US005514508A

United States Patent [19]

Fukami et al.

[11] Patent Number: 5,514,508

[45] Date of Patent: May 7, 1996

[54] ELECTROPHOTOSENSITIVE MATERIAL

[75] Inventors: Toshiyuki Fukami; Hideo Nakamori; Hiroshi Shiomi; Hirofumi Kawaguchi; Hisakazu Uegaito; Nariaki Muto; Mikio Kakui; Keisuke Sumida; Sakae Saito; Maki Uchida, all of Osaka, Japan

[73] Assignee: Mita Industrial Co., Ltd., Japan

[21] Appl. No.: 445,055

[22] Filed: May 19, 1995

[30] Foreign Application Priority Data

May 31, 1994 [JP] Japan ..... 6-119185
May 31, 1994 [JP] Japan ..... 6-119188

[51] Int. Cl.[6] ..... G03G 5/06

[52] U.S. Cl. ..... 430/76; 430/59

[58] Field of Search ..... 430/58, 59, 74, 430/76

[56] References Cited

U.S. PATENT DOCUMENTS

| | | | |
|---|---|---|---|
| 4,134,761 | 1/1979 | Okazaki et al. | 430/59 |
| 4,314,016 | 2/1982 | Ohta et al. | 430/58 |
| 4,352,876 | 10/1982 | Suzuki | 430/58 |
| 4,631,242 | 12/1986 | Emoto | 430/58 |
| 5,137,794 | 8/1992 | Kikuchi | 430/56 |
| 5,399,453 | 3/1995 | Dohi et al. | 430/59 |
| 5,415,962 | 5/1995 | Kanemaru et al. | 430/59 |

FOREIGN PATENT DOCUMENTS 3034564 3/1981 Germany .

*Primary Examiner*—John Goodrow
*Attorney, Agent, or Firm*—Beveridge, DeGrandi, Weilacher & Young

[57] ABSTRACT

The present invention provides an electrophotosensitive material having an improved sensitivity in comparison with a conventional one, obtained by combining a trinitrofluorenoneimine derivative represented by the formula (1):

(1)

[wherein $R^1$, $R^2$, $R^3$, $R^4$ and $R^5$ are the same or different and indicate a hydrogen atom, an alkyl group, an alkoxy group, an aryl group which may contain a substituent, an aralkyl group which may contain a substituent, or a halogen atom] as an electron transferring material with a prescribed electric charge generating material or hole transferring material.

13 Claims, 1 Drawing Sheet

ELECTROPHOTOSENSITIVE MATERIAL

BACKGROUND OF THE INVENTION

The present invention relates to an electrophotosensitive material which is used for image forming apparatuses such as copying apparatus and the like.

In the image forming apparatuses such as copying apparatus, etc., an organic photosensitive material (OPC) having a sensitivity within the wavelength range of a light source of the apparatus has exclusively been used.

As the organic photosensitive material, there have been known a single-layer type photosensitive material comprising a single-layer type photosensitive layer wherein an electric charge generating material and an electric charge transferring material are dispersed in a membrane of a suitable binding resin, a multi-layer type photosensitive material comprising an electric charge transferring layer containing the above electric charge transferring material and an electric charge generating layer containing an electric charge generating material, which are mutually laminated and the like.

Although those having a high carrier mobility are required as the electric charge transferring material to be used for these photosensitive materials, almost all of electric charge transferring materials having a high carrier mobility are hole transferring materials having hole transferring properties and, therefore, only negative charging type multi-layer type organic photosensitive materials, which are provided with an electric charge transferring layer at their outermost layer from the viewpoint of mechanical strength, are used for practical application. However, since the negatively charged type organic photosensitive material utilizes negative-polarity corona discharge, problems such as large amount of ozone generated, environmental pollution, deterioration of photosensitive material, etc. have arisen.

Accordingly, in order to eliminate the above drawbacks, it has been studied to use an electron transferring material as the electric charge transferring material. In Japanese Laid-Open Patent Publication No. 1-206349, there is suggested that a compound having a diphenoquinone structure is used as the electron transferring material for electrophotosensitive material.

However, it is difficult for electron transferring materials such as diphenoquinones to match with the electric charge generating material, which results in insufficient injection of electrons from the electric charge generating material into electron transferring material. Therefore, sufficient photosensitivity could not be obtained. Further, the single-layer type organic photosensitive layer had a problem that an interaction between diphenoquinone and a hole transferring material inhibits electrons from transferring.

Further, regarding the polarity of the photosensitive material to be charged, the scope of application of the photosensitive material can be widen if one photosensitive material can be used for both positively charged and negatively charged types. Further, if the organic photosensitive material can be used for the single-layer dispersion type, it becomes easy to produce the photosensitive material, thereby preventing generation of a coating defect. Therefore, there are many advantages for improving optical properties.

SUMMARY OF THE INVENTION

It is a main object of the present invention is to solve the above technical problem, thereby providing an electrophotosensitive material of which sensitivity is improved in comparison with a conventional one by smoothly injecting and transferring electrons from the electric charge generating material.

In order to accomplish the above object, the present inventors has studied intensively. As a result, it has been found that a trinitrofluorenoneimine derivative represented by the formula (1):

(1)

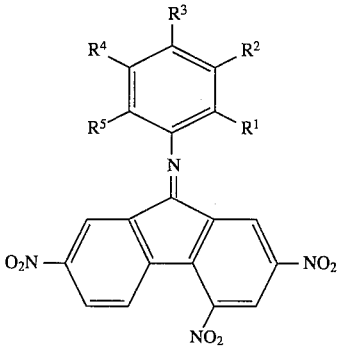

[wherein $R^1$, $R^2$, $R^3$, $R^4$ and $R^5$ are the same or different and indicate a hydrogen atom, an alkyl group, an alkoxy group, an aryl group which may contain a substituent, an aralkyl group which may contain a substituent, or a halogen atom] has a high electron transferring capability in comparison with a conventional diphenoquinone compound, and that, by combining this electron transferring material with the prescribed electric charge generating material or hole transferring material, electrons from the electric charge generating material are smoothly injected or transferred, thereby obtaining an electrophotosensitive material having an improved sensitivity is improved in comparison with a conventional one, thus the present invention has been accomplished.

That is, regarding the electrophotosensitive material of the present invention, an organic photosensitive layer provided on a conductive substrate comprises a binding resin, at least one sort selected from bisazo pigments represented by the formulas (I) to (V)

(I)

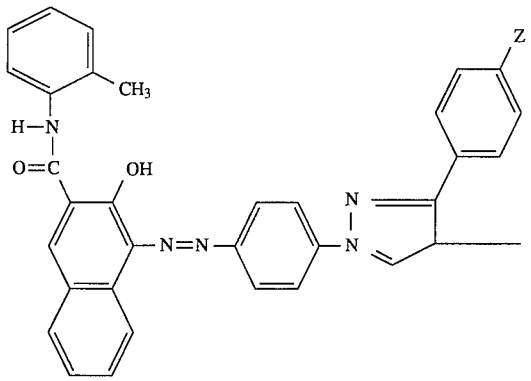

-continued
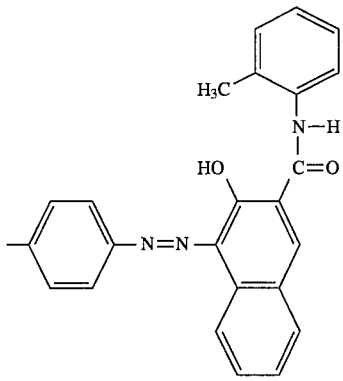
(II)
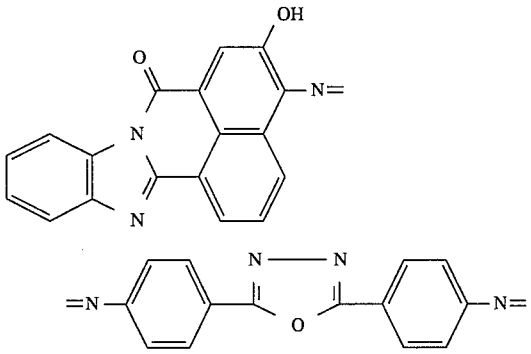
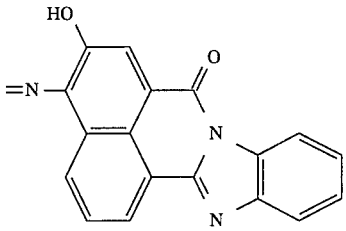
(III)
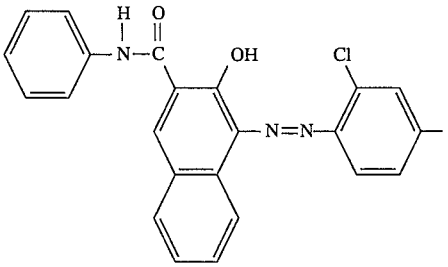
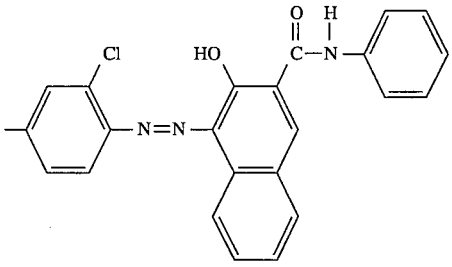
-continued
(IV)
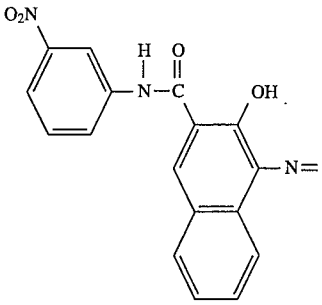
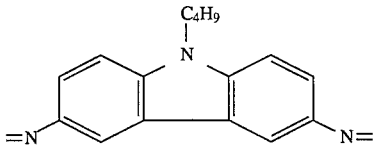
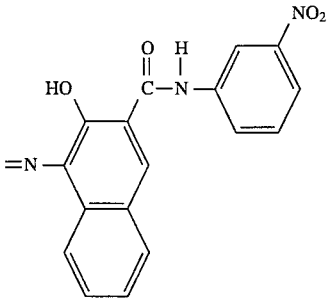
(V)
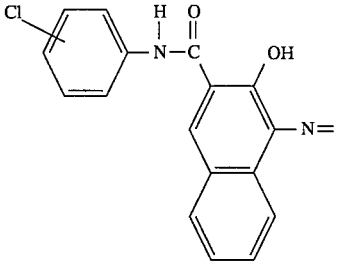
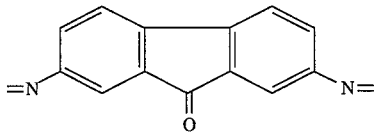
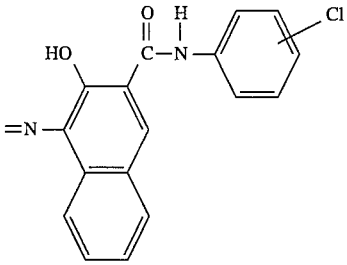
[in the formula (I), Z is a methyl group or a methoxy group] as an electric charge generating material and a trinitrofluorenoneimine derivative represented by the above formula (1) as an electron transferring material.

Further, regarding another electrophotosensitive material of the present invention, an organic photosensitive layer provided on a conductive substrate comprises a binding resin, an electric charge generating material, a trinitrofluorenoneimine derivative represented by the above formula (1) as an electron transferring material and at least one sort selected from benzidine derivatives represented by the following formulas (2) to (5) and a phenylenediamine derivative represented by the formula (6) as a hole transferring material.

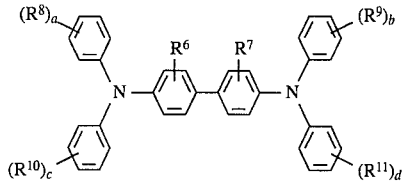

(2)

[wherein $R^6$ and $R^7$ are the same or different and indicate a hydrogen atom or an alkyl group; $R^8$, $R^9$, $R^{10}$ and $R^{11}$ are the same or different and indicate an alkyl group, an alkoxy group or a halogen atom; and a, b, c and d are the same or different and indicate an integer of 0 to 5; provided that at least one of a, b, c and d indicate an integer of 2 or more, and c and d indicate an integer other than 0 when a and b indicate 0, simultaneously]

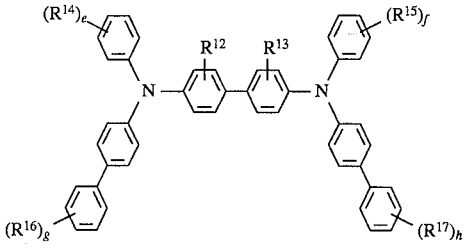

(3)

[wherein $R^{12}$ and $R^{13}$ are the same or different and indicate a hydrogen atom or an alkyl group; $R^{14}$ and $R^{15}$ are the same or different and indicate an alkyl group, an alkoxy group, an aryl group which may contain a substituent, or a halogen atom; $R^{16}$ and $R^{17}$ are the same or different and indicate an alkyl group, an alkoxy group or a halogen atom; and e, f, g and h are the same or different and indicate an integer of 0 to 5]

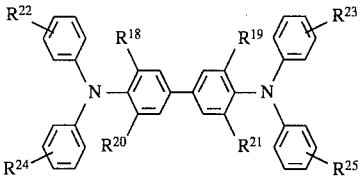

(4)

[wherein $R^{18}$, $R^{19}$, $R^{20}$ and $R^{21}$ are the same or different and indicate an alkyl group; and $R^{22}$, $R^{23}$, $R^{24}$ and $R^{25}$ are the same or different and indicate a hydrogen atom, an alkyl group, an alkoxy group, an aryl group which may contain a substituent, or a halogen atom]

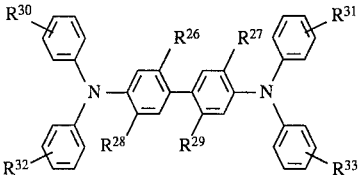

(5)

[wherein $R^{26}$, $R^{27}$, $R^{28}$ and $R^{29}$ are the same or different and indicate an alkyl group; and $R^{30}$, $R^{31}$, $R^{32}$ and $R^{33}$ are the same or different and indicate a hydrogen atom, an alkyl group, an alkoxy group, an aryl group which may contain a substituent, or a halogen atom]

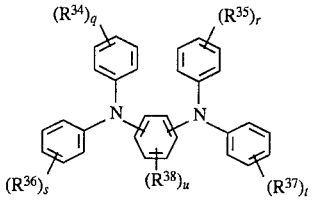

(6)

[wherein $R^{34}$, $R^{35}$, $R^{36}$ and $R^{37}$ are the same or different and indicate an alkyl group, an alkoxy group, an aryl group which may contain a substituent, a halogen atom, an amino group or a N-substituted amino group; $R^{38}$ is an alkyl group, an alkoxy group, a halogen atom, an amino group, a N-substituted amino group, an allyl group, an aryl group which may contain a substituent, or an electron attractive group; q, r, s and t are the same or different and indicate an integer of 0 to 5; and u is an integer of 0 to 2]

The trinitrofluorenoneimine derivative represented by the formula (1) as the electron transferring material is superior in solubility in solvent and good compatibility with binding resin, and is also superior in matching with the respective bisazo pigments represented by the formulas (I) to (V) as the electric charge generating material and, therefore, the electrons are smoothly injected. Particularly, it is superior in electron transferring properties in the low magnetic field. Further, since any of bulky substituents is introduced into the molecule of the trifluorenoneimine derivative, it is inhibited to form an electric charge transfer complex which can cause deterioration in sensitivity due to steric hindrance between the trifluorenoneimine derivative and hole transferring material, when it is used in combination with the hole transferring material.

Therefore, the electrophotosensitive material of the present invention has a high sensitivity within a visible region because the bisazo pigment selected from those represented by the formulas (I) to (V) responds to the wavelength of the visible region, and it can be suitably used for analog-optical image forming apparatuses.

On the other hand, the benzidine derivative represented by any one of the formulas (2) to (5) and phenylenediamine derivative represented by the formula (6), which are used in combination with the above trinitrofluorenoneimine derivative, are superior in hole transferring properties and Compatibility with binding resin. Further, since the benzidine derivative represented by any one of the formulas (2) to (5) has a high melting point, the glass transition temperature of the organic photosensitive layer can be improved. In addition, when the phenylenedimaine derivative represented by the formula (6) is added, the surface of the organic photosensitive layer is modified, thereby decreasing a friction coefficient and increasing a loss elastic modulus of the whole layer and, therefore, a wear resistance of the organic photosensitive layer can be improved.

Accordingly, the electrophotosensitive material of the present invention has a high sensitivity and is superior in durability and stability, thereby realizing high speed of image forming apparatuses such as copying apparatus, etc.

It is preferred that the organic photosensitive layer of the electrophotosensitive material of the present invention contains trinitrofluorenoneimine of the formula (1) as the electron transferring material, at least one sort selected from the bisazo pigments represented by the formulas (I) to (V) as the electric charge generating material and at least one sort selected from the benzidine derivatives represented by the formulas (2) to (5) and phenylenediamine derivative represented by the formula (6) as the hole transferring material.

It is preferred that the organic photosensitive layer of the electrophotosensitive material of the present invention contains an electron attractive compound having a redox potential of −0.8 to −1.4 V, in addition to the above respective components. The electrophotosensitive material containing the electron attractive compound has a higher sensitivity and is also superior in stability, as described hereinafter.

DETAILED DESCRIPTION OF THE INVENTION

Figure 1:
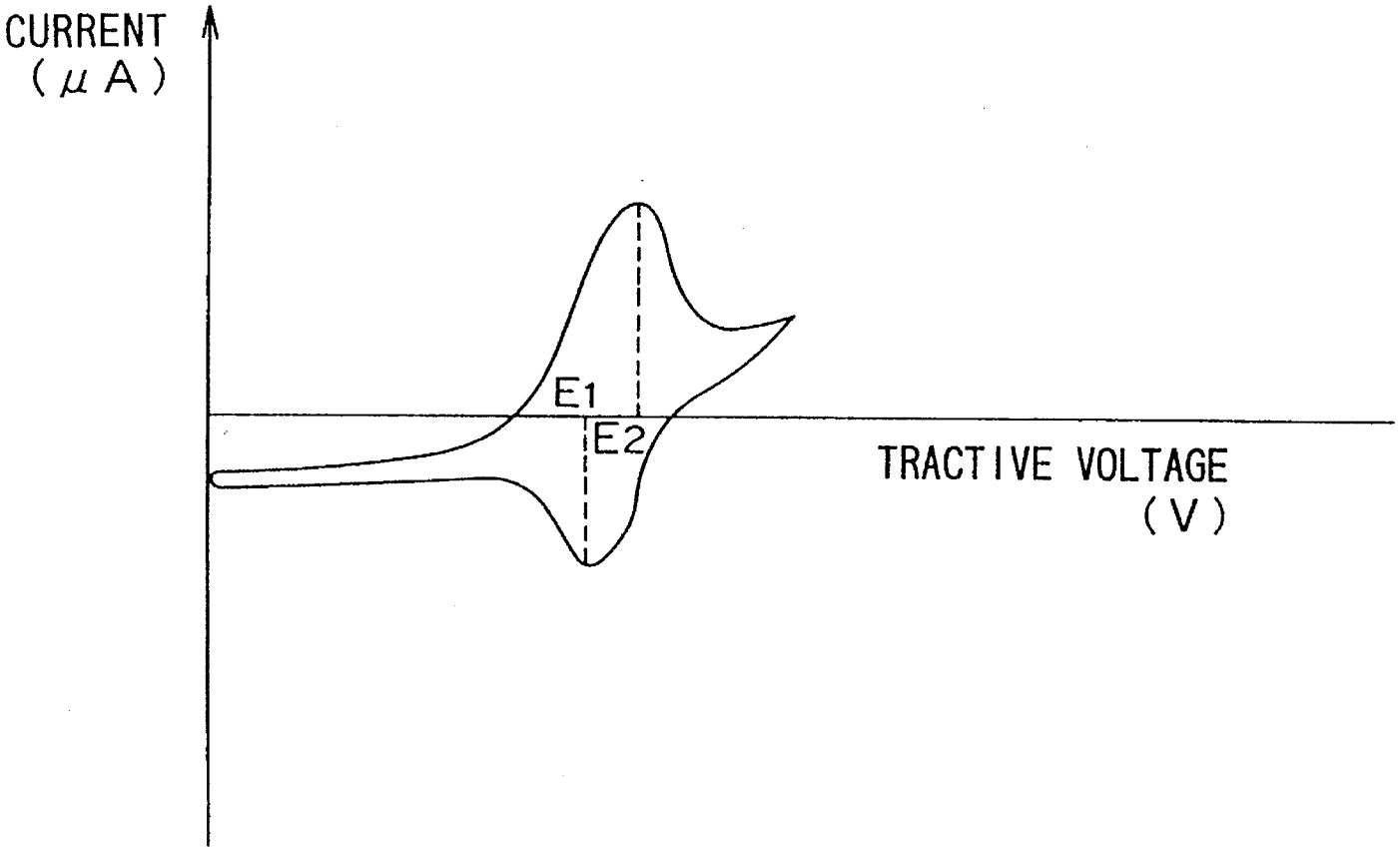
FIG. 1 iS a graph illustrating a relation between the tractive voltage (V) and current (A) for determining the redox potential of the electron attractive compound.

In the trinitrofluorenoneimine derivative represented by the formula (1), examples of the alkyl group corresponding to the groups $R^1$ to $R^5$ include alkyl groups having 1 to 6 carbon atoms, such as methyl group, ethyl group, n-propyl group, isopropyl group, t-butyl group, pentyl group, hexyl group and the like.

Examples of the alkoxy group include alkoxy groups having 1 to 6 carbon atoms, such as methoxy group, ethoxy group, propoxy group, t-butoxy group, pentyloxy group, hexyloxy group and the like.

Examples of the aryl group include phenyl group, o-terphenyl group, naphthyl group, anthryl group, phenanthryl group and the like. The aryl group may contain a substituent such as alkyl group, alkoxy group, halogen atom, etc. on any position, Examples of the aralkyl group include benzyl, α-phenethyl group, β-phenethyl group, 3-phenylpropyl group, benzhydryl group, trityl group and the like. The aralkyl group may contain a substituent such as alkyl group, alkoxy group, halogen atom, etc. on any position.

Examples of the halogen atom include chlorine, bromine, fluorine, and iodine.

As shown in the following reaction scheme, this derivative can be synthesized by condensing 2,4,7-trinitrofluorenone with aniline or its derivative in a solvent. Examples of the solvent include acetic acid, propionic acid, butyric acid, chloroform, tetrahydrofuran, dimethylformamide, dimethyl sulfoxide and the like. Further, the reaction may be conducted in the presence of a suitable catalyst such as zinc chloride, if necessary. The reaction may be normally conducted at a temperature of 30° to 170° C. for about 20 minutes to 4 hours.

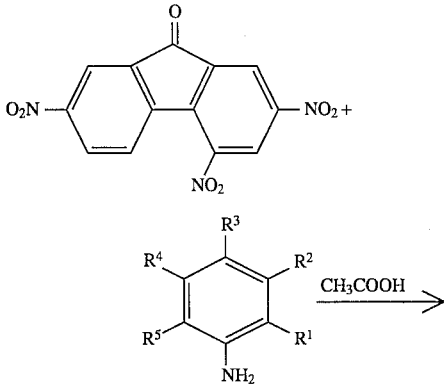

-continued

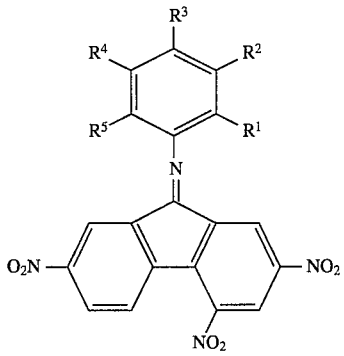

(1)

[wherein $R^1$ to $R^5$ are as defined above]

Preferred examples of the trinitrofluorenoneimine derivative include the compounds represented by the following formulas (7) to (9).

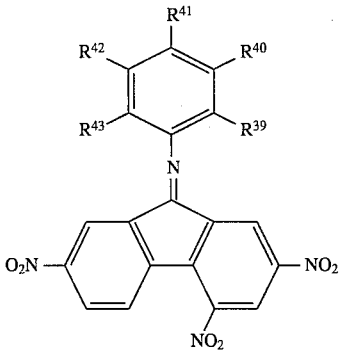

(7)

[wherein $R^{39}$, $R^{40}$, $R^{41}$, $R^{42}$ and $R^{43}$ are the same or different and indicate a hydrogen atom, an alkyl group, an alkoxy group or a halogen atom]

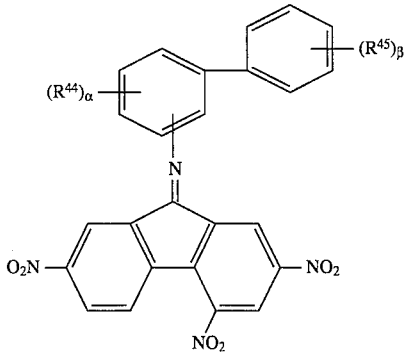

(8)

[wherein $R^{44}$ and $R^{45}$ are the same or different and indicate an alkyl group, an alkoxy group or a halogen atom; and α and β indicate an integer, the sum of which is 0 to 4]

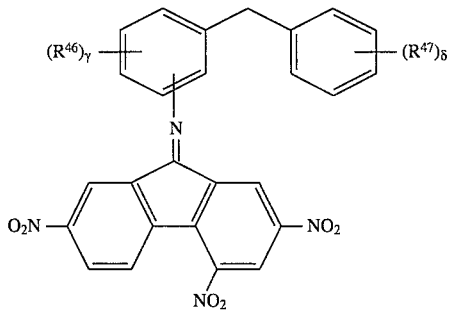

(9)

[wherein $R^{46}$ and $R^{47}$ are the same or different and indicate an alkyl group, an alkoxy group or a halogen atom; and γ and δ indicate an integer, the sum of which is 0 to 4]

Embodied compounds of the trinitrofluorenoneimine derivative are not specifically limited, but examples of the trinitrofluorenoneimine derivative represented by the formula (7) include the compounds represented by the following formulas (7a) to (7d).

(7a)

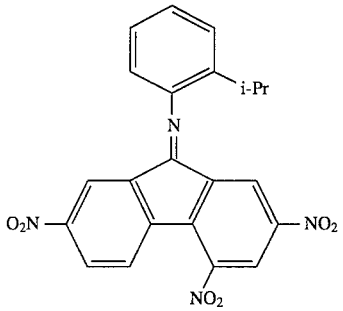

(7b)

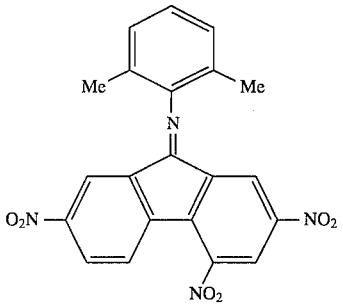

(7c)

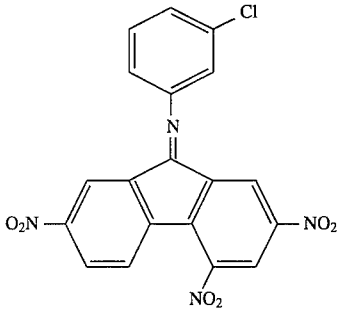

(7d)

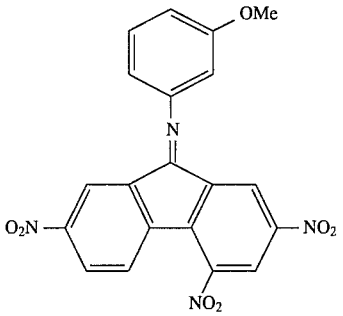

Further, examples of the trinitrofluorenoneimine derivative represented by the formula (8) include the compounds represented by the following formulas (8a) to (8d).

(8a)

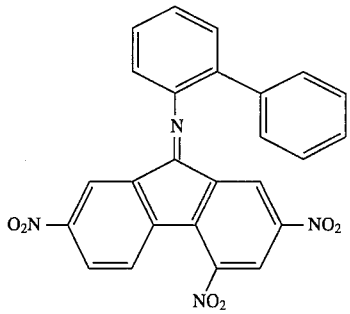

(8b)

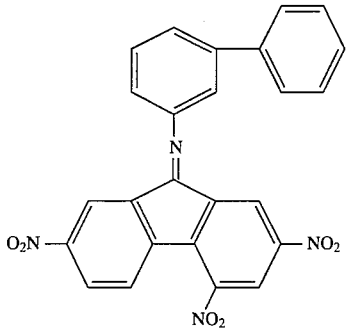

(8c)

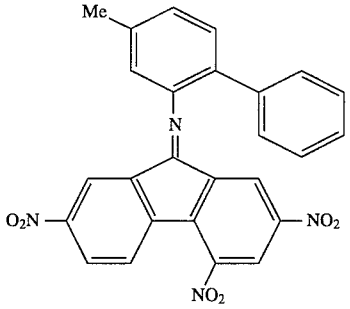

(8d)

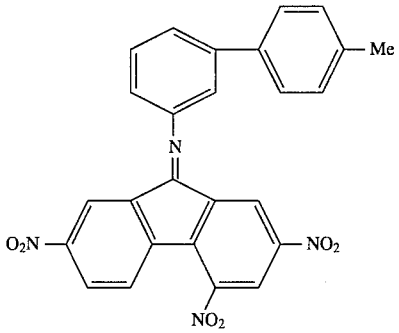

Further, examples of the trinitrofluorenoneimine derivative represented by the formula (9) include the compounds represented by the following formulas (9a) to (9d).

(9a)

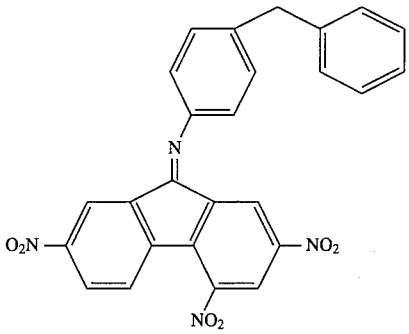

-continued (9b)

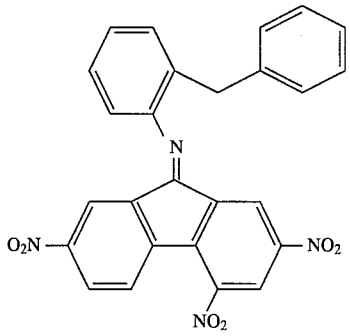

(9c)

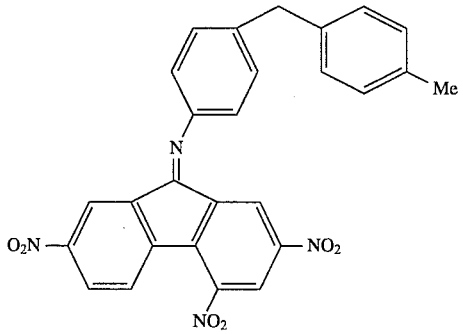

(9d)

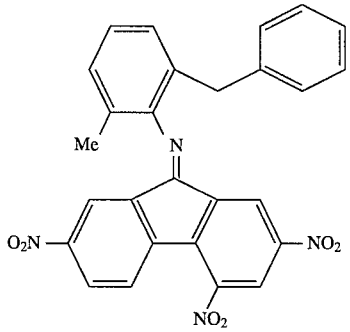

In the benzidine derivatives represented by the formulas (2) to (5), which are contained in the organic photosensitive layer as the hole transferring material, together with the trinitrofluorenoneimine derivative, examples of the alkyl group, alkoxy group, aryl group and halogen atom which correspond to any one of the groups $R^{12}$ to $R^{33}$ include the same groups as those described above.

In the phenylenediamine derivative represented by the formula (6), examples of the alkyl group, alkoxy group, aryl group and halogen atom which correspond to any one of the groups $R^{34}$ to $R^{38}$ include the same groups as those described above.

Examples of the N-substituted amino group corresponding to the groups $R^{34}$ to $R^{38}$ include methylamino group, dimethylamino group, ethylamino group, diethylamino group and the like.

Examples of the electron attractive group corresponding to the group $R^{38}$ include nitro group carbonyl group, carboxyl group, nitrile group and the like.

Among the above hole transferring materials, the benzidine derivative represented by the formula (2) has a high melting point in comparison with a conventional benzidine derivative (Japanese Patent Publication No. 5-21099) represented by the following formula (A):

(A)

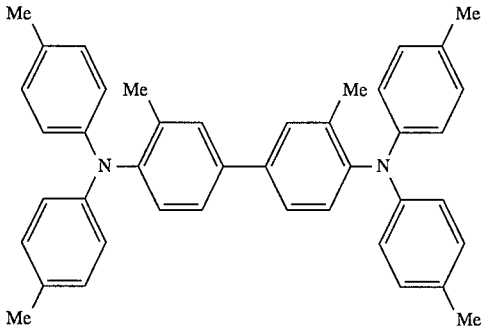

because at least one of four outer phenyl groups is substituted with two or more of alkyl group, alkoxy group or halogen atom and, therefore, the glass transition temperature of the photosensitive layer can be improved. Further, the benzidine derivative wherein the phenyl group other than that containing two or more substituents among outer four phenyl groups is substituted with an alkyl group having three or more carbon atoms is superior in compatibility with binding resin so that the hole transferring properties are improved in comparison with a conventional one.

Non-limited examples of the benzidine derivative represented by the formula (2) include the compounds represented by the following formulas (2a) to (2e).

(2a)

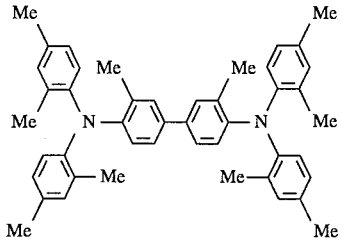

(2b)

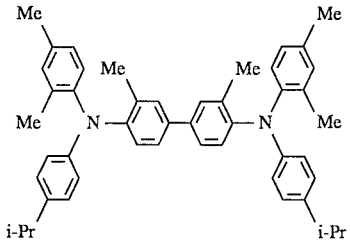

(2c)

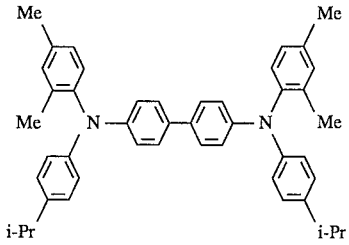

(2d)

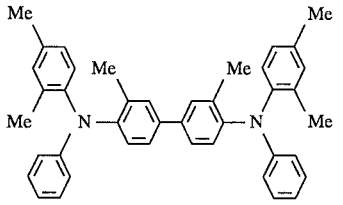

-continued

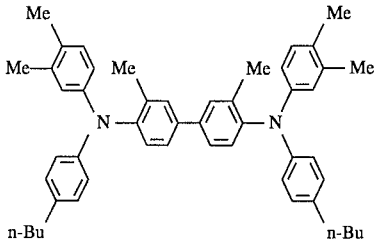

(2e)

The benzidine derivative represented by the formula (3) has a high melting point in comparison with a conventional benzidine derivative represented by the above formula (A) because at least two of four outer phenyl groups are further substituted with aryl groups such as phenyl group, etc. and, therefore, the glass transition temperature of the photosensitive layer can be improved. Further, the above benzidine derivative has large spreading of the π-electron conjugate system in comparison with a conventional one and, therefore, the hole transferring properties are also improved.

Non-limited examples of the benzidine derivative represented by the formula (3) include the compounds represented by the following formulas (3a) to (3g).

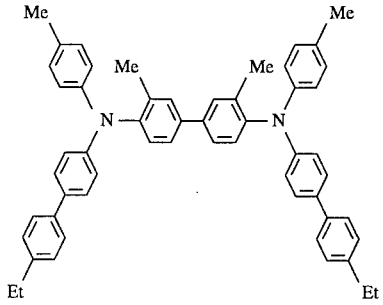

(3a)

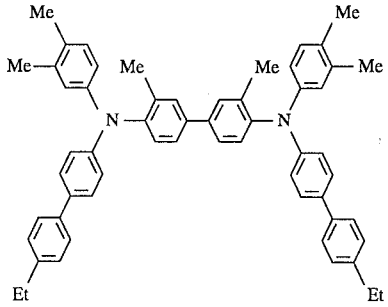

(3b)

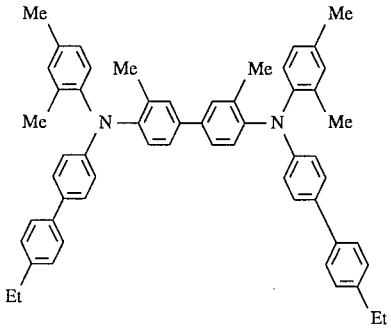

(3c)

-continued

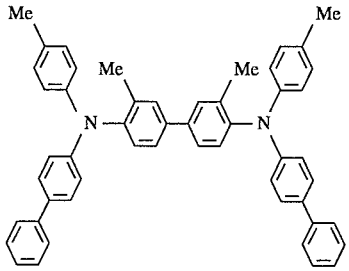

(3d)

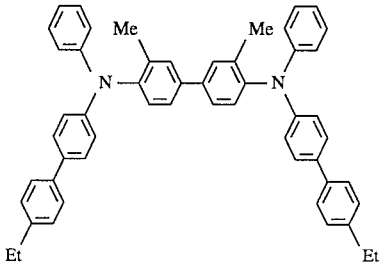

(3e)

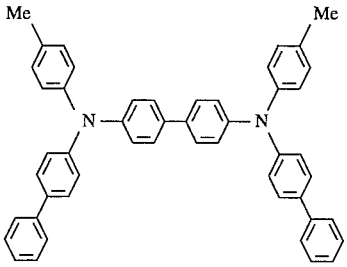

(3f)

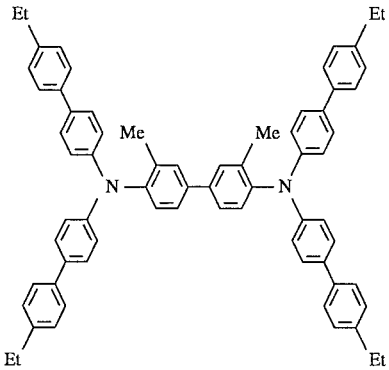

(3g)

The benzidine derivative represented by the formula (4) has a high melting point in comparison with a conventional benzidine derivative represented by the above formula (A) because biphenyl as its center skeleton is substituted with four alkyl groups and, therefore, the glass transition temperature of the organic photosensitive layer can be improved. Further, since the benzidine derivative wherein at least one of four outer phenyl groups is substituted with aryl groups such as phenyl group, etc. has a higher melting point, the glass transition temperature of the organic photosensitive material can be further improved.

Non-limited examples of the benzidine derivative represented by the formula (4) include the compounds represented by the following formulas (4a) to (4d).

(4a)

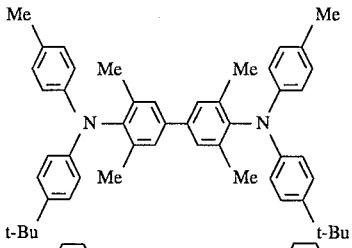

(4b)

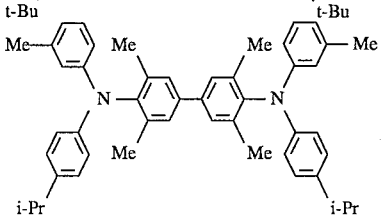

(4c)

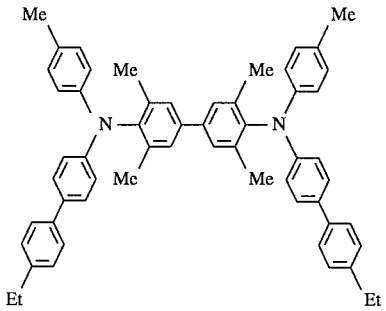

(4d)

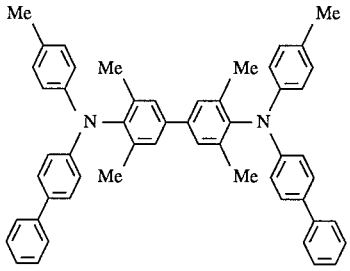

Similarly, the benzidine derivative represented by the formula (5) has a high melting point in comparison with a conventional benzidine derivative represented by the above formula (A) because biphenyl as its center skeleton is substituted with four alkyl groups and, therefore, the glass transition temperature of the organic photosensitive layer can be improved. Further, it is superior in compatibility with binding resin because the substitution position of four alkyl groups is unsymmetrical and, therefore, the hole transferring properties are also improved.

Examples of he benzidine derivative represented by the formula (5) include the compounds represented by the following formulas (5a) to (5d).

(5a)

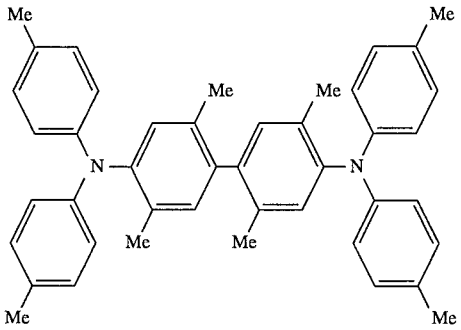

-continued (5b)

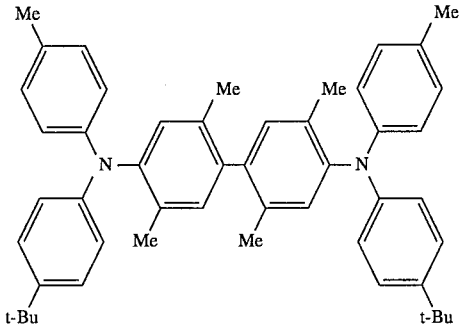

(5c)

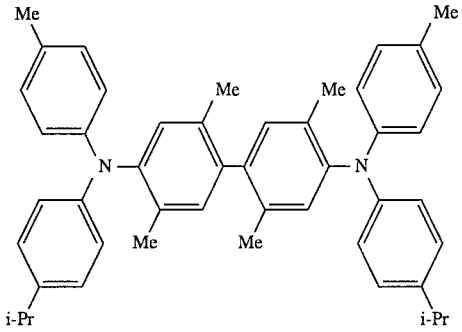

(5d)

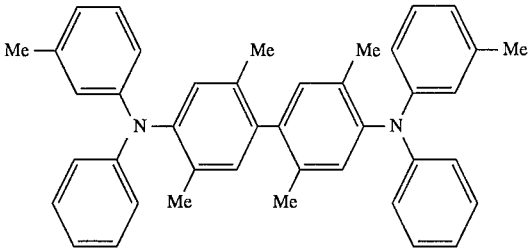

As described above, when the phenylenedimaine derivative represented by the formula (6) is added, the surface of the organic photosensitive layer is modified, thereby decreasing a friction coefficient and increasing a loss elastic modulus of the whole layer and, therefore, a wear resistance of the organic photosensitive layer can be improved.

The phenylenediamine derivative wherein four outer phenyl groups are substituted with two or more substituents or that wherein at least one of four phenyl groups and phenyl group as the center skeleton is substituted with aryl groups such as phenyl group, etc. has a high melting point and, therefore, the glass transition temperature of the organic photosensitive layer can be improved. Further, the phenylenediamine derivative wherein any one of the respective phenyl groups is substituted with an aryl group has large spreading of the π-electron conjugate system and, therefore, the hole transferring properties are also improved.

Further, the phenylenediamine derivative wherein the substitution position of the substituent on four outer phenyl groups is not 3-position but 2-position of the phenyl group or that wherein at least one of four phenyl groups is substituted with an alkyl group having three or more carbon atoms is superior in compatibility with binding resin and, therefore, the hole transferring properties are improved.

Non-limited examples of the benzidine derivative represented by the formula (6) include the compounds represented by the following formulas (6a) to (6n).

(6a)
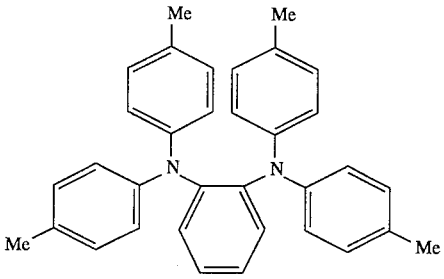
(6b)
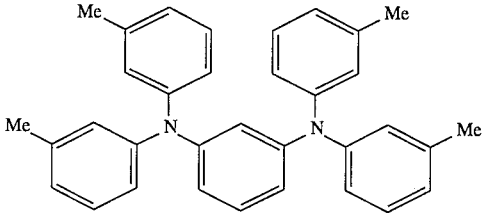
(6c)
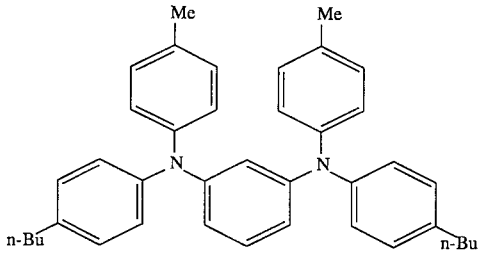
(6d)
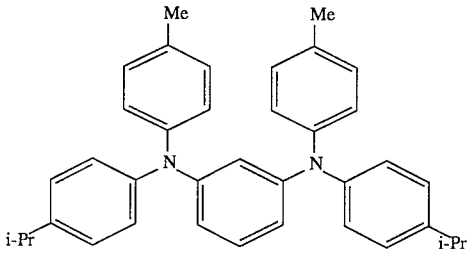
(6e)
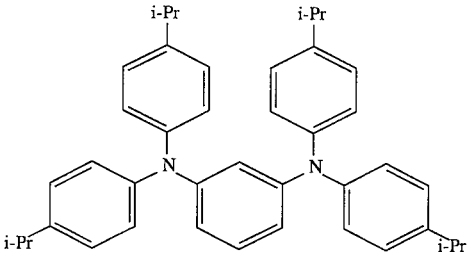
(6f)
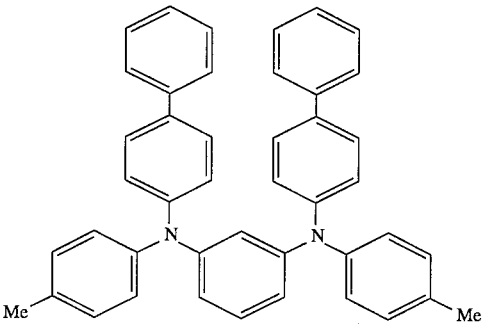
-continued
(6g)
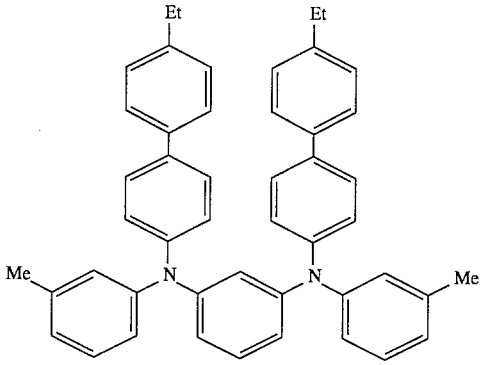
(6h)
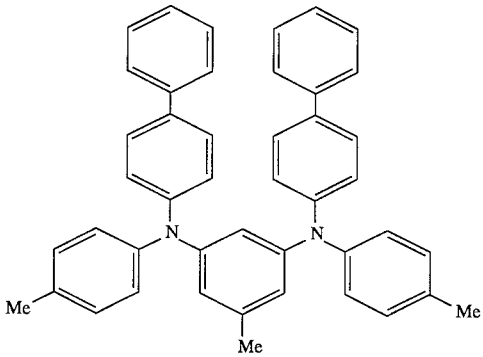
(6i)
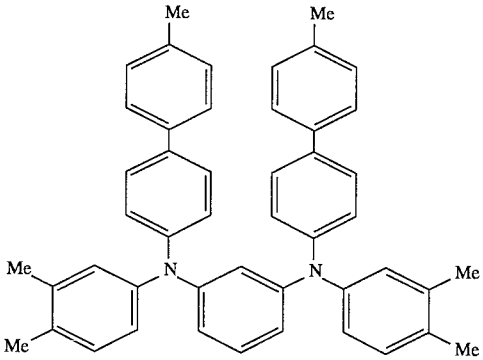
(6j)
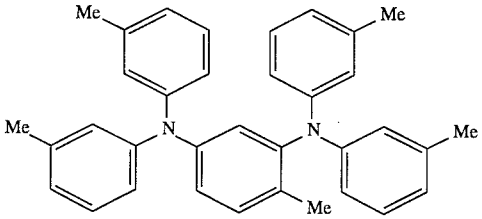
(6k)
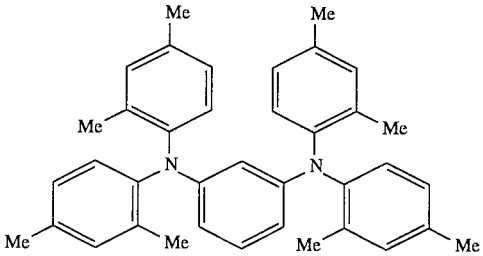

-continued (6l)

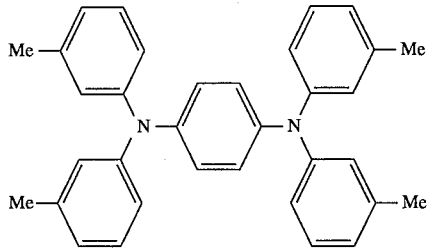

(6m)

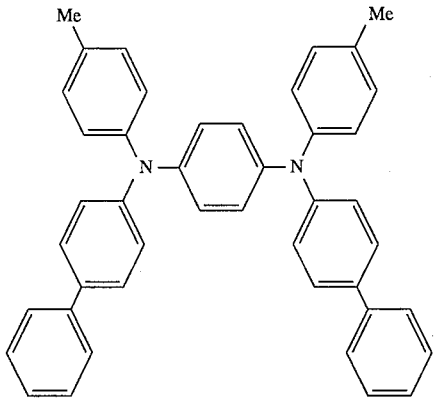

(6n)

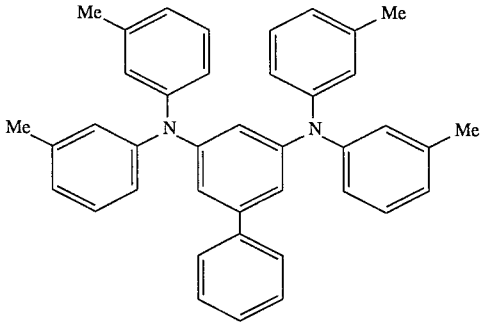

The organic photosensitive layer is classified into two types, that is, a single-layer type photosensitive layer containing the electron transferring material and hole transferring material in the same layer, together with the electric charge generating material, and a multi-layer type photosensitive material comprising the electric charge transferring layer and electric charge generating layer. Further, it is possible to use positively charged and negatively charged type photosensitive materials as the photosensitive material of the present invention. Particularly, it is preferred to use the positively charged type photosensitive material.

In the positively charged type photosensitive material, electrons emitted from the electron generating material in the exposure process are smoothly injected into the trinitrofluorenone derivative (electron transferring material) represented by the formula (1) and then transferred to the surface of the photosensitive layer by means of the giving and receiving of electrons between electron transferring materials to cancel the positive electric charge (+) which has previously been charged on the surface of the photosensitive layer. On the other hand, holes (+) are injected into the hole transferring material represented by any one of the formulas (2) to (6) and transferred to the surface of the conductive substrate without being trapped on the way, and then holes are canceled by the negative electric charge (–) which has previously been charged on the surface of the conductive substrate. It is considered that the sensitivity of the positively charged type photosensitive material is improved in this manner.

In the above-described combination of the trinitrofluorenoneimine derivative (1) as the electron transferring material with the benzidine derivative selected from those represented by the formulas (2) to (5) as the hole transferring material, as the electric charge generating material, there can be used selenium, selenium-tellurium, amorphous silicon, pyrilium salt, azo pigments, bisazo pigments (pigments of the formulas (2) to (5) are excluded), anthanthrone pigments, phthalocyanine pigments, naphthalocyanine pigments, indigo pigments, triphenylmethane pigments, threne pigments, toluidine pigments, pyrazoline pigments, quinacridone pigments, dithioketopyrrolopyrrole pigments and the like, in place of the bisazo pigments represented by the formulas (I) to (V). These electric charge generating materials can be used alone or in combination thereof to present an absorption wavelength within a desired range.

As the electric charge generating material suitable for the organic photosensitive material having a sensitivity within the wavelength range of 700 nm or more, which is particularly used for digital-optical image forming apparatuses using a light source such as semi-conductor, etc., there can be used phthalocyanine pigments such as X-type metal-free phthalocyanine, oxotitanyl phthalocyanine and the like. Since these phthalocyanine pigments are superior in matching with the above trinitrofluorenoneimine derivative represented by the formula (1), the electrophotosensitive material using both pigments in combination has a high sensitivity within the above wavelength range, and it can be suitably used for digital-optical image forming apparatuses.

As described above, the electron attractive compound having a redox potential of –0.8 to –1.4 V may be further added to the organic photosensitive layer. Regarding the electron attractive compound, the energy level of LUMO (which means the level of which energy is the lowest in molecular orbitals that is not occupied by electrons in the molecule, and electrons to be excited are normally moved to this level) is lower than that of the electric charge generating material. Therefore, it serves to extract electrons (–) generated in the electric charge generating material so that the electric charge-generating efficiency in the electric charge generating material is improved and, at the same time, the residual potential at the time of image forming is reduced, thereby realizing higher sensitivity.

Further, not only electric charge generating material, but also electric charge transferring material is excited at the time of light irradiation, which results in singlet excited state where the reactivity is high, therefore they are liable to be deteriorated or decomposed. In the presence of the electron attractive compound, the excited electric charge transferring material is quenched by the quenching effect so that photodeterioration is inhibited and the stability of the organic photosensitive material is also improved.

Since the electron attractive compound also serves as the electron transferring material, the sensitivity of the organic photosensitive material can be further enhanced by adding a large amount of the electron attractive compound which is particularly superior in compatibility with binding resin.

Non-limited examples of the electron attractive compound include quinones (e.g. benzoquinone derivatives, naphthoquinone derivatives, anthraquinone derivatives, diphenoquinone derivatives, etc.), malononitrile compounds, thiopyran compounds, fluorenone compounds (e.g. 3,4,5,7-tetranitro-9-fluorenone, etc.), tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, dibromomaleic anhydride, etc. Among them, examples of the preferred compound include quinones such as diphenoquinone derivative represented by the formula (10):

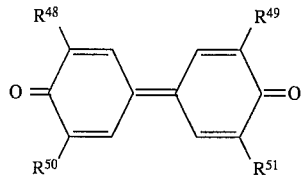

(10)

[wherein $R^{48}$, $R^{49}$, $R^{50}$ and $R^{51}$ are the same or different and indicate a hydrogen atom, an alkyl group, an alkoxy group, an aryl group, an aralkyl group, a cycloalkyl group, an amino group, a N-substituted amino group or a halogen atom], p-benzoquinone derivative represented by the formula (11):

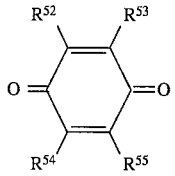

(11)

[wherein $R^{52}$, $R^{53}$, $R^{54}$ and $R^{55}$ are the same or different and indicate a hydrogen atom, an alkyl group, an alkoxy group, an aryl group, an aralkyl group, a cycloalkyl group, an amino group, a N-substituted amino group or a halogen atom]. Among them, the diphenoquinoine derivative is particularly preferred because a quinone oxygen atom having excellent electron attractive properties is bonded to the molecular chain terminal and a conjugate double bond exists along with the whole long molecular chain, thereby facilitating electron transfer in the molecule as well as giving and receiving of electrons between molecules.

In the quinone derivatives represented by the above formulas (10) and (11), examples of the cycloalkyl group corresponding to any one of the groups $R^{48}$ to $R^{55}$ include cycloalkyl groups having 3 to 7 carbon atoms, such as cyclopropyl group, cyclobutyl group, cyclopentyl group, cyclohexyl group, cycloheptyl group and the like. Examples of the alkyl group, alkoxy group, aryl group, aralkyl group, amino group, N-substituted amino group and halogen atom include the same groups as those described above.

Embodied compounds of the quinones as the electron attractive compound are not specifically limited, but examples of the diphenoquinone derivative represented by the formula (10) include the compounds represented by the following formulas (10a) to (10b).

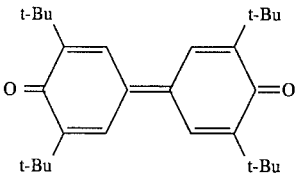

(10a)

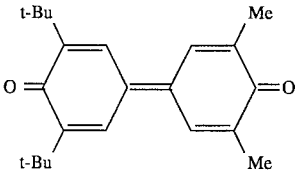

(10b)

The redox potential of the diphenoquinone derivative represented by the formula (10a) is −0.94 V and that of the diphenoquinone derivative represented by the formula (10b) is −0.86 V.

Further, examples of the p-benzoquinone derivative represented by the formula (11) include the compound represented by the following formula (11a).

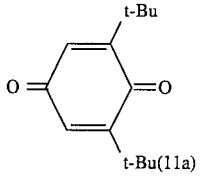

The redox potential of the p-benzoquinone derivative represented by the formula (11a) is −1.30 V.

As described above, the redox potential of the electron attractive compound is limited within a range of −0.8 to −1.4 V. The electron attractive compound having the redox potential of less than −0.8 V makes a separated free carrier (particularly, electron) to fall into the level where detrapping can not be effected to cause carrier trapping. Therefore, the photosensitivity is deteriorated and the residual potential becomes high.

On the other hand, regarding the electron attractive compound having the redox potential of more than −1.4 V, the energy level of LUMO becomes higher than that of the electric charge generating material so that the above-described electron-extracting effect is not obtained, which fails to improve the electric charge-generating efficiency.

The redox potential will be measured by means of a three-electrode system cyclic voltametry using the following materials.

Electrode: Working electrode (glassy carbon electrode), Counter electrode (platinum electrode)

Reference electrode: Silver nitrate electrode (0.1 moles/litter $AgNO_3$-acetonitrile solution)

Measuring solution: Electrolyte: t-Butylammmonium perchlorate (0.1 moles)

Measuring substance: Electron transferring material (0.001 moles)

Solvent: $CH_2Cl_2$ (1 litter)

The above materials are mixed to prepare a measuring solution.

Calculation of redox potential: As shown in FIG. 1, a relation between the tractive voltage (V) and current (μA) is determined to measure $E_1$ and $E_2$ shown in the same figure, then the redox potential is determined according to the following calculation formula:

$$\text{Redox potential}=(E_1+E_2)/2\ (V)$$

As the binding resin for dispersing the above respective components, there can be used various resins which have hitherto been used for the organic photosensitive layer, and examples thereof include thermoplastic resins such as styrene polymer, styrene-butadiene copolymer, styrene-acrylonitrile copolymer, styrene-maleic acid copolymer, acrylic polymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyarylate, polysulfon, diaryl phthalate resin, ketone resin, polyvinyl butyral resin, polyether resin, polyester resin, etc.; crosslinking thermosetting resins such as silicone resin, epoxy resin, phenol resin, urea resin, melamine resin, etc.; photosetting resins such as epoxy acrylate, urethane acrylate, etc. These binding resins can be used alone or in combination thereof. Suitable resins are styrene polymer, acrylic polymer, styrene-acrylic copolymer, polyester, alkyd resin, polycarbonate, polyarylate and the like.

Further, various additives known to the public, such as deterioration inhibitors (e.g. antioxidants, radical scavengers, singlet quenchers, ultraviolet absorbers, etc.), softeners, plasticizers, surface modifiers, bulking agents, thickening agents, dispersion stabilizers, wax, acceptors, donors, etc. can be formulated in the photosensitive layer without injury to the electrophotographic characteristics. The amount of these additives to be added may be the same as that used in a conventional technique. For example, it is preferred that a steric hindered phenolic antioxidant is formulated in the amount of about 0.1 to 50 parts by weight, based on 100 parts by weight of the binding resin.

In order to improve the sensitivity of the photosensitive layer, known sensitizers such as terphenyl, halonaphthoquinones, acenaphthylene, etc. may be used in combination with the electric charge generating material.

Further, other electric charge generating materials which have hitherto been known can be formulated in the photosensitive layer, together with the bisazo pigment represented by any one of the formulas (I) to (V). Examples of the electric charge generating material include selenium, selenium-tellurium, amorphous silicon, pyrilium salt, azo pigments, bisazo pigments other than those described above, anthanthrone pigments, phthalocyanine pigments, naphthalocyanine pigments, indigo pigments, triphenylmethane pigments, threne pigments, toluidine pigments, pyrazoline pigments, quinacridone pigments, dithioketopyrrolopyrrole pigments and the like. These electric charge generating materials can be used alone or in combination thereof to present an absorption wavelength within a desired range.

Further, other electron transferring materials which have hitherto been known can be formulated in the photosensitive layer, together with the trinitrofluorenoneimine derivative represented by the formula (1). Examples of the electron transferring material include benzoquinone compounds, diphenoquinone compounds, malononitrile compounds, thiopyran compounds, tetracyanoethylene, 2,4,8-trinitrothioxanthone, fluorenone compounds (e.g. 3,4,5,7-tetranitro-9-fluorenone, etc.), dinitrobenzene, dinitroanthracene, dinitroacridine, nitroanthraquinone, dinitroanthraquinone, succinic anhydride, maleic anhydride, dibromomaleic anhydride and the like. These electric transferring materials are used alone or in combination thereof.

Further, other hole transferring materials which have hitherto been known may be formulated in the photosensitive layer, together with the hole transferring materials represented by the formulas (2) to (6). Examples of the hole transferring material include nitrogen-containing cyclic compounds and condensed polycyclic compounds, e.g. oxadiazole compounds such as 2,5-di(4-methylaminophenyl), 1,3,4-oxadiazole, etc.; styryl compounds such as 9-(4-diethylaminostyryl)anthracene, etc.; carbazole compounds such as polyvinyl carbazole, etc.; organosilicon compounds; pyrazoline compounds such as 1-phenyl-3-(p-dimethylaminophenl)pyrazoline, etc.; hydrazone compounds; triphenylamine compounds; indol compounds; oxazole compounds; isooxazole compounds, thiazole compounds; thiadiazole compounds; imidazole compounds; pyrazole compounds; triazole compounds and the like. These hole transferring materials are used alone or in combination thereof. Further, the binding resin is not necessarily required when using the hole transferring material having film forming properties, such as polyvinyl carbazole, etc.

As the conductive substrate used for the photosensitive material of the present invention, various materials having a conductivity can be used, and examples thereof include metals such as aluminum, copper, tin, platinum, silver, vanadium, molybdenum, chromium, cadmium, titanium, nickel, palladium, indium, stainless steel, brass, etc.; plastic materials vapor-deposited or laminated with the above metal; glass materials coated with aluminum iodide, tin oxide, indium oxide, etc.

The conductive substrate may be made in the form of a sheet or a drum. The substrate itself may have a conductivity or only the surface of the substrate may have a conductivity. It is preferred that the conductive substrate has a sufficient mechanical strength when used.

The photosensitive layer in the present invention is produced by applying a coating solution, which is prepared by dissolving or dispersed a resin composition containing the above-described respective components in a solvent, on the conductive substrate, followed by drying.

The effect due to the use of the electric charge generating material, electron transferring material and hole transferring material in the present invention can be obtained in the single-layer type photosensitive material, particularly. The single-layer type photosensitive material of the present invention can be applied to positively charged and negatively charged type photosensitive materials, and it is particularly preferred to use for the positively charged type photosensitive material.

In the single-layer type electrophotosensitive material, it is preferred that the electric charge generating material may be formulated in the photosensitive layer in the amount of 0.5 to 20 parts by weight, particularly 0.5 to 10 parts by weight, based on 100 parts by weight of the binding resin.

It is preferred that the hole transferring material may be formulated in the photosensitive layer in the amount of 5 to 200 parts by weight, particularly 30 to 150 parts by weight, based on 100 parts by weight of the binding resin.

It is preferred that the electron transferring material may be formulated in the photosensitive layer in the amount of 5 to 100 parts by weight, particularly 10 to 80 parts by weight, based on 100 parts by weight of the binding resin.

When the electron attractive compound is added, the amount of the electron attractive compound is preferably 0.01 to 100 parts by weight, particularly 0.1 to 30 parts by weight, based on 100 parts by weight of the binding resin.

In the single-layer type photosensitive material, the thickness of the photosensitive layer to be formed is preferably 5 to 50 μm, particularly 10 to 40 μm.

Further, in order to obtain the multi-layer type photosensitive material, the electric charge generating material may be deposited alone on the conductive substrate to form an electric charge generating layer (vapor deposition type electric charge generating layer), or an electric charge generating layer (resin dispersion type electric charge generating layer) containing the electric charge generating material, binding resin and, if necessary, hole transferring material may be formed using a means such as coating, followed by forming an electric charge transferring layer containing the electron transferring material and binding resin on this electric charge generating layer. On the contrary, the electric charge generating layer may be formed after forming the electric charge transferring layer on the conductive substrate.

In the multi-layer photosensitive material, the electric charge generating material and the binding resin which constitute the resin dispersion type electric charge generating layer may be used in various proportions. It is preferred that the electric charge generating material may be used in the amount of 5 to 1000 parts by weight, particularly 30 to 500 parts by weight, based on 100 parts by weight of the binding resin. Further, when the electron attractive compound is added to the resin dispersion type electric charge generating layer, the amount is preferably 0.1 to 100 parts by weight, particularly 1 to 30 parts by weight, based on 100 parts by weight of the binding resin.

The electron transferring material and binding resin which constitute the electric charge transferring layer can be used in various proportions within such a range as not to prevent the transfer of electrons and to prevent the crystallization. It is preferred that the electron transferring material may be used in the amount of 10 to 500 parts by weight, particularly 25 to 200 parts by weight, based on 100 parts by weight of the binding resin to easily transfer electrons generated by light irradiation in the electric charge generating layer. Further, when the electron attractive compound is added to the electric charge transferring layer, the amount of the electron attractive compound is preferably 0.01 to 100 parts by weight, particularly 0.1 to 30 parts by weight, based on 100 parts by weight of the binding resin.

In the multi-layer type photosensitive layer, the thickness of the electric charge generating layer is preferably about 0.01 to 5 μm, particularly about 0.1 to 3 μm, and that of the electric charge transferring layer is preferably about 2 to 100 μm, particularly about 5 to 50 μm.

On the other hand, a conventional multi-layer type photosensitive material having the electric charge transferring layer containing the hole transferring material has a problem that photofatigue has arisen by exposure or discharge at the time of repeated using, thereby causing deterioration of charging properties and sensitivity. However, when the trinitrofluorenoneimine derivative (1) to be used as the electric charge transferring material is formulated in the electric charge transferring layer, together with the hole transferring material, a multi-layer type photosensitive material having an excellent light resistance can be obtained.

The reason is not appear, but is considered as follows. That is, when the electric charge transferring layer is formed, the bisazo pigment molecule is eluted from the electric charge generating layer to the vicinity of the interface between both layers, and electrons trapped by the bisazo pigment are extracted by the trinitrofluorenoneimine derivative (1) to transfer to the electric charge generating layer, thereby inhibiting deterioration of charging properties. Further, the trinitrofluorenoneimine derivative (1) also serves as the quencher and is effective for inhibiting photo-deterioration of the electric charge transferring material.

In the electric charge transferring layer, the hole transferring material may be added in the amount of 30 to 200 parts by weight, preferably 50 to 150 parts by weight, based on 100 parts by weight of the binding resin. Further, the trinitrofluorenoneimine derivative (1) may be added in the amount of 0.1 to 30 parts by weight, preferably 0.5 to 10 parts by weight, based on 100 parts by weight of the binding resin. Others are the same as those described in the above-described multi-layer type photosensitive material.

A barrier layer may be formed, in such a range as not to injure the characteristics of the photosensitive material, between the conductive substrate and photosensitive layer in the single-layer type photosensitive material, or between the conductive substrate and electric charge generating layer or between the conductive substrate layer and electric charge transferring layer in the multi-layer type photosensitive material. Further, a protective layer may be formed on the surface of the photosensitive layer.

When the above photosensitive layer is formed by a coating method, the electric charge generating material, electric charge transferring material and binding resin may be dispersed and mixed with a suitable solvent by a known method, for example, using a roll mill, a ball mill, an attritor mill, a paint shaker, a supersonic dispenser, etc. to prepare a dispersion, which is applied by a known means and then allowed to dry.

As the solvent for preparing the dispersion, there can be used Various organic solvents, and examples thereof include alcohols such as methanol, ethanol, isopropyl alcohol, butanol, etc.; aliphatic hydrocarbons such as n-hexane, octane, cyclohexane, etc.; aromatic hydrocarbons such as benzene, toluene, xylene, etc.; halogenated hydrocarbons such as dichloromethane, dichloroethane, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde, dimethylformamide, dimethyl sulfoxide, etc. These solvents may be used alone or in combination thereof.

In order to improve a dispersibility of the electric charge transferring material and electric charge generating material as well as a smoothness of the surface of the photosensitive layer, there may be used surfactants, leveling agents, etc.

EXAMPLES

The following Examples and Comparative Examples further illustrate the present invention in detail.

Examples 1 to 36

(Single-layer type photosensitive material for analog light source)

5 Parts by weight of a bisazo pigment represented by any one of the formulas (I) to (V) [Z in the formula (I) is a methyl group and a chlorine atom in the formula (V) is substituted on the 3-position of a phenyl group] as the electric charge generating material (hereinafter referred to as CGM in Tables), 70 parts by weight of a benzidine derivative represented by the formula (A) as the hole transferring material (hereinafter referred to as HTM in Tables), 20 parts by weight of a trinitrofluorenoneimine derivative represented by any one of the formulas (7) to (9) as the electron transferring material (hereinafter referred to as ETM in Tables) and 100 parts by weight of polycarbonate as the binding resin were mixed and dispersed with 800 parts by weight of tetrahydrofuran as the solvent for 50 hours, using a ball mill, to prepare a coating solution for single-layer type photosensitive layer. Then, this coating solution was applied on an aluminum tube as the conductive substrate by a dip coating method, followed by hot-air drying at 100° C. for 60 minutes to give a single-layer type photosensitive material for analog light source which has a single-layer type photosensitive layer of 15 to 20 μm in film thickness.

Comparative Examples 1 to 6

According to the same manner as that described in Examples 1 to 36 except for using 5 parts by weight of a perylene pigment represented by the formula (P):

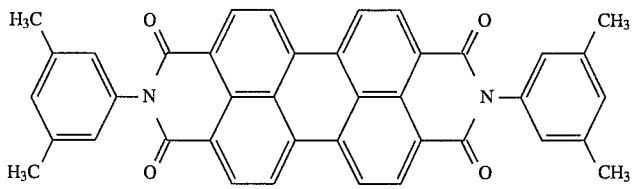

(P)

as the electric charge generating material, a single-layer type photosensitive material for analog light source, which has a single-layer type photosensitive layer of 15 to 20 μm in film thickness, was produced.

Embodied compounds of the electric charge generating material, hole transferring material, electron transferring material, etc. used in the above Examples and Comparative Examples area shown in the tables, using the above-described compound No. (same with the following Examples and Comparative Examples).

The following test was conducted as to the single-layer type photosensitive materials of the above respective Examples and Comparative Examples, and their characteristics were evaluated.

Photensensitivity test

By using a drum sensitivity tester manufactured by GENTEC Co., a voltage was applied on the surface of the photosensitive materials of the respective Examples and Comparative Examples to charge the surface at +700 V. Then, white light (having light intensity of 147 $\mu W/cm^2$ at a wavelength of 780 nm) from a halogen lamp as an exposure light source was irradiated on the surface of the photosensitive material (irradiation time: 50 msec.). Further, a surface potential at the time at which 330 msec. has passed since the beginning of exposure was measured as a potential after exposure $V_L$ (V). The results are shown in Tables 1 and 2, respectively.

TABLE 1

| EXAMPLE NO. | CGM | HTM | ETM | $V_L$ (V) |
|---|---|---|---|---|
| 1 | I | A | 7a | 198 |
| 2 | II | A | 7a | 204 |
| 3 | III | A | 7a | 206 |
| 4 | IV | A | 7a | 202 |
| 5 | V | A | 7a | 210 |
| 6 | I | A | 7b | 195 |
| 7 | II | A | 7b | 201 |
| 8 | III | A | 7b | 203 |
| 9 | IV | A | 7b | 199 |
| 10 | V | A | 7b | 207 |
| 11 | I | A | 7c | 210 |
| 12 | I | A | 7d | 180 |
| 13 | I | A | 8a | 210 |
| 14 | II | A | 8a | 216 |
| 15 | III | A | 8a | 218 |
| 16 | IV | A | 8a | 214 |
| 17 | V | A | 8a | 223 |
| 18 | I | A | 8b | 208 |
| 19 | II | A | 8b | 214 |
| 20 | III | A | 8b | 216 |
| 21 | IV | A | 8b | 212 |

TABLE 2

| EXAMPLE NO. | CGM | HTM | ETM | $V_L$ (V) |
|---|---|---|---|---|
| 22 | V | A | 8b | 220 |
| 23 | I | A | 8c | 195 |

TABLE 2-continued

| EXAMPLE NO. | CGM | HTM | ETM | $V_L$ (V) |
|---|---|---|---|---|
| 24 | I | A | 8d | 189 |
| 25 | I | A | 9a | 210 |
| 26 | II | A | 9a | 216 |
| 27 | III | A | 9a | 218 |
| 28 | IV | A | 9a | 214 |
| 29 | V | A | 9a | 223 |
| 30 | I | A | 9b | 200 |
| 31 | II | A | 9b | 216 |
| 32 | III | A | 9b | 208 |
| 33 | IV | A | 9b | 204 |
| 34 | V | A | 9b | 212 |
| 35 | I | A | 9c | 196 |
| 36 | I | A | 9d | 189 |
| COMP. EX. 1 | P | A | 7a | 248 |
| COMP. EX. 2 | P | A | 7b | 244 |
| COMP. EX. 3 | P | A | 8a | 263 |
| COMP. EX. 4 | P | A | 8b | 260 |
| COMP. EX. 5 | P | A | 9a | 263 |
| COMP. EX. 6 | P | A | 9b | 250 |

As is apparent from the results in Tables 1 and 2, the photosensitive materials of Examples 1 to 36 of the present invention are superior in sensitivity characteristics to those of Comparative Examples 1 to 6 because of their low potential after exposure $V_L$ (V).

Examples 37 to 64

According to the same manner as that described in Examples 1 to 36 except for using 70 parts by weight of a compound which belongs to the benzidine derivative represented by the formula (2) as the hole transferring material, a single-layer type photosensitive material for analog light source, which has a single-layer type photosensitive layer of 15 to 20 μm in film thickness, was produced.

The above photosensitivity test and the following tests were conducted as to the single-layer type photosensitive materials of the above respective Examples, and their characteristics were evaluated.

Measurement of glass transition temperature

About 5 mg of a photosensitive layer was peeled off from the photosensitive materials of the respective Examples and put in an exclusive aluminum pan, followed by sealing to prepare a sample, respectively. Then, this sample was measured under the following condition using a differential scanning calorimeter (Model DSC8230D, manufactured by Rikagaku Denki Co., Ltd.). An extrapolated glass transition initiation temperature (Tig) was determined from the results according to JIS K 7121 "Method for Measuring Transition Temperature of Plastics".

Environmental gas: Air

Heating rate: 20° C./minute

High-temperature resistance test

A photosensitive material of the respective Examples was fit with an imaging unit of a facsimile for paper (Model LDC-650, manufactured by Mita Kogyo Co., Ltd.) and, after standing at an environmental temperature of 50° C. for 10 days in such a state that a cleaning blade keeps in contact with the surface of the photosensitive material under linear pressure of 1.5 g/mm, the surface state of the photosensitive layer was measured using an universal surface shape tester (Model SE-3H, manufactured by Kosaka Kenkyusho) and a maximum depth of dent was recorded, respectively. Incidentally, the description of "less than 0.3 μm" in the item of the dent in Table 2 means that no dent was observed because the surface roughness of a normal photosensitive material having no dent is about 0.5 μm.

The results are shown in Tables 3 and 4, together with those of the above respective tests in Examples 1, 6, 11 and 12.

TABLE 3

| EXAMPLE NO. | CGM | HTM | ETM | $V_L$ (V) | Tig (°C.) | DENT (μm) |
|---|---|---|---|---|---|---|
| 37 | I | 2a | 7a | 113 | 82.4 | <0.3 |
| 38 | I | 2b | 7a | 116 | 78.8 | <0.3 |
| 39 | I | 2c | 7a | 110 | 80.9 | <0.3 |
| 40 | I | 2d | 7a | 143 | 79.5 | <0.3 |
| 41 | I | 2e | 7a | 120 | 80.2 | <0.3 |
| 42 | I | 2a | 7b | 114 | 81.6 | <0.3 |
| 43 | I | 2b | 7b | 117 | 78.0 | <0.3 |
| 44 | I | 2c | 7b | 111 | 80.1 | <0.3 |
| 45 | I | 2d | 7b | 144 | 78.7 | <0.3 |
| 46 | I | 2e | 7b | 122 | 79.4 | <0.3 |
| 47 | I | 2a | 7c | 116 | 80.8 | <0.3 |
| 48 | I | 2b | 7c | 119 | 77.3 | <0.3 |
| 49 | I | 2c | 7c | 113 | 79.4 | <0.3 |
| 50 | I | 2d | 7c | 146 | 78.0 | <0.3 |
| 51 | I | 2e | 7c | 123 | 78.7 | <0.3 |
| 52 | I | 2a | 7d | 117 | 80.0 | <0.3 |
| 53 | I | 2b | 7d | 120 | 76.5 | <0.3 |

TABLE 4

| EXAMPLE NO. | CGM | HTM | ETM | $V_L$ (V) | Tig (°C.) | DENT (μm) |
|---|---|---|---|---|---|---|
| 54 | I | 2c | 7d | 114 | 78.6 | <0.3 |
| 55 | I | 2d | 7d | 148 | 77.2 | <0.3 |
| 56 | I | 2e | 7d | 125 | 77.9 | <0.3 |
| 57 | II | 2a | 7a | 135 | 79.0 | <0.3 |
| 58 | II | 2b | 7a | 138 | 80.0 | <0.3 |
| 59 | III | 2a | 7a | 139 | 79.5 | <0.3 |
| 60 | III | 2b | 7a | 141 | 81.5 | <0.3 |
| 61 | IV | 2a | 7a | 129 | 81.5 | <0.3 |
| 62 | IV | 2b | 7a | 131 | 79.9 | <0.3 |
| 63 | V | 2a | 7a | 125 | 80.1 | <0.3 |
| 64 | V | 2b | 7a | 128 | 80.5 | <0.3 |
| 1 | I | A | 7a | 198 | 68.2 | 1.2 |
| 6 | I | A | 7b | 195 | 70.2 | 1.3 |
| 11 | I | A | 7c | 210 | 67.2 | 1.7 |
| 12 | I | A | 7d | 180 | 71.6 | 1.8 |

As is apparent from the results in Tables 3 and 4, the photosensitive materials of Examples 37 to 64 are superior in sensitivity characteristics to those of Examples 1, 6, 11 and 12 using conventional benzidine (A) because of their low potential after exposure $V_L$ (V), and are superior in durability and heat resistance because the extrapolated glass transition initiation temperature (Tig) is high and no dent is observed.

Examples 65 to 100

According to the same manner as that described in Examples 1 to 36 except for using 70 parts by weight of a compound which belongs to the benzidine derivative represented by the formula (3) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Tables 5 and 6.

TABLE 5

| EXAMPLE NO. | CGM | HTM | ETM | $V_L$ (V) | Tig (°C.) | DENT (μm) |
|---|---|---|---|---|---|---|
| 65 | I | 3a | 7a | 123 | 79.5 | <0.3 |
| 66 | I | 3b | 7a | 122 | 81.6 | <0.3 |
| 67 | I | 3c | 7a | 119 | 80.9 | <0.3 |
| 68 | I | 3d | 7a | 135 | 80.2 | <0.3 |
| 69 | I | 3e | 7a | 125 | 82.4 | <0.3 |
| 70 | I | 3f | 7a | 135 | 83.1 | <0.3 |
| 71 | I | 3g | 7a | 111 | 82.4 | <0.3 |
| 72 | I | 3a | 7b | 125 | 78.7 | <0.3 |
| 73 | I | 3b | 7b | 123 | 80.9 | <0.3 |
| 74 | I | 3c | 7b | 120 | 80.1 | <0.3 |
| 75 | I | 3d | 7b | 137 | 79.4 | <0.3 |
| 76 | I | 3e | 7b | 126 | 81.6 | <0.3 |
| 77 | I | 3f | 7b | 137 | 82.3 | <0.3 |
| 78 | I | 3g | 7b | 113 | 81.6 | <0.3 |
| 79 | I | 3a | 7c | 127 | 78.0 | <0.3 |
| 80 | I | 3b | 7c | 125 | 80.1 | <0.3 |
| 81 | I | 3c | 7c | 122 | 79.4 | <0.3 |
| 82 | I | 3d | 7c | 139 | 78.7 | <0.3 |

TABLE 6

| EXAMPLE NO. | CGM | HTM | ETM | $V_L$ (V) | Tig (°C.) | DENT (μm) |
|---|---|---|---|---|---|---|
| 83 | I | 3e | 7c | 128 | 80.8 | <0.3 |
| 84 | I | 3f | 7c | 139 | 81.5 | <0.3 |
| 85 | I | 3g | 7c | 114 | 80.8 | <0.3 |
| 86 | I | 3a | 7d | 128 | 77.2 | <0.3 |
| 87 | I | 3b | 7d | 127 | 79.3 | <0.3 |
| 88 | I | 3c | 7d | 124 | 78.6 | <0.3 |
| 89 | I | 3d | 7d | 141 | 77.9 | <0.3 |
| 90 | I | 3e | 7d | 130 | 80.0 | <0.3 |
| 91 | I | 3f | 7d | 141 | 80.7 | <0.3 |
| 92 | I | 3g | 7d | 116 | 80.0 | <0.3 |
| 93 | II | 3a | 7a | 141 | 78.0 | <0.3 |
| 94 | II | 3b | 7a | 146 | 81.3 | <0.3 |
| 95 | III | 3a | 7a | 152 | 81.7 | <0.3 |
| 96 | III | 3b | 7a | 155 | 82.7 | <0.3 |
| 97 | IV | 3a | 7a | 138 | 82.3 | <0.3 |
| 98 | IV | 3b | 7a | 137 | 80.3 | <0.3 |
| 99 | V | 3a | 7a | 139 | 80.5 | <0.3 |
| 100 | V | 3b | 7a | 135 | 80.9 | <0.3 |

As is apparent from the results in Tables 5 and 6, the photosensitive materials of Examples 65 to 100 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 101 to 124

According to the same manner as that described in Examples 1 to 36 except for using 70 parts by weight of a compound which belongs to the benzidine derivative represented by the formula (4) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 7.

TABLE 7

| EXAMPLE NO. | CGM | HTM | ETM | $V_L$ (V) | Tig (°C.) | DENT (μm) |
|---|---|---|---|---|---|---|
| 101 | I | 4a | 7a | 129 | 80.2 | <0.3 |
| 102 | I | 4b | 7a | 117 | 81.6 | <0.3 |
| 103 | I | 4c | 7a | 123 | 84.5 | <0.3 |
| 104 | I | 4d | 7a | 123 | 85.2 | <0.3 |
| 105 | I | 4a | 7b | 131 | 79.4 | <0.3 |
| 106 | I | 4b | 7b | 119 | 80.9 | <0.3 |
| 107 | I | 4c | 7b | 125 | 83.7 | <0.3 |
| 108 | I | 4d | 7b | 125 | 84.4 | <0.3 |
| 109 | I | 4a | 7c | 133 | 78.7 | <0.3 |
| 110 | I | 4b | 7c | 120 | 80.1 | <0.3 |
| 111 | I | 4c | 7c | 127 | 82.9 | <0.3 |
| 112 | I | 4d | 7c | 127 | 83.6 | <0.3 |
| 113 | I | 4a | 7d | 134 | 77.9 | <0.3 |
| 114 | I | 4b | 7d | 122 | 79.3 | <0.3 |
| 115 | I | 4c | 7d | 128 | 82.1 | <0.3 |
| 116 | I | 4d | 7d | 128 | 82.8 | <0.3 |
| 117 | II | 4a | 7a | 152 | 80.9 | <0.3 |
| 118 | II | 4b | 7a | 148 | 81.3 | <0.3 |
| 119 | III | 4a | 7a | 145 | 78.5 | <0.3 |
| 120 | III | 4b | 7a | 147 | 79.0 | <0.3 |
| 121 | IV | 4a | 7a | 138 | 79.2 | <0.3 |
| 122 | IV | 4b | 7a | 133 | 78.5 | <0.3 |
| 123 | V | 4a | 7a | 129 | 76.9 | <0.3 |
| 124 | V | 4b | 7a | 126 | 77.0 | <0.3 |

As is apparent from the results in Table 7, the photosensitive materials of Examples 101 to 124 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 125 to 148

According to the same manner as that described in Examples 1 to 36 except for using 70 parts by weight of a compound which belongs to the benzidine derivative represented by the formula (5) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 8.

TABLE 8

| EXAMPLE NO. | CGM | HTM | ETM | $V_L$ (V) | Tig (°C.) | DENT (μm) |
|---|---|---|---|---|---|---|
| 125 | I | 5a | 7a | 141 | 76.4 | <0.3 |
| 126 | I | 5b | 7a | 121 | 73.7 | <0.3 |
| 127 | I | 5c | 7a | 119 | 74.4 | <0.3 |
| 128 | I | 5d | 7a | 143 | 75.7 | <0.3 |
| 129 | I | 5a | 7b | 143 | 77.1 | <0.3 |
| 130 | I | 5b | 7b | 122 | 74.4 | <0.3 |
| 131 | I | 5c | 7b | 121 | 75.9 | <0.3 |
| 132 | I | 5d | 7b | 144 | 77.2 | <0.3 |
| 133 | I | 5a | 7c | 145 | 80.2 | <0.3 |
| 134 | I | 5b | 7c | 124 | 77.4 | <0.3 |
| 135 | I | 5c | 7c | 124 | 78.8 | <0.3 |
| 136 | I | 5d | 7c | 148 | 77.2 | <0.3 |
| 137 | I | 5a | 7d | 147 | 75.6 | <0.3 |
| 138 | I | 5b | 7d | 126 | 72.2 | <0.3 |
| 139 | I | 5c | 7d | 124 | 76.6 | <0.3 |
| 140 | I | 5d | 7d | 148 | 79.5 | <0.3 |
| 141 | II | 5a | 7a | 159 | 79.4 | <0.3 |
| 142 | II | 5b | 7a | 149 | 76.8 | <0.3 |
| 143 | III | 5a | 7a | 157 | 75.4 | <0.3 |
| 144 | III | 5b | 7a | 155 | 76.2 | <0.3 |
| 145 | IV | 5a | 7a | 148 | 78.1 | <0.3 |
| 146 | IV | 5b | 7a | 152 | 78.4 | <0.3 |
| 147 | V | 5a | 7a | 156 | 77.7 | <0.3 |
| 148 | V | 5b | 7a | 151 | 77.7 | <0.3 |

As is apparent from the results in Table 8, the photosensitive materials of Examples 125 to 148 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 149 to 186

According to the same manner as that described in Examples 1 to 36 except for using 70 parts by weight of a compound which belongs to the phenylenediamine derivative represented by the formula (6) as the hole transferring material, a single-layer type photosensitive material for analog light source which has a single-layer type photosensitive layer of 15 to 20 μm in film thickness was produced.

The above photosensitivity test and the following wear resistance test were conducted as to the single-layer type photosensitive materials of the above respective Examples, and their characteristics were evaluated.

Wear resistance test

A photosensitive material of the respective Examples was fit with a facsimile for paper (Model LDC-650, manufactured by Mita Kogyo Co., Ltd.) and, after rotating 150,000 times without passing a paper through it, a change in film thickness of the organic photosensitive layer was determined, respectively.

The results are shown in Tables 9 and 10, together with those of the above tests in Examples 1, 6, 11 and 12.

TABLE 9

| EXAMPLE NO. | CGM | HTM | ETM | $V_L$ (V) | AMOUNT OF WEAR (μm) |
|---|---|---|---|---|---|
| 149 | I | 6a | 7a | 143 | 5.60 |
| 150 | I | 6b | 7a | 144 | 5.25 |
| 151 | I | 6c | 7a | 144 | 5.46 |
| 152 | I | 6d | 7a | 146 | 5.11 |
| 153 | I | 6e | 7a | 144 | 5.18 |

TABLE 9-continued

| EXAMPLE NO. | CGM | HTM | ETM | $V_L$ (V) | AMOUNT OF WEAR (μm) |
|---|---|---|---|---|---|
| 154 | I | 6f | 7a | 141 | 5.81 |
| 155 | I | 6g | 7a | 144 | 5.74 |
| 156 | I | 6h | 7a | 146 | 5.95 |
| 157 | I | 6i | 7a | 143 | 5.67 |
| 158 | I | 6j | 7a | 143 | 5.88 |
| 159 | I | 6k | 7a | 144 | 6.30 |
| 160 | I | 6l | 7a | 146 | 6.37 |
| 161 | I | 6m | 7a | 135 | 6.37 |
| 162 | I | 6n | 7a | 147 | 5.81 |
| 163 | I | 6a | 7b | 144 | 5.60 |
| 164 | I | 6b | 7b | 146 | 5.25 |
| 165 | I | 6c | 7b | 146 | 5.46 |
| 166 | I | 6d | 7b | 147 | 5.11 |
| 167 | I | 6e | 7b | 146 | 5.18 |
| 168 | I | 6f | 7b | 143 | 5.81 |
| 169 | I | 6g | 7b | 146 | 5.74 |

TABLE 10

| EXAMPLE NO. | CGM | HTM | ETM | $V_L$ (V) | AMOUNT OF WEAR (μm) |
|---|---|---|---|---|---|
| 170 | I | 6h | 7b | 147 | 5.95 |
| 171 | I | 6i | 7b | 144 | 5.83 |
| 172 | I | 6j | 7b | 144 | 6.05 |
| 173 | I | 6k | 7b | 146 | 6.48 |
| 174 | I | 6l | 7b | 147 | 6.55 |
| 175 | I | 6m | 7b | 137 | 6.55 |
| 176 | I | 6n | 7b | 149 | 5.98 |
| 177 | I | 6b | 7c | 148 | 5.40 |
| 178 | I | 6f | 7c | 145 | 5.98 |
| 179 | I | 6h | 7c | 149 | 6.12 |
| 180 | I | 6b | 7d | 150 | 5.40 |
| 181 | I | 6f | 7d | 147 | 5.98 |
| 182 | I | 6h | 7d | 155 | 5.40 |
| 183 | II | 6a | 7a | 157 | 5.26 |
| 184 | III | 6a | 7a | 152 | 5.31 |
| 185 | IV | 6a | 7a | 149 | 5.25 |
| 186 | V | 6a | 7a | 158 | 5.16 |
| 1 | I | A | 7a | 198 | 9.0 |
| 6 | I | A | 7b | 195 | 8.0 |
| 11 | I | A | 7c | 210 | 11.0 |
| 12 | I | A | 7d | 180 | 12.0 |

As is apparent from the results in Tables 9 and 10, the photosensitive materials of Examples 149 to 186 are superior in sensitivity characteristics to those of the above respective Examples using conventional benzidine (A) because of their low potential after exposure $V_L$ (V), and are superior in durability, particularly hardness, because of their small amount of wear.

Examples 187 to 214

According to the same manner as that described in Examples 1 to 36 except for using 20 parts by weight of a compound which belongs to the trinitrofluorenoneimine derivative represented by the formula (8) as the electron transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of those of the above respective Examples, and their characteristics were evaluated. The results are shown in Tables 11 and 12, together with those of the above tests in Examples 13, 18, 23 and 24.

TABLE 11

| EXAMPLE NO. | CGM | HTM | ETM | $V_L$ (V) | Tig (°C.) | DENT (μm) |
|---|---|---|---|---|---|---|
| 187 | I | 2a | 8a | 171 | 75.1 | <0.3 |
| 188 | I | 2b | 8a | 139 | 71.8 | <0.3 |
| 189 | I | 2c | 8a | 132 | 73.8 | <0.3 |
| 190 | I | 2d | 8a | 171 | 72.5 | <0.3 |
| 191 | I | 2e | 8a | 145 | 73.1 | <0.3 |
| 192 | I | 2a | 8b | 173 | 75.8 | <0.3 |
| 193 | I | 2b | 8b | 141 | 72.5 | <0.3 |
| 194 | I | 2c | 8b | 134 | 74.5 | <0.3 |
| 195 | I | 2d | 8b | 173 | 73.2 | <0.3 |
| 196 | I | 2e | 8b | 146 | 73.9 | <0.3 |
| 197 | I | 2a | 8c | 175 | 76.6 | <0.3 |
| 198 | I | 2b | 8c | 143 | 73.3 | <0.3 |
| 199 | I | 2c | 8c | 135 | 75.3 | <0.3 |
| 200 | I | 2d | 8c | 175 | 73.9 | <0.3 |
| 201 | I | 2e | 8c | 148 | 74.6 | <0.3 |
| 202 | I | 2a | 8d | 177 | 77.3 | <0.3 |
| 203 | I | 2b | 8d | 144 | 74.0 | <0.3 |

TABLE 12

| EXAMPLE NO. | CGM | HTM | ETM | $V_L$ (V) | Tig (°C.) | DENT (μm) |
|---|---|---|---|---|---|---|
| 204 | I | 2c | 8d | 137 | 76.0 | <0.3 |
| 205 | I | 2d | 8d | 177 | 74.7 | <0.3 |
| 206 | I | 2e | 8d | 150 | 75.3 | <0.3 |
| 207 | II | 2a | 8a | 186 | 75.6 | <0.3 |
| 208 | II | 2b | 8a | 166 | 71.2 | <0.3 |
| 209 | III | 2a | 8a | 189 | 78.3 | <0.3 |
| 210 | III | 2b | 8a | 168 | 76.2 | <0.3 |
| 211 | IV | 2a | 8a | 190 | 75.6 | <0.3 |
| 212 | IV | 2b | 8a | 169 | 71.3 | <0.3 |
| 213 | V | 2a | 8a | 182 | 76.6 | <0.3 |
| 214 | V | 2b | 8a | 160 | 71.6 | <0.3 |
| 13 | I | A | 8a | 210 | 65.3 | 1.6 |
| 18 | I | A | 8b | 208 | 70.4 | 1.7 |
| 23 | I | A | 8c | 195 | 72.1 | 1.5 |
| 24 | I | A | 8d | 189 | 69.5 | 1.8 |

As is apparent from the results in Tables 11 and 12, the photosensitive materials of Examples 187 to 214 are superior in sensitivity characteristics to those of Examples 13, 18, 23 and 24 using conventional benzidine (A) because of their low potential after exposure $V_L$ (V), and are superior in durability and heat resistance because the extrapolated glass transition initiation temperature (Tig) is high and no dent is observed.

Examples 215 to 250

According to the same manner as that described in Examples 187 to 214 except for using 70 parts by weight of a compound which belongs to the benzidine derivative represented by the formula (3) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Tables 13 and 14.

TABLE 13

| EXAMPLE NO. | CGM | HTM | ETM | $V_L$ (V) | Tig (°C.) | DENT (μm) |
|---|---|---|---|---|---|---|
| 215 | I | 3a | 8a | 148 | 72.5 | <0.3 |
| 216 | I | 3b | 8a | 146 | 74.4 | <0.3 |
| 217 | I | 3c | 8a | 143 | 73.8 | <0.3 |
| 218 | I | 3d | 8a | 162 | 73.1 | <0.3 |
| 219 | I | 3e | 8a | 150 | 75.1 | <0.3 |
| 220 | I | 3f | 8a | 162 | 75.7 | <0.3 |
| 221 | I | 3g | 8a | 134 | 75.1 | <0.3 |
| 222 | I | 3a | 8b | 150 | 73.2 | <0.3 |
| 223 | I | 3b | 8b | 148 | 75.2 | <0.3 |
| 224 | I | 3c | 8b | 144 | 74.5 | <0.3 |
| 225 | I | 3d | 8b | 164 | 73.9 | <0.3 |
| 226 | I | 3e | 8b | 152 | 75.8 | <0.3 |
| 227 | I | 3f | 8b | 164 | 76.5 | <0.3 |
| 228 | I | 3g | 8b | 135 | 75.8 | <0.3 |
| 229 | I | 3a | 8c | 152 | 73.9 | <0.3 |
| 230 | I | 3b | 8c | 150 | 75.9 | <0.3 |
| 231 | I | 3c | 8c | 146 | 75.3 | <0.3 |
| 232 | I | 3d | 8c | 166 | 74.6 | <0.3 |

TABLE 14

| EXAMPLE NO. | CGM | HTM | ETM | $V_L$ (V) | Tig (°C.) | DENT (μm) |
|---|---|---|---|---|---|---|
| 233 | I | 3e | 8c | 153 | 76.6 | <0.3 |
| 234 | I | 3f | 8c | 166 | 77.3 | <0.3 |
| 235 | I | 3g | 8c | 137 | 76.6 | <0.3 |
| 236 | I | 3a | 8d | 153 | 74.7 | <0.3 |
| 237 | I | 3b | 8d | 152 | 76.7 | <0.3 |
| 238 | I | 3c | 8d | 148 | 76.0 | <0.3 |
| 239 | I | 3d | 8d | 168 | 75.3 | <0.3 |
| 240 | I | 3e | 8d | 155 | 77.3 | <0.3 |
| 241 | I | 3f | 8d | 168 | 78.0 | <0.3 |
| 242 | I | 3g | 8d | 139 | 77.3 | <0.3 |
| 243 | II | 3a | 8a | 159 | 72.9 | <0.3 |
| 244 | II | 3b | 8a | 157 | 74.4 | <0.3 |
| 245 | III | 3a | 8a | 170 | 73.1 | <0.3 |
| 246 | III | 3b | 8a | 172 | 75.0 | <0.3 |
| 247 | IV | 3a | 8a | 157 | 71.3 | <0.3 |
| 248 | IV | 3b | 8a | 155 | 72.6 | <0.3 |
| 249 | V | 3a | 8a | 151 | 72.6 | <0.3 |
| 250 | V | 3b | 8a | 153 | 72.7 | <0.3 |

As is apparent from the results in Tables 13 and 14, the photosensitive materials of Examples 215 to 250 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 251 to 274

According to the same manner as that described in Examples 187 to 214 except for using 70 parts by weight of a compound which belongs to the benzidine derivative represented by the formula (4) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 15.

TABLE 15

| EXAMPLE NO. | CGM | HTM | ETM | $V_L$ (V) | Tig (°C.) | DENT (μm) |
|---|---|---|---|---|---|---|
| 251 | I | 4a | 8a | 155 | 73.1 | <0.3 |
| 252 | I | 4b | 8a | 141 | 74.4 | <0.3 |
| 253 | I | 4c | 8a | 148 | 77.1 | <0.3 |
| 254 | I | 4d | 8a | 148 | 77.7 | <0.3 |
| 255 | I | 4a | 8b | 157 | 73.9 | <0.3 |
| 256 | I | 4b | 8b | 143 | 75.2 | <0.3 |
| 257 | I | 4c | 8b | 150 | 77.8 | <0.3 |
| 258 | I | 4d | 8b | 150 | 78.5 | <0.3 |
| 259 | I | 4a | 8c | 159 | 74.6 | <0.3 |
| 260 | I | 4b | 8c | 144 | 75.9 | <0.3 |
| 261 | I | 4c | 8c | 152 | 78.6 | <0.3 |
| 262 | I | 4d | 8c | 152 | 79.3 | <0.3 |
| 263 | I | 4a | 8d | 161 | 75.3 | <0.3 |
| 264 | I | 4b | 8d | 146 | 76.7 | <0.3 |
| 265 | I | 4c | 8d | 153 | 79.4 | <0.3 |
| 266 | I | 4d | 8d | 153 | 80.0 | <0.3 |
| 267 | II | 4a | 8a | 169 | 73.6 | <0.3 |
| 268 | II | 4b | 8a | 156 | 74.9 | <0.3 |
| 269 | III | 4a | 8a | 169 | 72.1 | <0.3 |
| 270 | III | 4b | 8a | 158 | 75.0 | <0.3 |
| 271 | IV | 4a | 8a | 151 | 71.9 | <0.3 |
| 272 | IV | 4b | 8a | 153 | 70.6 | <0.3 |
| 273 | V | 4a | 8a | 152 | 79.6 | <0.3 |
| 274 | V | 4b | 8a | 157 | 78.3 | <0.3 |

As is apparent from the results in Table 15, the photosensitive materials of Examples 251 to 274 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 275 to 298

According to the same manner as that described in Examples 187 to 214 except for using 70 parts by weight of a compound which belongs to the benzidine derivative represented by the formula (5) as the hole transferring material, a single-layer type photosensitive material for analog light source, which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 16.

TABLE 16

| EXAMPLE NO. | CGM | HTM | ETM | $V_L$ (V) | Tig (°C.) | DENT (μm) |
|---|---|---|---|---|---|---|
| 275 | I | 5 a | 8 a | 173 | 74.4 | <0.3 |
| 276 | I | 5 b | 8 a | 148 | 71.8 | <0.3 |
| 277 | I | 5 c | 8 a | 146 | 72.5 | <0.3 |
| 278 | I | 5 d | 8 a | 175 | 73.8 | <0.3 |
| 279 | I | 5 a | 8 b | 175 | 75.2 | <0.3 |
| 280 | I | 5 b | 8 b | 150 | 72.5 | <0.3 |
| 281 | I | 5 c | 8 b | 148 | 73.9 | <0.3 |
| 282 | I | 5 d | 8 b | 177 | 75.3 | <0.3 |
| 283 | I | 5 a | 8 c | 177 | 78.2 | <0.3 |
| 284 | I | 5 b | 8 c | 152 | 75.4 | <0.3 |
| 285 | I | 5 c | 8 c | 150 | 76.8 | <0.3 |
| 286 | I | 5 d | 8 c | 179 | 75.3 | <0.3 |
| 287 | I | 5 a | 8 d | 179 | 73.7 | <0.3 |

TABLE 16-continued

| EXAMPLE NO. | CGM | HTM | ETM | $V_L$ (V) | Tig (°C.) | DENT (μm) |
|---|---|---|---|---|---|---|
| 288 | I | 5 b | 8 d | 153 | 70.4 | <0.3 |
| 289 | I | 5 c | 8 d | 152 | 74.7 | <0.3 |
| 290 | I | 5 d | 8 d | 181 | 77.5 | <0.3 |
| 291 | II | 5 a | 8 a | 181 | 76.2 | <0.3 |
| 292 | II | 5 b | 8 a | 161 | 72.3 | <0.3 |
| 293 | III | 5 a | 8 a | 186 | 76.9 | <0.3 |
| 294 | III | 5 b | 8 a | 169 | 72.4 | <0.3 |
| 295 | IV | 5 a | 8 a | 179 | 76.9 | <0.3 |
| 296 | IV | 5 b | 8 a | 159 | 72.9 | <0.3 |
| 297 | V | 5 a | 8 a | 178 | 77.7 | <0.3 |
| 298 | V | 5 b | 8 a | 152 | 71.2 | <0.3 |

As is apparent from the results in Table 16, the photosensitive materials of Examples 275 to 298 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 299 to 336

According to the same manner as that described in Examples 187 to 214 except for using 70 parts by weight of a compound which belongs to the phenylenediamine derivative represented by the formula (6) as the hole transferring material, a single-layer type photosensitive material for analog light source, which has a single-layer type photosensitive layer of 15 to 20 μm in film thickness, was produced.

According to the same manner as that described above, the potential after exposure $V_L$ (V) and amount of wear (μm) were determined as to the single-layer type photosensitive materials of the above respective Examples, and their characteristics were evaluated. The results are shown in Tables 17 and 18, together with the above data in Examples 13, 18, 23 and 24.

TABLE 17

| EXAMPLE NO. | CGM | HTM | ETM | $V_L$ (V) | AMOUNT OF WEAR (μm) |
|---|---|---|---|---|---|
| 299 | I | 6 a | 8 a | 171 | 6.56 |
| 300 | I | 6 b | 8 a | 173 | 6.15 |
| 301 | I | 6 c | 8 a | 173 | 6.23 |
| 302 | I | 6 d | 8 a | 175 | 6.15 |
| 303 | I | 6 e | 8 a | 173 | 6.07 |
| 304 | I | 6 f | 8 a | 170 | 6.81 |
| 305 | I | 6 g | 8 a | 173 | 6.72 |
| 306 | I | 6 h | 8 a | 175 | 6.97 |
| 307 | I | 6 i | 8 a | 171 | 6.97 |
| 308 | I | 6 j | 8 a | 171 | 6.89 |
| 309 | I | 6 k | 8 a | 173 | 7.38 |
| 310 | I | 6 l | 8 a | 175 | 7.46 |
| 311 | I | 6 m | 8 a | 162 | 7.79 |
| 312 | I | 6 n | 8 a | 177 | 6.81 |
| 313 | I | 6 a | 8 b | 171 | 6.56 |
| 314 | I | 6 b | 8 b | 173 | 6.15 |
| 315 | I | 6 c | 8 b | 171 | 6.40 |
| 316 | I | 6 d | 8 b | 173 | 5.99 |
| 317 | I | 6 e | 8 b | 171 | 6.07 |
| 318 | I | 6 f | 8 b | 168 | 6.72 |
| 319 | I | 6 g | 8 b | 171 | 6.72 |

TABLE 18

| EXAMPLE NO. | CGM | HTM | ETM | $V_L$ (V) | AMOUNT OF WEAR (μm) |
|---|---|---|---|---|---|
| 320 | I | 6 h | 8 b | 173 | 6.97 |
| 321 | I | 6 i | 8 b | 169 | 6.64 |
| 322 | I | 6 j | 8 b | 169 | 6.89 |
| 323 | I | 6 k | 8 b | 171 | 7.38 |
| 324 | I | 6 l | 8 b | 173 | 7.46 |
| 325 | I | 6 m | 8 b | 161 | 7.46 |
| 326 | I | 6 n | 8 b | 175 | 6.81 |
| 327 | I | 6 b | 8 c | 181 | 6.15 |
| 328 | I | 6 f | 8 c | 174 | 6.81 |
| 329 | I | 6 h | 8 c | 181 | 6.97 |
| 330 | I | 6 b | 8 d | 183 | 6.15 |
| 331 | I | 6 f | 8 d | 182 | 6.81 |
| 332 | I | 6 h | 8 d | 189 | 6.15 |
| 333 | II | 6 a | 8 a | 186 | 6.56 |
| 334 | III | 6 a | 8 a | 187 | 6.66 |
| 335 | IV | 6 a | 8 a | 189 | 6.52 |
| 336 | V | 6 a | 8 a | 179 | 6.39 |
| 13 | I | A | 8 a | 210 | 9.0 |
| 18 | I | A | 8 b | 208 | 8.7 |
| 23 | I | A | 8 c | 195 | 10.5 |
| 24 | I | A | 8 d | 189 | 11.2 |

As is apparent from the results in Tables 17 and 18, the photosensitive materials of Examples 299 to 336 are superior in sensitivity characteristics to those of the above respective Examples using conventional benzidine (A) because of their low potential after exposure $V_L$ (V), and are superior in durability, particularly hardness, because of their small amount of wear.

Examples 337 to 364

According to the same manner as that described in Examples 1 to 36 except for using 20 parts by weight of a compound which belongs to the trinitrofluoreneoneimine derivative represented by the formula (9) as the electron transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Tables 19 and 20, together with those of the above tests in Examples 25, 30, 35 and 36.

TABLE 19

| EXAMPLE NO. | CGM | HTM | ETM | $V_L$ (V) | Tig (°C.) | DENT (μm) |
|---|---|---|---|---|---|---|
| 337 | I | 2 a | 9 a | 171 | 79.7 | <0.3 |
| 338 | I | 2 b | 9 a | 139 | 76.2 | <0.3 |
| 339 | I | 2 c | 9 a | 132 | 78.3 | <0.3 |
| 340 | I | 2 d | 9 a | 171 | 76.9 | <0.3 |
| 341 | I | 2 e | 9 a | 145 | 77.6 | <0.3 |
| 342 | I | 2 a | 9 b | 173 | 78.9 | <0.3 |
| 343 | I | 2 b | 9 b | 141 | 75.5 | <0.3 |
| 344 | I | 2 c | 9 b | 134 | 77.6 | <0.3 |
| 345 | I | 2 d | 9 b | 173 | 76.2 | <0.3 |
| 346 | I | 2 e | 9 b | 146 | 76.9 | <0.3 |
| 347 | I | 2 a | 9 c | 175 | 78.2 | <0.3 |
| 349 | I | 2 b | 9 c | 143 | 74.8 | <0.3 |
| 349 | I | 2 c | 9 c | 135 | 76.8 | <0.3 |
| 350 | I | 2 d | 9 c | 175 | 75.5 | <0.3 |
| 351 | I | 2 e | 9 c | 148 | 76.1 | <0.3 |

TABLE 19-continued

| EXAMPLE NO. | CGM | HTM | ETM | $V_L$ (V) | Tig (°C.) | DENT (μm) |
|---|---|---|---|---|---|---|
| 352 | I | 2 a | 9 d | 179 | 77.4 | <0.3 |
| 353 | I | 2 b | 9 d | 146 | 74.1 | <0.3 |

TABLE 20

| EXAMPLE NO. | CGM | HTM | ETM | $V_L$ (V) | Tig (°C.) | DENT (μm) |
|---|---|---|---|---|---|---|
| 354 | I | 2 c | 9 d | 138 | 76.1 | <0.3 |
| 355 | I | 2 d | 9 d | 179 | 74.7 | <0.3 |
| 356 | I | 2 e | 9 d | 151 | 75.4 | <0.3 |
| 357 | II | 2 a | 9 a | 181 | 79.6 | <0.3 |
| 358 | II | 2 b | 9 a | 148 | 76.8 | <0.3 |
| 359 | III | 2 a | 9 a | 186 | 79.2 | <0.3 |
| 360 | III | 2 b | 9 a | 152 | 77.6 | <0.3 |
| 361 | IV | 2 a | 9 a | 182 | 77.9 | <0.3 |
| 362 | IV | 2 b | 9 a | 159 | 75.3 | <0.3 |
| 363 | V | 2 a | 9 a | 183 | 77.9 | <0.3 |
| 364 | V | 2 b | 9 a | 161 | 76.7 | <0.3 |
| 25 | I | A | 9 a | 210 | 66.0 | 1.7 |
| 30 | I | A | 9 b | 200 | 71.0 | 1.7 |
| 35 | I | A | 9 c | 196 | 70.0 | 1.8 |
| 36 | I | A | 9 d | 189 | 67.0 | 2.0 |

As is apparent from the results in Tables 19 and 20, the photosensitive materials of Examples 337 to 364 are superior in sensitivity characteristics to those of Examples 25, 30, 35 and 36 using conventional benzidine (A) because of their low potential after exposure $V_L$ (V), and are superior in durability and heat resistance because the extrapolated glass transition initiation temperature (Tig) is high and no dent is observed.

Examples 365 to 400

According to the same manner as that described in Examples 337 to 364 except for using 70 parts by weight of a compound which belongs to the benzidine derivative represented by the formula (3) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Tables 21 and 22.

TABLE 21

| EXAMPLE NO. | CGM | HTM | ETM | $V_L$ (V) | Tig (°C.) | DENT (μm) |
|---|---|---|---|---|---|---|
| 365 | I | 3 a | 9 a | 148 | 76.9 | <0.3 |
| 366 | I | 3 b | 9 a | 146 | 79.0 | <0.3 |
| 367 | I | 3 c | 9 a | 143 | 78.3 | <0.3 |
| 368 | I | 3 d | 9 a | 162 | 77.6 | <0.3 |
| 369 | I | 3 e | 9 a | 150 | 79.7 | <0.3 |
| 370 | I | 3 f | 9 a | 162 | 80.4 | <0.3 |
| 371 | I | 3 g | 9 a | 134 | 79.7 | <0.3 |
| 372 | I | 3 a | 9 b | 150 | 76.2 | <0.3 |
| 373 | I | 3 b | 9 b | 148 | 78.2 | <0.3 |
| 374 | I | 3 c | 9 b | 144 | 77.6 | <0.3 |
| 375 | I | 3 d | 9 b | 164 | 76.9 | <0.3 |
| 376 | I | 3 e | 9 b | 152 | 78.9 | <0.3 |

TABLE 21-continued

| EXAMPLE NO. | CGM | HTM | ETM | $V_L$ (V) | Tig (°C.) | DENT (μm) |
|---|---|---|---|---|---|---|
| 377 | I | 3 f | 9 b | 164 | 79.6 | <0.3 |
| 378 | I | 3 g | 9 b | 135 | 78.9 | <0.3 |
| 379 | I | 3 a | 9 c | 152 | 75.5 | <0.3 |
| 380 | I | 3 b | 9 c | 150 | 77.5 | <0.3 |
| 381 | I | 3 c | 9 c | 146 | 76.8 | <0.3 |
| 382 | I | 3 d | 9 c | 166 | 76.1 | <0.3 |

TABLE 22

| EXAMPLE NO. | CGM | HTM | ETM | $V_L$ (V) | Tig (°C.) | DENT (μm) |
|---|---|---|---|---|---|---|
| 383 | I | 3 e | 9 c | 153 | 78.2 | <0.3 |
| 384 | I | 3 f | 9 c | 166 | 78.9 | <0.3 |
| 385 | I | 3 g | 9 c | 137 | 78.2 | <0.3 |
| 386 | I | 3 a | 9 d | 153 | 74.7 | <0.3 |
| 387 | I | 3 b | 9 d | 152 | 76.7 | <0.3 |
| 388 | I | 3 c | 9 d | 148 | 76.1 | <0.3 |
| 389 | I | 3 d | 9 d | 168 | 75.4 | <0.3 |
| 390 | I | 3 e | 9 d | 155 | 77.4 | <0.3 |
| 391 | I | 3 f | 9 d | 168 | 78.1 | <0.3 |
| 392 | I | 3 g | 9 d | 139 | 77.4 | <0.3 |
| 393 | II | 3 a | 9 a | 159 | 76.0 | <0.3 |
| 394 | II | 3 b | 9 a | 156 | 79.2 | <0.3 |
| 395 | III | 3 a | 9 a | 159 | 77.7 | <0.3 |
| 396 | III | 3 b | 9 a | 157 | 78.7 | <0.3 |
| 397 | IV | 3 a | 9 a | 162 | 78.9 | <0.3 |
| 398 | IV | 3 b | 9 a | 163 | 78.6 | <0.3 |
| 399 | V | 3 a | 9 a | 165 | 76.9 | <0.3 |
| 400 | V | 3 b | 9 a | 162 | 77.7 | <0.3 |

As is apparent from the results in Tables 21 and 22, the photosensitive materials of Examples 365 to 400 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 401 to 424

According to the same manner as that described in Examples 337 to 364 except for using 70 parts by weight of a compound which belongs to the benzidine derivative represented by the formula (4) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 23.

TABLE 23

| EXAMPLE NO. | CGM | HTM | ETM | $V_L$ (V) | Tig (°C.) | DENT (μm) |
|---|---|---|---|---|---|---|
| 401 | I | 4 a | 9 a | 152 | 77.6 | <0.3 |
| 402 | I | 4 b | 9 a | 138 | 79.0 | <0.3 |
| 403 | I | 4 c | 9 a | 145 | 81.8 | <0.3 |
| 404 | I | 4 d | 9 a | 145 | 82.5 | <0.3 |
| 405 | I | 4 a | 9 b | 153 | 76.9 | <0.3 |

TABLE 23-continued

| EXAMPLE NO. | CGM | HTM | ETM | $V_L$ (V) | Tig (°C.) | DENT (μm) |
|---|---|---|---|---|---|---|
| 406 | I | 4 b | 9 b | 139 | 78.2 | <0.3 |
| 407 | I | 4 c | 9 b | 146 | 81.0 | <0.3 |
| 408 | I | 4 d | 9 b | 146 | 81.7 | <0.3 |
| 409 | I | 4 a | 9 c | 155 | 76.1 | <0.3 |
| 410 | I | 4 b | 9 c | 141 | 77.5 | <0.3 |
| 411 | I | 4 c | 9 c | 148 | 80.2 | <0.3 |
| 412 | I | 4 d | 9 c | 148 | 80.9 | <0.3 |
| 413 | I | 4 a | 9 d | 157 | 75.4 | <0.3 |
| 414 | I | 4 b | 9 d | 143 | 76.7 | <0.3 |
| 415 | I | 4 c | 9 d | 150 | 79.4 | <0.3 |
| 416 | I | 4 d | 9 d | 150 | 80.1 | <0.3 |
| 417 | II | 4 a | 9 a | 163 | 79.2 | <0.3 |
| 418 | II | 4 b | 9 a | 156 | 76.5 | <0.3 |
| 419 | III | 4 a | 9 a | 169 | 79.8 | <0.3 |
| 420 | III | 4 b | 9 a | 156 | 80.0 | <0.3 |
| 421 | IV | 4 a | 9 a | 163 | 76.2 | <0.3 |
| 422 | IV | 4 b | 9 a | 159 | 80.0 | <0.3 |
| 423 | V | 4 a | 9 a | 168 | 79.2 | <0.3 |
| 424 | V | 4 b | 9 a | 159 | 81.3 | <0.3 |

As is apparent from the results in Table 23, the photosensitive materials of Examples 401 to 424 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 425 to 448

According to the same manner as that described in Examples 337 to 364 except for using 70 parts by weight of a compound which belongs to a benzidine derivative represented by the formula (5) as the hole transferring material, a single-layer type photosensitive material for analog light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 24.

TABLE 24

| EXAMPLE NO. | CGM | HTM | ETM | $V_L$ (V) | Tig (°C.) | DENT (μm) |
|---|---|---|---|---|---|---|
| 425 | I | 5 a | 9 a | 171 | 79.0 | <0.3 |
| 426 | I | 5 b | 9 a | 147 | 76.2 | <0.3 |
| 427 | I | 5 c | 9 a | 145 | 76.9 | <0.3 |
| 428 | I | 5 d | 9 a | 173 | 78.3 | <0.3 |
| 429 | I | 5 a | 9 b | 174 | 78.2 | <0.3 |
| 430 | I | 5 b | 9 b | 148 | 75.5 | <0.3 |
| 431 | I | 5 c | 9 b | 147 | 76.2 | <0.3 |
| 432 | I | 5 d | 9 b | 175 | 77.6 | <0.3 |
| 433 | I | 5 a | 9 c | 176 | 77.5 | <0.3 |
| 434 | I | 5 b | 9 c | 150 | 74.8 | <0.3 |
| 435 | I | 5 c | 9 c | 148 | 75.5 | <0.3 |
| 436 | I | 5 d | 9 c | 177 | 76.8 | <0.3 |
| 437 | I | 5 a | 9 d | 178 | 76.7 | <0.3 |
| 438 | I | 5 b | 9 d | 152 | 74.1 | <0.3 |
| 439 | I | 5 c | 9 d | 150 | 74.7 | <0.3 |
| 440 | I | 5 d | 9 d | 179 | 76.1 | <0.3 |
| 441 | II | 5 a | 9 a | 186 | 79.6 | <0.3 |
| 442 | II | 5 b | 9 a | 152 | 77.7 | <0.3 |

TABLE 24-continued

| EXAMPLE NO. | CGM | HTM | ETM | $V_L$ (V) | Tig (°C.) | DENT (μm) |
|---|---|---|---|---|---|---|
| 443 | III | 5 a | 9 a | 183 | 76.9 | <0.3 |
| 444 | III | 5 b | 9 a | 159 | 80.1 | <0.3 |
| 445 | IV | 5 a | 9 a | 182 | 79.2 | <0.3 |
| 446 | IV | 5 b | 9 a | 150 | 79.5 | <0.3 |
| 447 | V | 5 a | 9 a | 185 | 78.6 | <0.3 |
| 448 | V | 5 b | 9 a | 159 | 79.6 | <0.3 |

As is apparent from the results in Table 24, the photosensitive materials of Examples 425 to 448 are superior in sensitivity characteristics to those of the above respective Examples using conventional benzidine (A) because of their low potential after exposure $V_L$ (V), and are superior in durability and heat resistance because the extrapolated glass transition initiation temperature (Tig) is high and no dent is observed.

Examples 449 to 486

According to the same manner as that described in Examples 337 to 364 except for using 70 parts by weight of a compound which belongs to the phenylenediamine derivative represented by the formula (6) as the hole transferring material, a single-layer type photosensitive material for analog light source which has a single-layer type photosensitive layer of 15 to 20 μm in film thickness was produced.

According to the same manner as that described above, the potential after exposure $V_L$ (V) and amount of wear (μm) were determined as to the single-layer type photosensitive materials of the above respective Examples, and their characteristics were evaluated. The results are shown in Tables 25 and 26, together with those of the above tests in Examples 25, 30, 35 and 36.

TABLE 25

| EXAMPLE NO. | CGM | HTM | ETM | $V_L$ (V) | AMOUNT OF WEAR (μm) |
|---|---|---|---|---|---|
| 449 | I | 6 a | 9 a | 168 | 7.2 |
| 450 | I | 6 b | 9 a | 170 | 6.8 |
| 451 | I | 6 c | 9 a | 170 | 6.8 |
| 452 | I | 6 d | 9 a | 172 | 6.7 |
| 453 | I | 6 e | 9 a | 170 | 6.6 |
| 454 | I | 6 f | 9 a | 166 | 7.5 |
| 455 | I | 6 g | 9 a | 170 | 7.4 |
| 456 | I | 6 h | 9 a | 172 | 7.6 |
| 457 | I | 6 i | 9 a | 168 | 7.5 |
| 458 | I | 6 j | 9 a | 168 | 7.6 |
| 459 | I | 6 k | 9 a | 170 | 8.1 |
| 460 | I | 6 l | 9 a | 172 | 8.2 |
| 461 | I | 6 m | 9 a | 159 | 8.6 |
| 462 | I | 6 n | 9 a | 173 | 7.5 |
| 463 | I | 6 a | 9 b | 168 | 7.2 |
| 464 | I | 6 b | 9 b | 170 | 6.8 |
| 465 | I | 6 c | 9 b | 168 | 7.0 |
| 466 | I | 6 d | 9 b | 164 | 6.6 |
| 467 | I | 6 e | 9 b | 168 | 6.7 |
| 468 | I | 6 f | 9 b | 170 | 7.4 |
| 469 | I | 6 g | 9 b | 166 | 7.4 |

TABLE 26

| EXAMPLE NO. | CGM | HTM | ETM | $V_L$ (V) | AMOUNT OF WEAR (μm) |
|---|---|---|---|---|---|
| 470 | I | 6 h | 9 b | 166 | 7.7 |
| 471 | I | 6 i | 9 b | 168 | 7.3 |

TABLE 26-continued

| EXAMPLE NO. | CGM | HTM | ETM | $V_L$ (V) | AMOUNT OF WEAR (μm) |
|---|---|---|---|---|---|
| 472 | I | 6 j | 9 b | 170 | 7.6 |
| 473 | I | 6 k | 9 b | 157 | 8.1 |
| 474 | I | 6 l | 9 b | 171 | 8.2 |
| 340 | I | 6 m | 9 b | 178 | 8.2 |
| 476 | I | 6 n | 9 b | 170 | 7.5 |
| 477 | I | 6 b | 9 c | 178 | 6.9 |
| 478 | I | 6 f | 9 c | 180 | 7.5 |
| 479 | I | 6 h | 9 c | 178 | 7.7 |
| 480 | I | 6 b | 9 d | 186 | 6.8 |
| 481 | I | 6 f | 9 d | 178 | 7.5 |
| 482 | I | 6 h | 9 d | 169 | 6.8 |
| 483 | II | 6 a | 9 a | 176 | 6.9 |
| 484 | III | 6 a | 9 a | 180 | 6.8 |
| 485 | IV | 6 a | 9 a | 172 | 7.2 |
| 486 | V | 6 a | 9 a | 179 | 7.1 |
| 25 | I | A | 9 a | 210 | 11.0 |
| 30 | I | A | 9 b | 200 | 11.2 |
| 35 | I | A | 9 c | 196 | 10.5 |
| 36 | I | A | 9 d | 186 | 10.0 |

As is apparent from the results in Tables 25 and 26, the photosensitive materials of Examples 449 to 486 are superior in sensitivity characteristics to those of the above respective Examples using conventional benzidine (A) because of their low potential after exposure $V_L$ (V), and are superior in durability, particularly hardness, because of their small amount of wear.

Examples 487 and 499

(Multi-layer photosensitive material for analog light source)

250 Parts by weight of a bisazo pigment represented by any one of the formulas (I) to (V) as the electric charge generating material and 100 parts by weight of polyvinyl butyral as the binding resin were mixed and dispersed with 1500 parts by weight of tetrahydrofuran using a ball mill to prepare a coating solution for electric charge generating layer. Then, this coating solution was applied on an aluminum tube as the conductive substrate by a dip coating method, followed by hot-air drying at 100° C. for 30 minutes to form an electric charge generating layer of 0.5 μm in film thickness.

Then, 100 parts by weight of a compound represented by any one of the formulas (6b) and (A) and the following formula (Q) as the hole transferring material, a predetermined amount of a trinitrofluorenoneimine derivative represented by any one of the formulas (7) to (9) as the electron transferring material and 100 parts by weight of a polycarbonate resin as the binding resin were mixed and dispersed with 1000 parts by weight of tetrahydrofuran for 50 hours, using a ball mill, to prepare a coating solution for electric charge transferring layer. Then, this coating solution was applied on the above electric charge generating layer by a dip coating method, followed by hot-air drying at 110° C. for 30 minutes to form an electric charge transferring layer of 20 μm in film thickness, thereby affording a multi-layer negative-charging type photosensitive material.

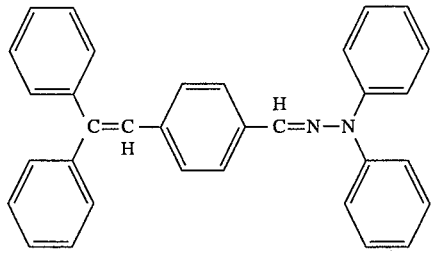

(Q)

Comparative Examples 7 to 13

According to the same manner as that described in Examples 487 to 499 except for adding no electron transferring material, a multi-layer negative-charging type photosensitive material was produced.

The kind and amount (based on 100 parts by weight of binding resin) of the electron transferring material used in the respective Examples and Comparative Examples and kind of the electric charge generating material and hole transferring material used are shown in Table 27, respectively. Among the electron transferring materials shown in Table 27, the compounds represented by the formulas (7e) and (7f) are as follows.

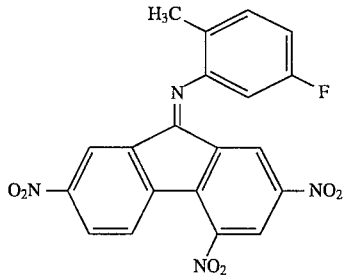

(7e)

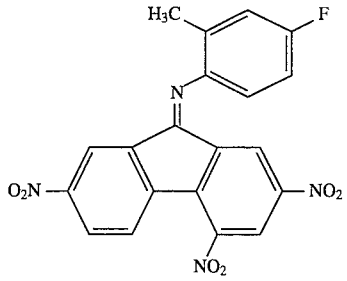

(7f)

TABLE 27

| | ETM | | | |
|---|---|---|---|---|
| | KIND | AMOUNT (PARTS BY WEIGHT) | CGM | HTM |
| EX. 487 | 7 e | 1 | I (Z=$CH_3$) | 6 b |
| EX. 488 | 7 e | 3 | I (Z=$CH_3$) | 6 b |
| EX. 489 | 7 e | 5 | I (Z=$CH_3$) | 6 b |
| EX. 490 | 7 e | 3 | V* | 6 b |
| EX. 491 | 7 e | 3 | I (Z=$OCH_3$) | 6 b |
| EX. 492 | 7 e | 3 | II | 6 b |
| EX. 493 | 7 f | 3 | I (Z=$CH_3$) | 6 b |
| EX. 494 | 7 f | 3 | I (Z=$CH_3$) | A |
| Ex. 495 | 7 f | 3 | I (Z=$CH_3$) | Q |
| EX. 496 | 7 f | 3 | I (Z=$OCH_3$) | A |
| EX. 497 | 7 a | 3 | I (Z=$CH_3$) | 6 b |
| EX. 498 | 8 a | 3 | I (Z=$CH_3$) | 6 b |
| EX. 499 | 9 a | 3 | I (Z=$CH_3$) | 6 b |
| COMP. EX. 7 | — | — | V* | 6 b |

TABLE 27-continued

| | ETM | | | |
|---|---|---|---|---|
| | KIND | AMOUNT (PARTS BY WEIGHT) | CGM | HTM |
| COMP. EX. 8 | — | — | I (Z=$CH_3$) | 6 b |
| COMP. EX. 9 | — | — | I (Z=$CH_3$) | A |
| COMP. EX. 10 | — | — | I (Z=$CH_3$) | Q |
| COMP. EX. 11 | — | — | I (Z=$OCH_3$) | 6 b |
| COMP. EX. 12 | — | — | I (Z=$OCH_3$) | A |
| COMP. EX. 13 | — | — | II | 6 b |

*A chlorine atom in the formula (V) is substituted on the 2-position of a phenyl group.

The stability at the time of repeated using was examined by the following method, using the respective photosensitive materials obtained in Examples 487 to 499 and Comparative Examples 7 to 13.

Stability test (1) Initial electric characteristics

By using a drum sensitivity tester manufactured by GEN-TEC Co., a voltage was applied on the surface of the electrophotosensitive material to charge the surface at −800±20 V, and a surface potential ($V_0$) was measured. Then, white light (light intensity: 10 lux) from a halogen lamp as an exposure light source was irradiated on the surface of the photosensitive material (irradiation time: 1.5 seconds), and a half-life exposure $E_{1/2}$ (lux second) was determined. Further, a surface potential at the time at which 0.5 seconds has passed since the beginning of exposure was measured as a residual potential ($V_r$).

(2) Evaluation of stability after printing 10,000 copies

A photosensitive material obtained in the respective Examples and Comparative Examples was fit with an electrophotographic copying apparatus modified with a negative- changing specification (Model DC-2556, manufactured by Mita Kogyo Co., Ltd.) and, after printing 10,000 copies, a difference ($\Delta V_0$) between a charged potential before printing and that after printing was determined and, further, a difference ($\Delta V_r$) between a residual potential before printing and that after printing was determined.

The results are shown in Table 28.

TABLE 28

| | INITIAL ELECTRIC CHARACTERISTICS | | | CHANGE AFTER PRINTING 10,000 COPIES | |
|---|---|---|---|---|---|
| | $V_0$ (V) | Vr (V) | E ½ (lux · sec.) | $\Delta V_0$ (V) | ΔVr (V) |
| EX. 487 | −802 | −125 | 1.74 | −140 | +10 |
| EX. 488 | −806 | −128 | 1.76 | −45 | +5 |
| EX. 489 | −817 | −133 | 1.79 | −30 | +5 |
| EX. 490 | −793 | −118 | 1.75 | −130 | +10 |
| EX. 491 | −798 | −103 | 1.61 | −20 | ±0 |
| EX. 492 | −786 | −139 | 1.81 | −125 | +15 |
| EX. 493 | −811 | −130 | 1.74 | −50 | +10 |
| EX. 494 | −789 | −114 | 1.68 | −35 | ±0 |
| EX. 495 | −810 | −126 | 1.73 | −55 | +5 |
| EX. 496 | −782 | −110 | 1.66 | −15 | ±0 |
| EX. 497 | −819 | −138 | 1.81 | −65 | +10 |
| EX. 498 | −811 | −132 | 1.77 | −75 | +5 |
| EX. 499 | −796 | −130 | 1.74 | −45 | ±0 |
| COMP. EX. 7 | −811 | −110 | 1.71 | −280 | +45 |
| COMP. EX. 8 | −806 | −128 | 1.75 | −230 | +30 |
| COMP. EX. 9 | −796 | −112 | 1.66 | −340 | +45 |
| COMP. EX. 10 | −817 | −118 | 1.68 | −185 | +30 |
| COMP. EX. 11 | −785 | −106 | 1.60 | −225 | +40 |
| COMP. EX. 12 | −805 | −115 | 1.65 | −210 | +35 |
| COMP. EX. 13 | −805 | −133 | 1.77 | −220 | +35 |

As is apparent from Table 28, regarding the photosensitive materials of the Examples wherein the electron transferring material is formulated in the hole transferring layer, the light resistance and static stability as well as stability at the time of repeated using are improved in comparison with the photosensitive materials of the Comparative Examples wherein no electron transferring material is formulated.

Examples 500 to 525

(Single-layer photosensitive material for digital light source)

5 Parts by weight of a phthalocyanine pigment as the electric charge generating material, 50 parts by weight of a compound which belongs to the benzidine derivative represented by the formula (2) as the hole transferring material, 30 parts by weight of a compound which belongs to the trinitrofluorenoneimine derivative represented by the formula (7) as the electron transferring material and 100 parts by weight of polycarbonate as the binding resin were mixed and dispersed with 800 parts by weight of tetrahydrofuran as the solvent for 50 hours, using a ball mill, to prepare a coating solution for single-layer type photosensitive layer. Then, this coating solution was applied on an aluminum tube as the conductive substrate by a dip coating method, followed by hot-air drying at 100° C. for 60 minutes to give a single-layer type photosensitive material for digital light source which has a single-layer type photosensitive layer of 15 to 20 μm in film thickness.

Comparative Examples 14 to 17

According to the same manner as that described in Examples 500 to 525 except for using 50 parts by weight of a conventional benzidine derivative represented by the formula (A) as the hole transferring material, a single-layer type photosensitive material for digital light source which has a single-layer type photosensitive layer of 15 to 20 μm in film thickness was produced.

Embodied compounds of the electric charge generating material, hole transferring material and electron transferring material used in the above Examples and Comparative Examples are shown in Table 29, using the above-described compound No. of the respective embodiments. Further, two kinds of phthalocyanine pigments (i.e. X-type metal-free phthalocyanine and oxotitanyl phthalocyanine) were used, and the kind of the phthalocyanine pigment to be used in the respective Examples and Comparative Examples is shown in Table 29, using the following symbols.

X: X-type metal-free phthalocyanine

Ti: Oxotitanyl phthalocyanine

The following tests were conducted as to the single-layer type photosensitive materials of the above respective Examples and Comparative Examples, and their characteristics were evaluated.

Photosensitivity test

By using a drum sensitivity tester manufactured by GEN-TEC Co., a voltage was applied on the surface of the photosensitive materials of the respective Examples and Comparative Examples to charge the surface at +700 V. Then, monochromic light having a wavelength of 780 nm (half-width: 20 nm) and a light intensity of 16 μW/cm$^2$ from white light of a halogen lamp as an exposure light source through a band-pass filter was irradiated on the surface of the photosensitive material (irradiation time: 80 msec.). Further, a surface potential at the time at which 330 msec. has passed since the beginning of exposure was measured as a potential after exposure $V_L$ (V).

Measurement of glass transition initiation temperature

About 5 mg of a photosensitive layer was peeled off from the photosensitive materials of the respective Examples and Comparative Examples and put in an exclusive aluminum pan, followed by sealing to prepare a sample, respectively. Then, this sample was measured under the following condition using a differential scanning calorimeter (Model DSC8230D, manufactured by Rikagaku Denki Co., Ltd.). An extrapolated glass transition initiation temperature Tig (°C.) was determined from the results according to JIS K 7121 "Method for Measuring Transition Temperature of Plastics".

Environmental gas: Air

Heating rate: 20° C./minute

High-temperature resistance test

A photosensitive material of the respective Examples and Comparative Examples was fit with an imaging unit of a facsimile for paper (Model LDC-650, manufactured by Mita Kogyo Co., Ltd.) and, after standing at an environmental temperature of 50° C. for 10 days in such a state that a cleaning blade keeps in contact with the surface of the photosensitive material under linear pressure of 1.5 g/mm, the surface state of the photosensitive layer was measured using an universal surface shape tester (Model SE-3H, manufactured by Kosaka Kenkyusho) and a maximum depth of dent was recorded, respectively. Incidentally, the description of "less than 0.3 μm" in the item of the dent in Table 29 means that no dent was observed because the surface roughness of a normal photosensitive material having no dent is about 0.5 μm.

The results are shown in Table 29.

TABLE

| Example No. | CGM | HTM | ETM | $V_L$ (V) | Tig (°C.) | Dent (μm) |
|---|---|---|---|---|---|---|
| 500 | X | 2 a | 7 a | 157 | 78.4 | <0.3 |
| 501 | X | 2 b | 7 a | 128 | 75.0 | <0.3 |
| 502 | X | 2 c | 7 a | 121 | 77.1 | <0.3 |
| 503 | X | 2 d | 7 a | 157 | 75.7 | <0.3 |
| 504 | X | 2 e | 7 a | 133 | 76.4 | <0.3 |
| 505 | X | 2 a | 7 b | 163 | 79.9 | <0.3 |
| 506 | X | 2 b | 7 b | 133 | 76.5 | <0.3 |
| 507 | X | 2 c | 7 b | 126 | 78.5 | <0.3 |
| 508 | X | 2 d | 7 b | 163 | 77.1 | <0.3 |
| 509 | X | 2 e | 7 b | 138 | 77.8 | <0.3 |
| 510 | X | 2 a | 7 c | 184 | 77.1 | <0.3 |
| 511 | X | 2 b | 7 c | 150 | 73.7 | <0.3 |
| 512 | X | 2 c | 7 c | 142 | 75.7 | <0.3 |
| 513 | X | 2 d | 7 c | 184 | 74.4 | <0.3 |
| 514 | X | 2 e | 7 c | 156 | 75.0 | <0.3 |
| 515 | X | 2 a | 7 d | 188 | 76.4 | <0.3 |
| 516 | X | 2 b | 7 d | 153 | 73.7 | <0.3 |
| 517 | X | 2 c | 7 d | 145 | 75.0 | <0.3 |
| 518 | X | 2 d | 7 d | 188 | 73.7 | <0.3 |
| 519 | X | 2 e | 7 d | 159 | 74.4 | <0.3 |
| 520 | Ti | 2 a | 7 a | 173 | 78.2 | <0.3 |

TABLE-continued

| Example No. | CGM | HTM | ETM | $V_L$ (V) | Tig (°C.) | Dent (μm) |
|---|---|---|---|---|---|---|
| 521 | Ti | 2 b | 7 a | 141 | 75.1 | <0.3 |
| 522 | Ti | 2 c | 7 a | 133 | 76.9 | <0.3 |
| 523 | Ti | 2 a | 7 b | 179 | 78.9 | <0.3 |
| 524 | Ti | 2 b | 7 b | 146 | 76.8 | <0.3 |
| 525 | Ti | 2 c | 7 b | 139 | 78.8 | <0.3 |
| Comp. Ex. 14 | X | A | 7 a | 164 | 68.2 | 1.1 |
| Comp. Ex. 15 | X | A | 7 b | 170 | 69.5 | 1.0 |
| Comp. Ex. 16 | X | A | 7 c | 192 | 67.0 | 1.5 |
| Comp. Ex. 17 | X | A | 7 d | 196 | 66.4 | 1.7 |

As is apparent from the results in Table 29, the photosensitive materials of Examples 500 to 525 are superior in sensitivity characteristics because of their low potential after exposure $V_L$ (V), and are superior in durability and heat resistance to those of Comparative Examples 1 to 4 using conventional benzidine (A) because the extrapolated glass transition initiation temperature Tig (°C.) is high and no dent is observed.

Examples 526 to 557

According to the same manner as that described in Examples 500 to 525 except for using 50 parts by weight of a compound which belongs to the benzidine derivative represented by the formula (3) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the respective Examples, and their characteristics were evaluated. The results are shown in Table 30.

TABLE 30

| Example No. | CGM | HTM | ETM | $V_L$ (V) | Tig (°C.) | Dent (μm) |
|---|---|---|---|---|---|---|
| 526 | X | 3 a | 7 a | 136 | 79.7 | <0.3 |
| 527 | X | 3 b | 7 a | 134 | 81.9 | <0.3 |
| 528 | X | 3 c | 7 a | 131 | 81.2 | <0.3 |
| 529 | X | 3 d | 7 a | 149 | 80.4 | <0.3 |
| 530 | X | 3 e | 7 a | 137 | 82.6 | <0.3 |
| 531 | X | 3 f | 7 a | 149 | 83.3 | <0.3 |
| 532 | X | 3 g | 7 a | 123 | 82.6 | <0.3 |
| 533 | X | 3 a | 7 b | 141 | 81.2 | <0.3 |
| 534 | X | 3 b | 7 b | 139 | 83.4 | <0.3 |
| 535 | X | 3 c | 7 b | 136 | 82.6 | <0.3 |
| 536 | X | 3 d | 7 b | 155 | 81.9 | <0.3 |
| 537 | X | 3 e | 7 b | 143 | 84.1 | <0.3 |
| 538 | X | 3 f | 7 b | 155 | 84.8 | <0.3 |
| 539 | X | 3 g | 7 b | 128 | 84.1 | <0.3 |
| 540 | X | 3 a | 7 c | 159 | 78.3 | <0.3 |
| 541 | X | 3 b | 7 c | 157 | 80.4 | <0.3 |
| 542 | X | 3 c | 7 c | 153 | 79.7 | <0.3 |
| 543 | X | 3 d | 7 c | 175 | 79.0 | <0.3 |
| 544 | X | 3 e | 7 c | 161 | 81.1 | <0.3 |
| 545 | X | 3 f | 7 c | 175 | 81.8 | <0.3 |
| 546 | X | 3 g | 7 c | 144 | 81.1 | <0.3 |
| 547 | X | 3 a | 7 d | 163 | 77.6 | <0.3 |
| 548 | X | 3 b | 7 d | 161 | 79.7 | <0.3 |
| 549 | X | 3 c | 7 d | 157 | 79.0 | <0.3 |
| 550 | X | 3 d | 7 d | 179 | 78.3 | <0.3 |
| 551 | X | 3 e | 7 d | 165 | 80.4 | <0.3 |
| 552 | X | 3 f | 7 d | 179 | 81.1 | <0.3 |
| 553 | X | 3 g | 7 d | 147 | 80.4 | <0.3 |

TABLE 30-continued

| Example No. | CGM | HTM | ETM | $V_L$ (V) | Tig (°C.) | Dent (μm) |
|---|---|---|---|---|---|---|
| 554 | Ti | 3 a | 7 a | 150 | 75.7 | <0.3 |
| 555 | Ti | 3 b | 7 a | 147 | 77.8 | <0.3 |
| 556 | Ti | 3 a | 7 b | 155 | 79.6 | <0.3 |
| 557 | Ti | 3 b | 7 b | 153 | 81.7 | <0.3 |

As is apparent from the results in Table 30, the photosensitive materials of Examples 526 to 557 are superior in sensitivity characteristics because of their low potential after exposure $V_L$ (V), and are superior in durability and heat resistance to those of Comparative Examples 14 to 17 using conventional benzidine (A) because the extrapolated Glass transition initiation temperature Tig (°C.) is high and no dent is observed.

Examples 558 to 579

According to the same manner as that described in Examples 500 to 525 except for using 50 parts by weight of a compound which belongs to the benzidine derivative represented by the formula (4) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated Glass transition initiation temperature Tig (°C.) and maximum depth of dent (μm) were determined as to the single-layer type photosensitive materials of the above respective Examples, and their characteristics were evaluated. The results are shown in Table 31.

TABLE 31

| Example No. | CGM | HTM | ETM | $V_L$ (V) | Tig (°C.) | Dent (μm) |
|---|---|---|---|---|---|---|
| 558 | X | 4 a | 7 a | 142 | 80.4 | <0.3 |
| 559 | X | 4 b | 7 a | 129 | 81.9 | <0.3 |
| 560 | X | 4 c | 7 a | 136 | 84.8 | <0.3 |
| 561 | X | 4 d | 7 a | 136 | 85.5 | <0.3 |
| 562 | X | 4 a | 7 b | 148 | 81.9 | <0.3 |
| 563 | X | 4 b | 7 b | 134 | 83.4 | <0.3 |
| 564 | X | 4 c | 7 b | 141 | 86.3 | <0.3 |
| 565 | X | 4 d | 7 b | 141 | 87.0 | <0.3 |
| 566 | X | 4 a | 7 c | 167 | 79.0 | <0.3 |
| 567 | X | 4 b | 7 c | 152 | 80.4 | <0.3 |
| 568 | X | 4 c | 7 c | 159 | 83.2 | <0.3 |
| 569 | X | 4 d | 7 c | 159 | 83.9 | <0.3 |
| 570 | X | 4 a | 7 d | 171 | 78.3 | <0.3 |
| 571 | X | 4 b | 7 d | 155 | 79.7 | <0.3 |
| 572 | X | 4 c | 7 d | 163 | 82.4 | <0.3 |
| 573 | X | 4 d | 7 d | 167 | 83.1 | <0.3 |
| 574 | Ti | 4 a | 7 a | 156 | 78.8 | <0.3 |
| 575 | Ti | 4 b | 7 a | 142 | 80.3 | <0.3 |
| 576 | Ti | 4 c | 7 a | 150 | 83.1 | <0.3 |
| 577 | Ti | 4 a | 7 b | 163 | 80.3 | <0.3 |
| 578 | Ti | 4 b | 7 b | 147 | 81.7 | <0.3 |
| 579 | Ti | 4 c | 7 b | 150 | 84.6 | <0.3 |

As is apparent from the results in Table 31, the photosensitive materials of Examples 558 to 579 are superior in sensitivity characteristics because of their low potential after exposure $V_L$ (V), and are superior in durability and heat resistance to those of Comparative Examples 14 to 17 using conventional benzidine (A) because the extrapolated glass transition initiation temperature Tig (°C.) is high and no dent is observed.

Examples 580 to 601

According to the same manner as that described in Examples 500 to 525 except for using 50 parts by weight of a compound which belongs to the benzidine derivative represented by the formula (5) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 32.

TABLE 32

| Example No. | CGM | HTM | ETM | $V_L$ (V) | Tig (°C.) | Dent (μm) |
|---|---|---|---|---|---|---|
| 580 | X | 5 a | 7 a | 159 | 81.9 | <0.3 |
| 581 | X | 5 b | 7 a | 136 | 79.0 | <0.3 |
| 582 | X | 5 c | 7 a | 134 | 79.7 | <0.3 |
| 583 | X | 5 d | 7 a | 160 | 81.2 | <0.3 |
| 584 | X | 5 a | 7 b | 165 | 83.4 | <0.3 |
| 585 | X | 5 b | 7 b | 141 | 80.4 | <0.3 |
| 586 | X | 5 c | 7 b | 139 | 81.2 | <0.3 |
| 587 | X | 5 d | 7 b | 167 | 82.6 | <0.3 |
| 588 | X | 5 a | 7 c | 186 | 80.4 | <0.3 |
| 589 | X | 5 b | 7 c | 159 | 77.6 | <0.3 |
| 590 | X | 5 c | 7 c | 157 | 78.3 | <0.3 |
| 591 | X | 5 d | 7 c | 188 | 79.7 | <0.3 |
| 592 | X | 5 a | 7 d | 190 | 79.7 | <0.3 |
| 593 | X | 5 b | 7 d | 163 | 76.9 | <0.3 |
| 594 | X | 5 c | 7 d | 161 | 77.6 | <0.3 |
| 595 | X | 5 d | 7 d | 192 | 79.0 | <0.3 |
| 596 | Ti | 5 a | 7 a | 175 | 80.3 | <0.3 |
| 597 | Ti | 5 b | 7 a | 150 | 77.4 | <0.3 |
| 598 | Ti | 5 c | 7 a | 147 | 78.1 | <0.3 |
| 599 | Ti | 5 a | 7 b | 182 | 81.7 | <0.3 |
| 600 | Ti | 5 b | 7 b | 155 | 78.8 | <0.3 |
| 601 | Ti | 5 c | 7 b | 153 | 79.6 | <0.3 |

As is apparent from the results in Table 32, the photosensitive materials of Examples 580 to 601 are superior in sensitivity characteristics because of their low potential after exposure $V_L$ (V), and are superior in durability and heat resistance to those of Comparative Examples 14 to 17 using conventional benzidine (A) because the extrapolated glass transition initiation temperature Tig (°C.) is high and no dent is observed.

Examples602 to 639

According to the same manner as that described in Examples 500 to 525 except for using 50 parts by weight of a compound which belongs to the phenylenediamine derivative represented by the formula (6) as the hole transferring material, a single-layer type photosensitive material for digital light source, which has a single-layer type photosensitive layer of 15 to 20 μm in film thickness, was produced.

The above photosensitivity test and the following wear resistance test were conducted as to the single-layer type photosensitive materials of the above respective Examples, and their characteristics were evaluated.

Wear resistance test

A photosensitive material of the respective Examples was fit with a facsimile for paper (Model LDC-650, manufactured by Mita Kogyo Co., Ltd.) and, after rotating 150,000 times without passing a paper through it, a change in film thickness of the organic photosensitive layer was determined, respectively.

The results are shown in Tables 5 and 6, together with those of the above tests in Comparative Examples 14 to 17.

TABLE 33

| Example No. | CGM | HTM | ETM | $V_L$ (V) | Amount of wear (μm) |
|---|---|---|---|---|---|
| 602 | X | 6 a | 7 a | 157 | 3.5 |
| 603 | X | 6 b | 7 a | 159 | 3.2 |
| 604 | X | 6 c | 7 a | 155 | 3.3 |
| 605 | X | 6 d | 7 a | 160 | 3.3 |
| 606 | X | 6 e | 7 a | 159 | 3.1 |
| 607 | X | 6 f | 7 a | 155 | 3.5 |
| 608 | X | 6 g | 7 a | 159 | 3.8 |
| 609 | X | 6 h | 7 a | 160 | 3.4 |
| 610 | X | 6 i | 7 a | 157 | 2.9 |
| 611 | X | 6 j | 7 a | 156 | 3.1 |
| 612 | X | 6 k | 7 a | 159 | 3.4 |
| 613 | X | 6 l | 7 a | 160 | 3.1 |
| 614 | X | 6 m | 7 a | 159 | 3.2 |
| 615 | X | 6 n | 7 a | 161 | 3.3 |
| 616 | X | 6 a | 7 b | 163 | 4.0 |
| 617 | X | 6 b | 7 b | 164 | 3.7 |
| 618 | X | 6 c | 7 b | 160 | 3.2 |
| 619 | X | 6 d | 7 b | 167 | 3.4 |
| 620 | X | 6 e | 7 b | 165 | 3.0 |
| 621 | X | 6 f | 7 b | 161 | 3.2 |
| 622 | X | 6 g | 7 b | 165 | 3.0 |

TABLE 34

| Example No. | CGM | HTM | ETM | $V_L$ (V) | Amount of wear (μm) |
|---|---|---|---|---|---|
| 623 | X | 6 h | 7 b | 166 | 2.8 |
| 624 | X | 6 i | 7 b | 163 | 3.8 |
| 625 | X | 6 j | 7 b | 163 | 3.7 |
| 626 | X | 6 k | 7 b | 165 | 3.4 |
| 627 | X | 6 l | 7 b | 167 | 3.1 |
| 628 | X | 6 m | 7 b | 164 | 3.2 |
| 629 | X | 6 n | 7 b | 168 | 3.3 |
| 630 | X | 6 b | 7 c | 186 | 3.5 |
| 631 | X | 6 f | 7 c | 182 | 3.4 |
| 632 | X | 6 h | 7 c | 188 | 3.1 |
| 633 | X | 6 b | 7 d | 190 | 3.9 |
| 634 | X | 6 f | 7 d | 186 | 3.2 |
| 635 | X | 6 h | 7 d | 192 | 3.1 |
| 636 | Ti | 6 b | 7 a | 175 | 3.0 |
| 637 | Ti | 6 f | 7 a | 171 | 3.5 |
| 638 | Ti | 6 b | 7 b | 180 | 3.4 |
| 639 | Ti | 6 f | 7 b | 177 | 3.0 |
| Comp. Ex. 14 | X | A | 7 a | 164 | 5.0 |
| Comp. Ex. 15 | X | A | 7 b | 170 | 4.9 |
| Comp. Ex. 16 | X | A | 7 c | 192 | 5.2 |
| Comp. Ex. 17 | X | A | 7 d | 196 | 5.4 |

As is apparent from the results in Tables 33 and 34, the photosensitive materials of Examples 602 to 639 are superior in sensitivity characteristics because of their low potential after exposure $V_L$ (V), and are superior in durability, particularly wear resistance, to Comparative Examples 14 to 17 using conventional benzidine (A) because of their small amount of wear.

Examples 640 to 665 and Comparative Examples 18 to 21

According to the same manner as that described in Examples 500 to 525 and Comparative Examples 14 to 17 except for using 30 parts by weight of the compound which belongs to a trinitrofluorenoneimine derivative represented by the formula (8) as the electron transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 35.

TABLE 35

| Example No. | CGM | HTM | ETM | $V_L$ (V) | Tig (°C.) | Dent (μm) |
|---|---|---|---|---|---|---|
| 640 | X | 2 a | 8 a | 137 | 79.2 | <0.3 |
| 641 | X | 2 b | 8 a | 111 | 75.6 | <0.3 |
| 642 | X | 2 c | 8 a | 105 | 77.9 | <0.3 |
| 643 | X | 2 d | 8 a | 137 | 77.2 | <0.3 |
| 644 | X | 2 e | 8 a | 116 | 80.7 | <0.3 |
| 645 | X | 2 a | 8 b | 178 | 77.3 | <0.3 |
| 646 | X | 2 b | 8 b | 145 | 77.2 | <0.3 |
| 647 | X | 2 c | 8 b | 137 | 79.3 | <0.3 |
| 648 | X | 2 d | 8 b | 178 | 77.9 | <0.3 |
| 649 | X | 2 e | 8 b | 150 | 78.6 | <0.3 |
| 650 | X | 2 a | 8 c | 156 | 77.9 | <0.3 |
| 651 | X | 2 b | 8 c | 128 | 74.4 | <0.3 |
| 652 | X | 2 c | 8 c | 121 | 76.5 | <0.3 |
| 653 | X | 2 d | 8 c | 156 | 75.1 | <0.3 |
| 654 | X | 2 e | 8 c | 133 | 75.8 | <0.3 |
| 655 | X | 2 a | 8 d | 160 | 77.1 | <0.3 |
| 656 | X | 2 b | 8 d | 136 | 74.4 | <0.3 |
| 657 | X | 2 c | 8 d | 129 | 75.8 | <0.3 |
| 658 | X | 2 d | 8 d | 167 | 74.4 | <0.3 |
| 659 | X | 2 e | 8 d | 142 | 75.1 | <0.3 |
| 660 | Ti | 2 a | 8 a | 151 | 78.9 | <0.3 |
| 661 | Ti | 2 b | 8 a | 123 | 75.9 | <0.3 |
| 662 | Ti | 2 c | 8 a | 116 | 77.7 | <0.3 |
| 663 | Ti | 2 a | 8 b | 195 | 79.7 | <0.3 |
| 664 | Ti | 2 b | 8 b | 159 | 77.6 | <0.3 |
| 665 | Ti | 2 c | 8 b | 152 | 79.6 | <0.3 |
| Comp. Ex. 18 | X | A | 8 a | 152 | 70.5 | 1.0 |
| Comp. Ex. 19 | X | A | 8 b | 159 | 71.2 | 1.2 |
| Comp. Ex. 20 | X | A | 8 c | 181 | 71.8 | 1.4 |
| Comp. Ex. 21 | X | A | 8 d | 183 | 69.9 | 1.6 |

As is apparent from the results in Table 35, the photosensitive materials of Examples 640 to 665 are superior in sensitivity characteristics because of their low potential after exposure $V_L$ (V), and are superior in durability and heat resistance to those of Comparative Examples 18 to 21 using conventional benzidine (A) because the extrapolated glass transition initiation temperature Tig (°C.) is high and no dent is observed.

Examples 666 to 697

According to the same manner as that described in Examples 640 to 665 except for using 50 parts by weight of a compound which belongs to the benzidine derivative represented by the formula (3) as the hole transferring material, a single-layer type photosensitive material for digital light source, which has a single-layer type photosensitive layer of 15 to 20 μm in film thickness, was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 36.

TABLE 36

| Example No. | CGM | HTM | ETM | $V_L$ (V) | Tig (°C.) | Dent (μm) |
|---|---|---|---|---|---|---|
| 666 | X | 3 a | 8 a | 118 | 80.5 | <0.3 |
| 667 | X | 3 b | 8 a | 117 | 82.7 | <0.3 |
| 668 | X | 3 c | 8 a | 114 | 82.0 | <0.3 |
| 669 | X | 3 d | 8 a | 130 | 81.2 | <0.3 |
| 670 | X | 3 e | 8 a | 119 | 83.4 | <0.3 |
| 671 | X | 3 f | 8 a | 130 | 84.1 | <0.3 |
| 672 | X | 3 g | 8 a | 107 | 83.4 | <0.3 |
| 673 | X | 3 a | 8 b | 151 | 82.0 | <0.3 |
| 674 | X | 3 b | 8 b | 149 | 84.2 | <0.3 |
| 675 | X | 3 c | 8 b | 146 | 82.7 | <0.3 |
| 676 | X | 3 d | 8 b | 166 | 84.9 | <0.3 |
| 677 | X | 3 e | 8 b | 166 | 85.6 | <0.3 |
| 678 | X | 3 f | 8 b | 137 | 85.1 | <0.3 |
| 679 | X | 3 g | 8 b | 170 | 79.1 | <0.3 |
| 680 | X | 3 a | 8 c | 135 | 81.2 | <0.3 |
| 681 | X | 3 b | 8 c | 133 | 80.5 | <0.3 |
| 682 | X | 3 c | 8 c | 130 | 79.8 | <0.3 |
| 683 | X | 3 d | 8 c | 137 | 81.9 | <0.3 |
| 684 | X | 3 e | 8 c | 149 | 82.6 | <0.3 |
| 685 | X | 3 f | 8 c | 139 | 81.9 | <0.3 |
| 686 | X | 3 g | 8 c | 133 | 78.4 | <0.3 |
| 687 | X | 3 a | 8 d | 145 | 80.5 | <0.3 |
| 688 | X | 3 b | 8 d | 143 | 79.8 | <0.3 |
| 689 | X | 3 c | 8 d | 140 | 79.1 | <0.3 |
| 690 | X | 3 d | 8 d | 159 | 81.2 | <0.3 |
| 691 | X | 3 e | 8 d | 147 | 81.9 | <0.3 |
| 692 | X | 3 f | 8 d | 159 | 81.2 | <0.3 |
| 693 | X | 3 g | 8 d | 131 | 76.5 | <0.3 |
| 694 | Ti | 3 a | 8 a | 131 | 78.6 | <0.3 |
| 695 | Ti | 3 b | 8 a | 128 | 78.6 | <0.3 |
| 696 | Ti | 3 a | 8 b | 135 | 80.4 | <0.3 |
| 697 | Ti | 3 b | 8 b | 133 | 82.5 | <0.3 |

As is apparent from the results in Tables 36, the photosensitive materials of Examples 666 to 697 are superior in sensitivity characteristics because of their low potential after exposure $V_L$ (V), and are superior in durability and heat resistance to those of Comparative Examples 18 to 21 using conventional benzidine (A) because the extrapolated glass transition initiation temperature Tig (°C.) is high and no dent is observed.

Examples 698 to 719

According to the same manner as that described in Examples 640 to 665 except for using 50 parts by weight of a compound which belongs to the benzidine derivative represented by the formula (4) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 37.

TABLE 37

| Example No. | CGM | HTM | ETM | $V_L$ (V) | Tig (°C.) | Dent (μm) |
|---|---|---|---|---|---|---|
| 698 | X | 4 a | 8 a | 124 | 81.2 | <0.3 |
| 699 | X | 4 b | 8 a | 112 | 82.7 | <0.3 |
| 700 | X | 4 c | 8 a | 118 | 85.6 | <0.3 |
| 701 | X | 4 d | 8 a | 118 | 86.4 | <0.3 |
| 702 | X | 4 a | 8 b | 161 | 82.7 | <0.3 |

TABLE 37-continued

| Example No. | CGM | HTM | ETM | $V_L$ (V) | Tig (°C.) | Dent (μm) |
|---|---|---|---|---|---|---|
| 703 | X | 4 b | 8 b | 146 | 84.2 | <0.3 |
| 704 | X | 4 c | 8 b | 154 | 87.2 | <0.3 |
| 705 | X | 4 d | 8 b | 156 | 87.9 | <0.3 |
| 706 | X | 4 a | 8 c | 132 | 79.8 | <0.3 |
| 707 | X | 4 b | 8 c | 138 | 81.2 | <0.3 |
| 708 | X | 4 c | 8 c | 138 | 84.0 | <0.3 |
| 709 | X | 4 d | 8 c | 149 | 84.7 | <0.3 |
| 710 | X | 4 a | 8 d | 135 | 79.1 | <0.3 |
| 711 | X | 4 b | 8 d | 142 | 80.5 | <0.3 |
| 712 | X | 4 c | 8 d | 145 | 83.2 | <0.3 |
| 713 | X | 4 d | 8 d | 149 | 83.9 | <0.3 |
| 714 | Ti | 4 a | 8 a | 139 | 79.6 | <0.3 |
| 715 | Ti | 4 b | 8 a | 126 | 81.1 | <0.3 |
| 716 | Ti | 4 c | 8 a | 132 | 83.9 | <0.3 |
| 717 | Ti | 4 a | 8 b | 177 | 81.1 | <0.3 |
| 718 | Ti | 4 b | 8 b | 160 | 82.5 | <0.3 |
| 719 | Ti | 4 c | 8 b | 164 | 85.4 | <0.3 |

As is apparent from the results in Table 37, the photosensitive materials of Examples 698 to 719 are superior in sensitivity characteristics because of their low potential after exposure $V_L$ (V), and are superior in durability and heat resistance to those of Comparative Examples 18 to 21 using conventional benzidine (A) because the extrapolated glass transition initiation temperature Tig (°C.) is high and no dent is observed.

Examples 720 to 741

According to the same manner as that described in Examples 640 to 665 except for using 50 parts by weight of a compound which belongs to the benzidine derivative represented by the formula (5) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 38.

TABLE 38

| Example No. | CGM | HTM | ETM | $V_L$ (V) | Tig (°C.) | Dent (μm) |
|---|---|---|---|---|---|---|
| 720 | X | 5 a | 8 a | 138 | 82.7 | <0.3 |
| 721 | X | 5 b | 8 a | 118 | 79.8 | <0.3 |
| 722 | X | 5 c | 8 a | 117 | 80.5 | <0.3 |
| 723 | X | 5 d | 8 a | 139 | 82.0 | <0.3 |
| 724 | X | 5 a | 8 b | 180 | 84.2 | <0.3 |
| 725 | X | 5 b | 8 b | 154 | 81.2 | <0.3 |
| 726 | X | 5 c | 8 b | 152 | 82.0 | <0.3 |
| 727 | X | 5 d | 8 b | 182 | 83.4 | <0.3 |
| 728 | X | 5 a | 8 c | 162 | 81.2 | <0.3 |
| 729 | X | 5 b | 8 c | 138 | 78.4 | <0.3 |
| 730 | X | 5 c | 8 c | 137 | 79.1 | <0.3 |
| 731 | X | 5 d | 8 c | 164 | 80.5 | <0.3 |
| 732 | X | 5 a | 8 d | 166 | 80.4 | <0.3 |
| 733 | X | 5 b | 8 d | 141 | 77.7 | <0.3 |
| 734 | X | 5 c | 8 d | 139 | 78.4 | <0.3 |
| 735 | X | 5 d | 8 d | 167 | 79.8 | <0.3 |
| 736 | Ti | 5 a | 8 a | 152 | 81.1 | <0.3 |
| 737 | Ti | 5 b | 8 a | 131 | 78.9 | <0.3 |
| 738 | Ti | 5 c | 8 a | 128 | 82.5 | <0.3 |
| 739 | Ti | 5 a | 8 b | 198 | 80.0 | <0.3 |

TABLE 38-continued

| Example No. | CGM | HTM | ETM | $V_L$ (V) | Tig (°C.) | Dent (μm) |
|---|---|---|---|---|---|---|
| 740 | Ti | 5 b | 8 b | 169 | 79.7 | <0.3 |
| 741 | Ti | 5 c | 8 b | 167 | 80.4 | <0.3 |

As is apparent from the results in Table 38, the photosensitive materials of Examples 720 to 741 are superior in sensitivity characteristics because of their low potential after exposure $V_L$ (V), and are superior in durability and heat resistance to those of Comparative Examples 18 to 21 using conventional benzidine (A) because the extrapolated glass transition initiation temperature Tig (°C.) is high and no dent is observed.

Examples 742 to 779

According to the same manner as that described in Examples 640 to 665 except for using 50 parts by weight of a compound which belongs to the phenylenediamine derivative represented by the formula (6) as the hole transferring material, a single-layer type photosensitive material for digital light source which has a single-layer type photosensitive layer of 15 to 20 μm in film thickness was produced.

According to the same manner as that described above, the potential after exposure $V_L$ (V) and amount of wear (μm) were determined as to the single-layer type photosensitive materials of the above respective Examples, and their characteristics were evaluated. The results are shown in Tables 39 and 40, together with the above data in Comparative Examples 18 to 21.

TABLE 39

| Example No. | CGM | HTM | ETM | $V_L$ (V) | Amount of wear (μm) |
|---|---|---|---|---|---|
| 742 | X | 6 a | 8 a | 138 | 3.3 |
| 743 | X | 6 b | 8 a | 140 | 3.0 |
| 744 | X | 6 c | 8 a | 136 | 3.6 |
| 745 | X | 6 d | 8 a | 141 | 3.3 |
| 746 | X | 6 e | 8 a | 140 | 3.5 |
| 747 | X | 6 f | 8 a | 136 | 3.7 |
| 748 | X | 6 g | 8 a | 140 | 3.4 |
| 749 | X | 6 h | 8 a | 141 | 2.8 |
| 750 | X | 6 i | 8 a | 138 | 3.4 |
| 751 | X | 6 j | 8 a | 137 | 3.1 |
| 752 | X | 6 k | 8 a | 140 | 3.3 |
| 753 | X | 6 l | 8 a | 141 | 2.9 |
| 754 | X | 6 m | 8 a | 140 | 2.9 |
| 755 | X | 6 n | 8 a | 142 | 3.1 |
| 756 | X | 6 a | 8 b | 178 | 3.0 |
| 757 | X | 6 b | 8 b | 179 | 2.8 |
| 758 | X | 6 c | 8 b | 182 | 3.3 |
| 759 | X | 6 d | 8 b | 180 | 3.2 |
| 760 | X | 6 e | 8 b | 175 | 3.4 |
| 761 | X | 6 f | 8 b | 181 | 3.5 |
| 762 | X | 6 g | 8 b | 178 | 2.7 |

TABLE 40

| Example No. | CGM | HTM | ETM | $V_L$ (V) | Amount of wear (μm) |
|---|---|---|---|---|---|
| 763 | X | 6 h | 8 b | 178 | 2.9 |
| 764 | X | 6 i | 8 b | 180 | 3.4 |
| 765 | X | 6 j | 8 b | 182 | 3.0 |
| 766 | X | 6 k | 8 b | 179 | 3.1 |
| 767 | X | 6 l | 8 b | 183 | 2.9 |
| 768 | X | 6 m | 8 b | 178 | 3.3 |

TABLE 40-continued

| Example No. | CGM | HTM | ETM | $V_L$ (V) | Amount of wear (μm) |
|---|---|---|---|---|---|
| 769 | X | 6 n | 8 b | 181 | 3.0 |
| 770 | X | 6 b | 8 c | 164 | 2.4 |
| 771 | X | 6 f | 8 c | 160 | 2.9 |
| 772 | X | 6 h | 8 c | 167 | 3.3 |
| 773 | X | 6 b | 8 d | 164 | 3.3 |
| 774 | X | 6 f | 8 d | 169 | 3.0 |
| 775 | X | 6 h | 8 d | 169 | 3.3 |
| 776 | Ti | 6 b | 8 a | 154 | 3.1 |
| 777 | Ti | 6 f | 8 a | 150 | 2.9 |
| 778 | Ti | 6 b | 8 b | 196 | 3.0 |
| 779 | Ti | 6 f | 8 b | 193 | 3.1 |
| Comp. Ex. 18 | X | A | 8 a | 152 | 5.3 |
| Comp. Ex. 19 | X | A | 8 b | 159 | 5.0 |
| Comp. Ex. 20 | X | A | 8 c | 181 | 5.5 |
| Comp. Ex. 21 | X | A | 8 d | 183 | 4.8 |

As is apparent from the results in Tables 39 and 40, the photosensitive materials of Examples 742 to 779 are superior in sensitivity characteristics because of their low potential after exposure $V_L$ (V), and are superior in durability, particularly wear resistance, to those of Comparative Examples 18 to 21 using conventional benzidine (A) because of their small amount of wear.

Examples 780 to 805 and Comparative Examples 22 to 25

According to the same manner as that described in Examples 500 to 525 and Comparative Examples 14 to 17 except for using 30 parts by weight of a compound which belongs to the trinitrofluoreneoneimine derivative represented by the formula (9) as the electron transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 41.

TABLE 4

| Example No. | CGM | HTM | ETM | $V_L$ (V) | Tig (°C.) | Dent (μm) |
|---|---|---|---|---|---|---|
| 780 | X | 2 a | 9 a | 170 | 80.0 | <0.3 |
| 781 | X | 2 b | 9 a | 138 | 76.5 | <0.3 |
| 782 | X | 2 c | 9 a | 131 | 78.6 | <0.3 |
| 783 | X | 2 d | 9 a | 170 | 77.2 | <0.3 |
| 784 | X | 2 e | 9 a | 144 | 77.9 | <0.3 |
| 785 | X | 2 a | 9 b | 161 | 81.5 | <0.3 |
| 786 | X | 2 b | 9 b | 132 | 78.0 | <0.3 |
| 787 | X | 2 c | 9 b | 125 | 80.1 | <0.3 |
| 788 | X | 2 d | 9 b | 161 | 78.6 | <0.3 |
| 789 | X | 2 e | 9 b | 137 | 79.4 | <0.3 |
| 790 | X | 2 a | 9 c | 169 | 78.6 | <0.3 |
| 791 | X | 2 b | 9 c | 138 | 75.2 | <0.3 |
| 792 | X | 2 c | 9 c | 131 | 77.2 | <0.3 |
| 793 | X | 2 d | 9 c | 169 | 75.9 | <0.3 |
| 794 | X | 2 e | 9 c | 140 | 76.5 | <0.3 |
| 795 | X | 2 a | 9 d | 160 | 77.9 | <0.3 |
| 796 | X | 2 b | 9 d | 130 | 75.2 | <0.3 |
| 797 | X | 2 c | 9 d | 123 | 76.5 | <0.3 |
| 798 | X | 2 d | 9 d | 160 | 75.2 | <0.3 |
| 799 | X | 2 e | 9 d | 135 | 75.9 | <0.3 |
| 800 | Ti | 2 a | 9 a | 187 | 79.8 | <0.3 |

TABLE 4-continued

| Example No. | CGM | HTM | ETM | $V_L$ (V) | Tig (°C.) | Dent (μm) |
|---|---|---|---|---|---|---|
| 801 | Ti | 2 b | 9 a | 152 | 76.6 | <0.3 |
| 802 | Ti | 2 c | 9 a | 144 | 78.4 | <0.3 |
| 803 | Ti | 2 a | 9 b | 179 | 80.5 | <0.3 |
| 804 | Ti | 2 b | 9 b | 145 | 78.4 | <0.3 |
| 805 | Ti | 2 c | 9 b | 138 | 80.4 | <0.3 |
| Comp. Ex. 22 | X | A | 9 a | 167 | 70.8 | 1.3 |
| Comp. Ex. 23 | X | A | 9 b | 172 | 69.9 | 1.5 |
| Comp. Ex. 24 | X | A | 9 c | 189 | 68.6 | 1.6 |
| Comp. Ex. 25 | X | A | 9 d | 195 | 70.5 | 1.3 |

As is apparent from the results in Table 41, the photosensitive materials of Examples 780 to 805 are superior in sensitivity characteristics because of their low potential after exposure $V_L$ (V), and are superior in durability and heat resistance to those of Comparative Examples 22 to 25 using conventional benzidine (A) because the extrapolated glass transition initiation temperature Tig (°C.) is high and no dent is observed.

Examples 806 to 837

According to the same manner as that described in Examples 780 to 805 except for using 50 parts by weight of a compound which belongs to the benzidine derivative represented by the formula (3) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 42.

TABLE 42

| Example No. | CGM | HTM | ETM | $V_L$ (V) | Tig (°C.) | Dent (μm) |
|---|---|---|---|---|---|---|
| 806 | X | 3 a | 9 a | 147 | 81.3 | <0.3 |
| 807 | X | 3 b | 9 a | 145 | 83.5 | <0.3 |
| 808 | X | 3 c | 9 a | 141 | 82.8 | <0.3 |
| 809 | X | 3 d | 9 a | 161 | 82.0 | <0.3 |
| 810 | X | 3 e | 9 a | 148 | 84.2 | <0.3 |
| 811 | X | 3 f | 9 a | 161 | 85.0 | <0.3 |
| 812 | X | 3 g | 9 a | 133 | 84.3 | <0.3 |
| 813 | X | 3 a | 9 b | 140 | 82.8 | <0.3 |
| 814 | X | 3 b | 9 b | 138 | 85.1 | <0.3 |
| 815 | X | 3 c | 9 b | 135 | 84.3 | <0.3 |
| 816 | X | 3 d | 9 b | 153 | 83.5 | <0.3 |
| 817 | X | 3 e | 9 b | 142 | 85.8 | <0.3 |
| 818 | X | 3 f | 9 b | 153 | 86.5 | <0.3 |
| 819 | X | 3 g | 9 b | 127 | 85.8 | <0.3 |
| 820 | X | 3 a | 9 c | 143 | 79.9 | <0.3 |
| 821 | X | 3 b | 9 c | 141 | 82.0 | <0.3 |
| 822 | X | 3 c | 9 c | 138 | 81.3 | <0.3 |
| 823 | X | 3 d | 9 c | 158 | 80.6 | <0.3 |
| 824 | X | 3 e | 9 c | 145 | 82.7 | <0.3 |
| 825 | X | 3 f | 9 c | 158 | 83.4 | <0.3 |
| 826 | X | 3 g | 9 c | 130 | 82.7 | <0.3 |
| 827 | X | 3 a | 9 d | 137 | 79.2 | <0.3 |
| 828 | X | 3 b | 9 d | 133 | 81.3 | <0.3 |
| 829 | X | 3 c | 9 d | 152 | 80.6 | <0.3 |
| 830 | X | 3 d | 9 d | 140 | 79.9 | <0.3 |
| 831 | X | 3 e | 9 d | 152 | 82.0 | <0.3 |
| 832 | X | 3 f | 9 d | 125 | 82.7 | <0.3 |
| 833 | X | 3 g | 9 d | 125 | 82.0 | <0.3 |

TABLE 42-continued

| Example No. | CGM | HTM | ETM | $V_L$ (V) | Tig (°C.) | Dent (μm) |
|---|---|---|---|---|---|---|
| 834 | Ti | 3 a | 9 a | 162 | 77.2 | <0.3 |
| 835 | Ti | 3 b | 9 a | 159 | 79.4 | <0.3 |
| 836 | Ti | 3 a | 9 b | 153 | 81.2 | <0.3 |
| 837 | Ti | 3 b | 9 b | 151 | 83.3 | <0.3 |

As is apparent from the results in Table 42, the photosensitive materials of Examples 806 to 837 are superior in sensitivity characteristics because of their low potential after exposure $V_L$ (V), and are superior in durability and heat resistance to those of Comparative Examples 22 to 25 using conventional benzidine (A) because the extrapolated glass transition initiation temperature Tig (°C.) is high and no dent is observed.

Examples 838 to 859

According to the same manner as that described in Examples 780 to 805 except for using 50 parts by weight of a compound which belongs to the benzidine derivative represented by the formula (4) as the hole transferring material, a single-layer type photosensitive material for digital light source, which has a single-layer type photosensitive layer of 15 to 20 μm in film thickness, was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated- The results are shown in Table 43.

TABLE 43

| Example No. | CGM | HTM | ETM | $V_L$ (V) | Tig (°C.) | Dent (μm) |
|---|---|---|---|---|---|---|
| 838 | X | 4 a | 9 a | 153 | 82.0 | <0.3 |
| 839 | X | 4 b | 9 a | 139 | 83.5 | <0.3 |
| 840 | X | 4 c | 9 a | 147 | 86.5 | <0.3 |
| 841 | X | 4 d | 9 a | 147 | 87.2 | <0.3 |
| 842 | X | 4 a | 9 b | 147 | 83.5 | <0.3 |
| 843 | X | 4 b | 9 b | 133 | 85.1 | <0.3 |
| 844 | X | 4 c | 9 b | 140 | 88.0 | <0.3 |
| 845 | X | 4 d | 9 b | 140 | 88.7 | <0.3 |
| 846 | X | 4 a | 9 c | 150 | 80.6 | <0.3 |
| 847 | X | 4 b | 9 c | 137 | 82.0 | <0.3 |
| 848 | X | 4 c | 9 c | 142 | 84.9 | <0.3 |
| 849 | X | 4 d | 9 c | 143 | 85.6 | <0.3 |
| 850 | X | 4 a | 9 d | 145 | 79.9 | <0.3 |
| 851 | X | 4 b | 9 d | 132 | 81.3 | <0.3 |
| 852 | X | 4 c | 9 d | 139 | 84.0 | <0.3 |
| 853 | X | 4 d | 9 d | 142 | 84.8 | <0.3 |
| 854 | Ti | 4 a | 9 a | 168 | 80.4 | <0.3 |
| 855 | Ti | 4 b | 9 a | 153 | 81.9 | <0.3 |
| 856 | Ti | 4 c | 9 a | 162 | 84.8 | <0.3 |
| 857 | Ti | 4 a | 9 b | 161 | 81.9 | <0.3 |
| 858 | Ti | 4 b | 9 b | 146 | 83.3 | <0.3 |
| 859 | Ti | 4 c | 9 b | 149 | 86.3 | <0.3 |

As is apparent from the results in Table 43, the photosensitive materials of Examples 838 to 859 of the present invention are superior in sensitivity characteristics because of their low potential after exposure $V_L$ (V), and are superior in durability and heat resistance to those of Comparative Examples 22 to 25 using conventional benzidine (A) because the extrapolated glass transition initiation temperature Tig (°C.) is high and no dent is observed.

Examples 860 to 881

According to the same manner as that described in Examples 780 to 805 except for using 50 parts by weight of a compound which belongs to the benzidine derivative represented by the formula (5) as the hole transferring material, a single-layer type photosensitive material for digital light source, which has a single-layer type photosensitive layer of 15 to 20 μm in film thickness, was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples, and their characteristics were evaluated. The results are shown in Table 44.

TABLE 44

| Example No. | CGM | HTM | ETM | $V_L$ (V) | Tig (°C.) | Dent (μm) |
|---|---|---|---|---|---|---|
| 860 | X | 5 a | 9 a | 172 | 83.5 | <0.3 |
| 861 | X | 5 b | 9 a | 147 | 80.6 | <0.3 |
| 862 | X | 5 c | 9 a | 145 | 81.3 | <0.3 |
| 863 | X | 5 d | 9 a | 173 | 82.8 | <0.3 |
| 864 | X | 5 a | 9 b | 163 | 85.1 | <0.3 |
| 865 | X | 5 b | 9 b | 140 | 82.0 | <0.3 |
| 866 | X | 5 c | 9 b | 138 | 82.8 | <0.3 |
| 867 | X | 5 d | 9 b | 165 | 84.3 | <0.3 |
| 868 | X | 5 a | 9 c | 167 | 82.0 | <0.3 |
| 869 | X | 5 b | 9 c | 143 | 79.2 | <0.3 |
| 870 | X | 5 c | 9 c | 141 | 79.9 | <0.3 |
| 871 | X | 5 d | 9 c | 169 | 81.3 | <0.3 |
| 872 | X | 5 a | 9 d | 139 | 81.3 | <0.3 |
| 873 | X | 5 b | 9 d | 137 | 78.4 | <0.3 |
| 874 | X | 5 c | 9 d | 163 | 79.2 | <0.3 |
| 875 | X | 5 d | 9 d | 149 | 80.6 | <0.3 |
| 876 | Ti | 5 a | 9 a | 189 | 81.9 | <0.3 |
| 877 | Ti | 5 b | 9 a | 162 | 78.9 | <0.3 |
| 878 | Ti | 5 c | 9 a | 159 | 79.7 | <0.3 |
| 879 | Ti | 5 a | 9 b | 180 | 83.3 | <0.3 |
| 880 | Ti | 5 b | 9 b | 153 | 80.4 | <0.3 |
| 881 | Ti | 5 c | 9 b | 151 | 81.2 | <0.3 |

As is apparent from the results in Table 44, the photosensitive materials of Examples 860 to 881 are superior in sensitivity characteristics because of their low potential after exposure $V_L$ (V), and are superior in durability and heat resistance to those of Comparative Examples 22 to 25 using conventional benzidine (A) because the extrapolated glass transition initiation temperature Tig (°C.) is high and no dent is observed.

Examples 882 to 919

According to the same manner as that described in Examples 780 to 805 except for using 50 parts by weight of a compound which belongs to the phenylenediamine derivative represented by the formula (6) as the hole transferring material, a single-layer type photosensitive material for digital light source which has a single-layer type photosensitive layer of 15 to 20 μm in film thickness was produced.

According to the same manner as that described above, the potential after exposure $V_L$ (V) and amount of wear (μm) were determined as to the single-layer type photosensitive materials of the above respective Examples, and their characteristics were evaluated. The results are shown in Tables 45 and 46, together with the above data of Comparative Examples 22 to 25.

TABLE 45

| Example No. | CGM | HTM | ETM | $V_L$ (V) | Amount of wear (μm) |
|---|---|---|---|---|---|
| 882 | X | 6 a | 9 a | 149 | 2.9 |
| 883 | X | 6 b | 9 a | 151 | 3.3 |
| 884 | X | 6 c | 9 a | 147 | 2.7 |
| 885 | X | 6 d | 9 a | 152 | 3.1 |
| 886 | X | 6 e | 9 a | 151 | 3.0 |
| 887 | X | 6 f | 9 a | 147 | 2.9 |
| 888 | X | 6 g | 9 a | 151 | 3.4 |
| 889 | X | 6 h | 9 a | 152 | 3.4 |
| 890 | X | 6 i | 9 a | 149 | 3.1 |
| 891 | X | 6 j | 9 a | 148 | 2.8 |
| 892 | X | 6 k | 9 a | 151 | 3.2 |
| 893 | X | 6 l | 9 a | 152 | 2.8 |
| 894 | X | 6 m | 9 a | 151 | 2.9 |
| 895 | X | 6 n | 9 a | 153 | 3.3 |
| 896 | X | 6 a | 9 b | 177 | 3.0 |
| 897 | X | 6 b | 9 b | 180 | 3.2 |
| 898 | X | 6 c | 9 b | 178 | 3.1 |
| 899 | X | 6 d | 9 b | 173 | 3.2 |
| 900 | X | 6 e | 9 b | 179 | 2.8 |
| 901 | X | 6 f | 9 b | 179 | 3.3 |
| 902 | X | 6 g | 9 b | 176 | 3.1 |

TABLE 46

| Example No. | CGM | HTM | ETM | $V_L$ (V) | Amount of wear (μm) |
|---|---|---|---|---|---|
| 903 | X | 6 h | 9 b | 176 | 3.2 |
| 904 | X | 6 i | 9 b | 178 | 3.0 |
| 905 | X | 6 j | 9 b | 180 | 3.2 |
| 906 | X | 6 k | 9 b | 177 | 3.1 |
| 907 | X | 6 l | 9 b | 181 | 3.0 |
| 908 | X | 6 m | 9 b | 179 | 3.0 |
| 909 | X | 6 n | 9 b | 179 | 2.7 |
| 910 | X | 6 b | 9 c | 148 | 3.2 |
| 911 | X | 6 f | 9 c | 144 | 3.0 |
| 912 | X | 6 h | 9 c | 150 | 3.0 |
| 913 | X | 6 b | 9 d | 139 | 2.9 |
| 914 | X | 6 f | 9 d | 144 | 3.3 |
| 915 | X | 6 h | 9 d | 144 | 3.2 |
| 916 | Ti | 6 b | 9 a | 166 | 3.4 |
| 917 | Ti | 6 f | 9 a | 162 | 3.1 |
| 918 | Ti | 6 b | 9 b | 194 | 3.4 |
| 919 | Ti | 6 f | 9 b | 191 | 2.9 |
| Comp. Ex. 22 | X | A | 9 a | 167 | 5.5 |
| Comp. Ex. 23 | X | A | 9 b | 172 | 6.0 |
| Comp. Ex. 24 | X | A | 9 c | 189 | 5.2 |
| Comp. Ex. 25 | X | A | 9 d | 195 | 5.3 |

As is apparent from the results in Tables 45 and 46, the photosensitive materials of Examples 882 to 919 are superior in sensitivity characteristics because of their low potential after exposure $V_L$ (V), and are superior in durability, particularly wear resistance, to those of Comparative Examples 22 to 25 using conventional benzidine (A) because of their small amount of wear.

Examples 920 and 937

5 Parts by weight of a phthalocyanine pigment as the electric charge generating material, 50 parts by weight of a compound which belongs to the benzidine derivative represented by the formula (2) as the hole transferring material, 30 parts by weight of a compound which belongs to a trinitrofluorenoneimine derivative represented by the formula (7), 10 parts by weight of a compound which belongs to the quinone derivative represented by any one of the formulas (10) and (11) as the electron attractive compound (hereinafter referred to as EAC in Tables) and 100 parts by weight of polycarbonate as the binding resin were mixed and dispersed with 800 parts by weight of tetrahydrofuran for 50 hours, using a ball mill, to prepare a coating solution for electric charge generating layer. Then, this coating solution was applied on an aluminum tube as the conductive substrate by a dip coating method, followed by hot-air drying at 100° C. for 60 minutes to give a single-layer type photosensitive material for digital light source which has a single-layer type photosensitive layer of 15 to 20 μm in film thickness.

Comparative Examples 26 to 28

According to the same manner as that described in Examples 920 to 937 except for using 10 parts by weight of a quinone derivative represented by the formula (B) as the electron attractive compound:

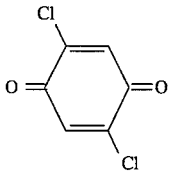

(B)

which has a redox potential of −0.5 V, a single-layer type photosensitive material for digital light source, which has a single-layer type photosensitive layer of 15 to 20 μm in film thickness, was produced.

Comparative Examples 29 and 30

According to the same manner as that described in Examples 920 to 937 except for using 50 parts by weight of a conventional benzidine derivative represented by the formula (A) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 47.

TABLE 47

| Example No. | CGM | HTM | ETM | EAC | $V_L$ (V) | Tig (°C.) | Dent (μm) |
|---|---|---|---|---|---|---|---|
| 920 | X | 2 a | 7 a | 10 a | 126 | 76.8 | <0.3 |
| 921 | X | 2 b | 7 a | 10 a | 102 | 73.5 | <0.3 |
| 922 | X | 2 c | 7 a | 10 a | 97 | 75.6 | <0.3 |
| 923 | X | 2 d | 7 a | 10 a | 126 | 74.2 | <0.3 |
| 924 | X | 2 e | 7 a | 10 a | 106 | 74.9 | <0.3 |
| 925 | X | 2 a | 7 b | 10 a | 130 | 78.3 | <0.3 |
| 926 | X | 2 b | 7 b | 10 a | 106 | 75.0 | <0.3 |
| 927 | X | 2 c | 7 b | 10 a | 101 | 76.9 | <0.3 |
| 928 | X | 2 a | 7 a | 10 b | 133 | 76.4 | <0.3 |
| 929 | X | 2 b | 7 a | 10 b | 109 | 73.1 | <0.3 |
| 930 | X | 2 c | 7 a | 10 b | 103 | 75.2 | <0.3 |
| 931 | X | 2 a | 7 b | 10 b | 139 | 77.9 | <0.3 |
| 932 | X | 2 b | 7 b | 10 b | 113 | 74.6 | <0.3 |
| 933 | X | 2 c | 7 b | 10 b | 107 | 76.5 | <0.3 |
| 934 | X | 2 a | 7 a | 11 a | 141 | 76.0 | <0.3 |
| 935 | X | 2 b | 7 a | 11 a | 115 | 72.8 | <0.3 |
| 936 | Ti | 2 a | 7 a | 10 a | 138 | 76.6 | <0.3 |
| 937 | Ti | 2 b | 7 a | 10 a | 113 | 73.6 | <0.3 |
| Comp. Ex. 26 | X | 2 a | 7 a | B | 204 | 76.0 | <0.3 |

TABLE 47-continued

| Example No. | CGM | HTM | ETM | EAC | $V_L$ (V) | Tig (°C.) | Dent (μm) |
|---|---|---|---|---|---|---|---|
| Comp. Ex. 27 | X | 2 b | 7 a | B | 166 | 72.8 | <0.3 |
| Comp. Ex. 28 | X | 2 c | 7 a | B | 157 | 74.8 | <0.3 |
| Comp. Ex. 29 | X | A | 7 a | 10 a | 131 | 66.8 | 1.4 |
| Comp. Ex. 30 | X | A | 7 b | 10 a | 136 | 68.1 | 1.3 |

As is apparent from the results in Table 47, the photosensitive materials of Examples 920 to 937 are superior in sensitivity characteristics to those of Comparative Examples 26 to 28 using an electron attractive compound of the formula (B) having a redox potential of less than −0.8 V and those of Examples 500, 501, etc. containing no electron attractive compound because of their low potential after exposure $V_L$ (V), and are superior in durability and heat resistance to those of Comparative Examples 29 and 30 using conventional benzidine (A) because the extrapolated glass transition initiation temperature Tig (°C.) is high and no dent is observed.

Examples 938 to 957 and Comparative Examples 31 to 33

According to the same manner as that described in Examples 920 to 937 and Comparative Examples 26 to 28 except for using 50 parts by weight of a compound which belongs to the benzidine derivative represented by the formula (3) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 48.

TABLE 48

| Example No. | CGM | HTM | ETM | EAC | $V_L$ (V) | Tig (°C.) | DENT (μm) |
|---|---|---|---|---|---|---|---|
| 938 | X | 3 a | 7 a | 10 a | 109 | 78.1 | <0.3 |
| 939 | X | 3 b | 7 a | 10 a | 107 | 80.3 | <0.3 |
| 940 | X | 3 c | 7 a | 10 a | 105 | 79.6 | <0.3 |
| 941 | X | 3 d | 7 a | 10 a | 119 | 78.8 | <0.3 |
| 942 | X | 3 e | 7 a | 10 a | 110 | 80.9 | <0.3 |
| 943 | X | 3 f | 7 a | 10 a | 119 | 81.6 | <0.3 |
| 944 | X | 3 g | 7 a | 10 a | 98 | 80.9 | <0.3 |
| 945 | X | 3 a | 7 b | 10 a | 113 | 79.6 | <0.3 |
| 946 | X | 3 b | 7 b | 10 a | 111 | 81.7 | <0.3 |
| 947 | X | 3 c | 7 b | 10 a | 109 | 80.9 | <0.3 |
| 948 | X | 3 a | 7 a | 10 b | 116 | 77.7 | <0.3 |
| 949 | X | 3 b | 7 a | 10 b | 114 | 79.9 | <0.3 |
| 950 | X | 3 c | 7 a | 10 b | 111 | 79.2 | <0.3 |
| 951 | X | 3 a | 7 b | 10 b | 120 | 79.2 | <0.3 |
| 952 | X | 3 b | 7 b | 10 b | 118 | 81.3 | <0.3 |
| 953 | X | 3 c | 7 b | 10 b | 116 | 80.5 | <0.3 |
| 954 | X | 3 a | 7 a | 11 a | 122 | 77.3 | <0.3 |
| 955 | X | 3 b | 7 a | 11 a | 121 | 79.4 | <0.3 |
| 956 | Ti | 3 a | 7 a | 10 a | 120 | 74.2 | <0.3 |
| 957 | Ti | 3 b | 7 a | 10 a | 148 | 76.2 | <0.3 |
| Comp. Ex. 31 | X | 3 a | 7 a | B | 177 | 77.3 | <0.3 |

TABLE 48-continued

| Example No. | CGM | HTM | ETM | EAC | $V_L$ (V) | Tig (°C.) | DENT (μm) |
|---|---|---|---|---|---|---|---|
| Comp. Ex. 32 | X | 3 b | 7 a | B | 174 | 79.4 | <0.3 |
| Comp. Ex. 33 | X | 3 c | 7 a | B | 170 | 78.8 | <0.3 |

As is apparent from the results in Table 48, the photosensitive materials of Examples 938 to 957 are superior in sensitivity characteristics to those of Comparative Examples 31 to 33 using an electron attractive compound of the formula (B) having a redox potential of less than −0.8 V and those of Examples 526, 527, etc. containing no electron attractive compound because of their low potential after exposure $V_L$ (V), and are superior in durability and heat resistance to those of Comparative Examples 29 and 30 using conventional benzidine (A) because the extrapolated glass transition initiation temperature Tig (°C.) is high and no dent is observed.

Examples 958 to 974 and Comparative Examples 34 to 36

According to the same manner as that described in Examples 920 to 937 and Comparative Examples 26 to 28 except for using 50 parts by weight of a compound which belongs to the benzidine derivative represented by the formula (4) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 49.

TABLE 49

| Example No. | CGM | HTM | ETM | EAC | $V_L$ (V) | Tig (°C.) | Dent (μm) |
|---|---|---|---|---|---|---|---|
| 958 | X | 4 a | 7 a | 10 a | 114 | 78.8 | <0.3 |
| 959 | X | 4 b | 7 a | 10 a | 103 | 80.3 | <0.3 |
| 960 | X | 4 c | 7 a | 10 a | 109 | 83.1 | <0.3 |
| 961 | X | 4 d | 7 a | 10 a | 109 | 83.8 | <0.3 |
| 962 | X | 4 a | 7 b | 10 a | 118 | 80.3 | <0.3 |
| 963 | X | 4 b | 7 b | 10 a | 107 | 81.7 | <0.3 |
| 964 | X | 4 c | 7 b | 10 a | 113 | 84.6 | <0.3 |
| 965 | X | 4 a | 7 a | 10 b | 121 | 78.4 | <0.3 |
| 966 | X | 4 b | 7 a | 10 b | 110 | 79.9 | <0.3 |
| 967 | X | 4 c | 7 a | 10 b | 116 | 82.7 | <0.3 |
| 968 | X | 4 a | 7 b | 10 b | 126 | 79.9 | <0.3 |
| 969 | X | 4 b | 7 b | 10 b | 114 | 81.3 | <0.3 |
| 970 | X | 4 c | 7 b | 10 b | 120 | 84.1 | <0.3 |
| 971 | X | 4 a | 7 a | 11 a | 128 | 78.0 | <0.3 |
| 972 | X | 4 b | 7 a | 11 a | 116 | 79.4 | <0.3 |
| 973 | Ti | 4 a | 7 a | 10 a | 140 | 77.2 | <0.3 |
| 974 | Ti | 4 b | 7 a | 10 a | 128 | 78.7 | <0.3 |
| Comp. Ex. 34 | X | 4 a | 7 a | B | 185 | 78.0 | <0.3 |
| Comp. Ex. 35 | X | 4 b | 7 a | B | 168 | 79.4 | <0.3 |
| Comp. Ex. 36 | X | 4 c | 7 a | B | 177 | 82.3 | <0.3 |

As is apparent from the results in Table 49, the photosensitive materials of Examples 958 to 974 are superior in sensitivity characteristics to those of Comparative Examples 34 to 36 using an electron attractive compound of the formula (B) having a redox potential of less than −0.8 V and those of Examples 558, 559, etc. containing no electron attractive compound because of their low potential after exposure $V_L$ (V), and are superior in durability and heat resistance to those of Comparative Examples 29 and 30 using conventional benzidine (A) because the extrapolated glass transition initiation temperature Tig (°C.) is high and no dent is observed.

Examples 975 to 991 and Comparative Examples 37 to 39

According to the same manner as that described in Examples 920 to 937 and Comparative Examples 26 to 28 except for using 50 parts by weight of a compound which belongs to the benzidine derivative represented by the formula (5) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 50.

TABLE 50

| Example No. | CGM | HTM | ETM | EAC | $V_L$ (V) | Tig (°C.) | Dent (μm) |
|---|---|---|---|---|---|---|---|
| 975 | X | 5 a | 7 a | 10 a | 127 | 80.3 | <0.3 |
| 976 | X | 5 b | 7 a | 10 a | 109 | 77.4 | <0.3 |
| 977 | X | 5 c | 7 a | 10 a | 107 | 78.1 | <0.3 |
| 978 | X | 5 d | 7 a | 10 a | 128 | 79.6 | <0.3 |
| 979 | X | 5 a | 7 b | 10 a | 132 | 81.7 | <0.3 |
| 980 | X | 5 b | 7 b | 10 a | 113 | 78.8 | <0.3 |
| 981 | X | 5 c | 7 b | 10 a | 111 | 79.6 | <0.3 |
| 982 | X | 5 a | 7 a | 10 b | 135 | 79.9 | <0.3 |
| 983 | X | 5 b | 7 a | 10 b | 116 | 77.0 | <0.3 |
| 984 | X | 5 c | 7 a | 10 b | 114 | 77.7 | <0.3 |
| 985 | X | 5 a | 7 b | 10 b | 140 | 81.3 | <0.3 |
| 986 | X | 5 b | 7 b | 10 b | 120 | 78.4 | <0.3 |
| 987 | X | 5 c | 7 b | 10 b | 118 | 79.2 | <0.3 |
| 988 | X | 5 a | 7 a | 11 a | 143 | 79.4 | <0.3 |
| 989 | X | 5 b | 7 a | 11 a | 122 | 76.6 | <0.3 |
| 990 | Ti | 5 a | 7 a | 10 a | 158 | 78.7 | <0.3 |
| 991 | Ti | 5 b | 7 a | 10 a | 135 | 75.9 | <0.3 |
| Comp. Ex. 37 | X | 5 a | 7 a | B | 207 | 79.4 | <0.3 |
| Comp. Ex. 38 | X | 5 b | 7 a | B | 177 | 76.6 | <0.3 |
| Comp. Ex. 39 | X | 5 c | 7 a | B | 174 | 77.3 | <0.3 |

As is apparent from the results in Table 50, the photosensitive materials of Examples 975 to 991 are superior in sensitivity characteristics to those of Comparative Examples 37 to 39 using an electron attractive compound of the formula (B) having a redox potential of less than −0.8 V and those of Examples 580, 581, etc. containing no electron attractive compound because of their low potential after exposure $V_L$ (V), and are superior in durability and heat resistance to those of Comparative Examples 29 and 30 using conventional benzidine (A) because the extrapolated glass transition initiation temperature Tig (°C.) is high and no dent is observed.

Examples 992 to 1018 and Comparative Examples 40 to 42

According to the same manner as that described in Examples 920 to 937 and Comparative Examples 26 to 28 except for using 50 parts by weight of a compound which belongs to the phenylendiamine derivative represented by the formula (6) as the hole transferring material, a single-layer type photosensitive material for digital light source, which has a single-layer type photosensitive layer of 15 to 20 μm in film thickness, was produced.

According to the same manner as that described above, the potential after exposure $V_L$ (V) and amount of wear (μm) were determined as to the single-layer type photosensitive materials of the above respective Examples and Comparative Examples, and their characteristics were evaluated. The results are shown in Tables 51 and 52, together with the above data in Comparative Examples 29 and 30.

TABLE 51

| Example No. | CGM | HTM | ETM | EAC | $V_L$ (V) | Amount of wear (μm) |
|---|---|---|---|---|---|---|
| 992 | X | 6 a | 7 a | 10 a | 126 | 3.4 |
| 993 | X | 6 b | 7 a | 10 a | 127 | 3.1 |
| 994 | X | 6 c | 7 a | 10 a | 124 | 3.2 |
| 995 | X | 6 d | 7 a | 10 a | 128 | 3.8 |
| 996 | X | 6 e | 7 a | 10 a | 127 | 3.4 |
| 997 | X | 6 f | 7 a | 10 a | 124 | 2.9 |
| 998 | X | 6 g | 7 a | 10 a | 127 | 3.3 |
| 999 | X | 6 h | 7 a | 10 a | 128 | 4.0 |
| 1000 | X | 6 i | 7 a | 10 a | 126 | 3.2 |
| 1001 | X | 6 j | 7 a | 10 a | 125 | 3.4 |
| 1002 | X | 6 k | 7 a | 10 a | 127 | 3.3 |
| 1003 | X | 6 l | 7 a | 10 a | 128 | 3.1 |
| 1004 | X | 6 m | 7 a | 10 a | 127 | 3.5 |
| 1005 | X | 6 n | 7 a | 10 a | 129 | 2.9 |

TABLE 52

| Example No. | CGM | HTM | ETM | EAC | $V_L$ (V) | Amount of wear (μm) |
|---|---|---|---|---|---|---|
| 1006 | X | 6 b | 7 b | 10 a | 131 | 3.4 |
| 1007 | X | 6 f | 7 b | 10 a | 129 | 3.2 |
| 1008 | X | 6 h | 7 b | 10 a | 133 | 3.1 |
| 1009 | X | 6 b | 7 a | 10 b | 135 | 3.3 |
| 1010 | X | 6 f | 7 a | 10 b | 132 | 3.4 |
| 1011 | X | 6 h | 7 a | 10 b | 136 | 3.2 |
| 1012 | X | 6 b | 7 b | 10 b | 139 | 3.1 |
| 1013 | X | 6 f | 7 b | 10 b | 137 | 3.5 |
| 1014 | X | 6 h | 7 b | 10 b | 141 | 3.4 |
| 1015 | X | 6 b | 7 a | 11 a | 143 | 2.9 |
| 1016 | X | 6 f | 7 a | 11 a | 140 | 3.2 |
| 1017 | Ti | 6 b | 7 a | 10 a | 158 | 3.2 |
| 1018 | Ti | 6 f | 7 a | 10 a | 154 | 3.1 |
| Comp. Ex. 40 | X | 6 b | 7 a | B | 207 | 2.8 |
| Comp. Ex. 41 | X | 6 f | 7 a | B | 202 | 2.9 |
| Comp. Ex. 42 | X | 6 h | 7 a | B | 208 | 3.2 |
| Comp. Ex. 29 | X | A | 7 a | 10 a | 131 | 5.0 |
| Comp. Ex. 30 | X | A | 7 b | 10 a | 136 | 4.9 |

As is apparent from the results in Tables 51 and 52 the photosensitive materials of Examples 992 to 1018 are superior in sensitivity characteristics to those of Comparative Examples 40 to 42 using an electron attractive compound of the formula (B) having a redox potential of less than −0.8 V and those of Examples 603, 607, etc. containing no electron attractive compound because of their low potential after exposure $V_L$ (V), and are superior in durability, particularly wear resistance, to those of Comparative Examples 29 and 30 using conventional benzidine (A) because of their small amount of wear.

Examples 1019 to 1036 and Comparative Examples 43 to 45

According to the same manner as that described in Examples 920 to 937 and Comparative Examples 26 to 28 except for using 30 parts by weight of a compound which belongs to the trinitrofluorenoneimine derivative represented by the formula (8) as the electron transferring material, a single-layer type photosensitive material for digital light source which has a single-layer type photosensitive layer of 15 to 20 μm in film thickness was produced.

Comparative Examples 46 and 47

According to the same manner as that described in Examples 1019 to 1036 except for using 50 parts by weight of a conventional benzidine derivative represented by the formula (A) as the hole transferring material, a single-layer type photosensitive material for digital light source,which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 53.

TABLE 53

| Example No. | CGM | HTM | ETM | EAC | $V_L$ (V) | Tig (°C.) | Dent (μm) |
|---|---|---|---|---|---|---|---|
| 1019 | X | 2 a | 8 a | 10 a | 110 | 77.6 | <0.3 |
| 1020 | X | 2 b | 8 a | 10 a | 89 | 74.1 | <0.3 |
| 1021 | X | 2 c | 8 a | 10 a | 84 | 76.3 | <0.3 |
| 1022 | X | 2 d | 8 a | 10 a | 110 | 75.7 | <0.3 |
| 1023 | X | 2 e | 8 a | 10 a | 93 | 79.1 | <0.3 |
| 1024 | X | 2 a | 8 b | 10 a | 142 | 75.8 | <0.3 |
| 1025 | X | 2 b | 8 b | 10 a | 116 | 75.7 | <0.3 |
| 1026 | X | 2 c | 8 b | 10 a | 110 | 77.7 | <0.3 |
| 1027 | X | 2 a | 8 a | 10 b | 116 | 77.2 | <0.3 |
| 1028 | X | 2 b | 8 a | 10 b | 94 | 73.7 | <0.3 |
| 1029 | X | 2 c | 8 a | 10 b | 89 | 76.0 | <0.3 |
| 1030 | X | 2 a | 8 b | 10 b | 151 | 75.4 | <0.3 |
| 1031 | X | 2 b | 8 b | 10 b | 123 | 75.3 | <0.3 |
| 1032 | X | 2 c | 8 b | 10 b | 116 | 77.3 | <0.3 |
| 1033 | X | 2 a | 8 a | 11 a | 123 | 76.8 | <0.3 |
| 1034 | X | 2 b | 8 a | 11 a | 100 | 73.3 | <0.3 |
| 1035 | Ti | 2 a | 8 a | 10 a | 121 | 77.3 | <0.3 |
| 1036 | Ti | 2 b | 8 a | 10 a | 98 | 74.4 | <0.3 |
| Comp. Ex. 43 | X | 2 a | 8 a | B | 178 | 76.8 | <0.3 |
| Comp. Ex. 44 | X | 2 b | 8 a | B | 144 | 73.3 | <0.3 |
| Comp. Ex. 45 | X | 2 c | 8 a | B | 137 | 75.6 | <0.3 |
| Comp. Ex. 46 | X | A | 8 a | 10 a | 122 | 69.1 | 1.3 |
| Comp. Ex. 47 | X | A | 8 b | 10 a | 127 | 69.8 | 1.2 |

As is apparent from the results in Table 53, the photosensitive materials of Examples 1019 to 1036 are superior in sensitivity characteristics to those of Comparative Examples 43 to 45 using an electron attractive compound of the formula (B) having a redox potential of less than −0.8 V and those of Examples 640, 641, etc. containing no electron attractive compound because of their low potential after exposure $V_L$ (V), and are superior in durability and heat resistance to those of Comparative Examples 46 and 47 using conventional benzidine (A) because the extrapolated glass transition initiation temperature Tig (°C.) is high and no dent is observed.

Examples 1037 to 1056 and Comparative Examples 48 to 50

According to the same manner as that described in Examples 1019 to 1036 and Comparative Examples 43 to 45 except for using 50 parts by weight of a compound which belongs to the benzidine derivative represented by the formula (3) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 54.

TABLE 54

| Example No. | CGM | HTM | ETM | EAC | $V_L$ (V) | Tig (°C.) | Dent (μm) |
|---|---|---|---|---|---|---|---|
| 1037 | X | 3 a | 8 a | 10 a | 94 | 78.9 | <0.3 |
| 1038 | X | 3 b | 8 a | 10 a | 94 | 81.0 | <0.3 |
| 1039 | X | 3 c | 8 a | 10 a | 91 | 80.4 | <0.3 |
| 1040 | X | 3 d | 8 a | 10 a | 104 | 79.6 | <0.3 |
| 1041 | X | 3 e | 8 a | 10 a | 95 | 81.7 | <0.3 |
| 1042 | X | 3 f | 8 a | 10 a | 104 | 82.4 | <0.3 |
| 1043 | X | 3 g | 8 a | 10 a | 86 | 81.7 | <0.3 |
| 1044 | X | 3 a | 8 b | 10 a | 121 | 80.4 | <0.3 |
| 1045 | X | 3 b | 8 b | 10 a | 119 | 82.5 | <0.3 |
| 1046 | X | 3 c | 8 b | 10 a | 117 | 81.0 | <0.3 |
| 1047 | X | 3 a | 8 a | 10 b | 100 | 78.5 | <0.3 |
| 1048 | X | 3 b | 8 a | 10 b | 99 | 80.6 | <0.3 |
| 1049 | X | 3 c | 8 a | 10 b | 97 | 80.0 | <0.3 |
| 1050 | X | 3 a | 8 b | 10 b | 128 | 80.0 | <0.3 |
| 1051 | X | 3 b | 8 b | 10 b | 127 | 82.1 | <0.3 |
| 1052 | X | 3 c | 8 b | 10 b | 124 | 80.6 | <0.3 |
| 1053 | X | 3 a | 8 a | 11 a | 106 | 78.1 | <0.3 |
| 1054 | X | 3 b | 8 a | 11 a | 105 | 80.2 | <0.3 |
| 1055 | Ti | 3 a | 8 a | 10 a | 105 | 77.0 | <0.3 |
| 1056 | Ti | 3 b | 8 a | 10 a | 129 | 77.0 | <0.3 |
| Comp. Ex. 48 | X | 3 a | 8 a | B | 153 | 78.1 | <0.3 |
| Comp. Ex. 49 | X | 3 b | 8 a | B | 152 | 80.2 | <0.3 |
| Comp. Ex. 50 | X | 3 c | 8 a | B | 148 | 79.5 | <0.3 |

As is apparent from the results in Table 54, the photosensitive materials of Examples 1037 to 1056 are superior in sensitivity characteristics to those of Comparative Examples 48 to 50 using an electron attractive compound of the formula (B) having a redox potential of less than −0.8 V and those of Examples 666, 667, etc. containing no electron attractive compound because of their low potential after exposure $V_L$ (V), and are superior in durability and heat resistance to those of Comparative Examples 46 and 47 using conventional benzidine (A) because the extrapolated glass transition initiation temperature Tig (°C.) is high and no dent is observed.

Examples 1057to 1073 and Comparative Examples 51 to 53

According to the same manner as that described in Examples 1019 to 1036 and Comparative Examples 43 to 45 except for using 50 parts by weight of a compound which belongs to the benzidine derivative represented by the formula (4) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 55.

TABLE 55

| Example No. | CGM | HTM | ETM | EAC | $V_L$ (V) | Tig (°C.) | Dent (μm) |
|---|---|---|---|---|---|---|---|
| 1057 | X | 4 a | 8 a | 10 a | 99 | 79.6 | <0.3 |
| 1058 | X | 4 b | 8 a | 10 a | 90 | 81.0 | <0.3 |
| 1059 | X | 4 c | 8 a | 10 a | 94 | 83.9 | <0.3 |
| 1060 | X | 4 d | 8 a | 10 a | 94 | 84.7 | <0.3 |
| 1061 | X | 4 a | 8 b | 10 a | 129 | 81.0 | <0.3 |
| 1062 | X | 4 b | 8 b | 10 a | 117 | 82.5 | <0.3 |
| 1063 | X | 4 c | 8 b | 10 a | 123 | 85.5 | <0.3 |
| 1064 | X | 4 a | 8 a | 10 b | 105 | 79.2 | <0.3 |
| 1065 | X | 4 b | 8 a | 10 b | 95 | 80.6 | <0.3 |
| 1066 | X | 4 c | 8 a | 10 b | 100 | 83.5 | <0.3 |
| 1067 | X | 4 a | 8 b | 10 b | 137 | 80.6 | <0.3 |
| 1068 | X | 4 b | 8 b | 10 b | 124 | 82.1 | <0.3 |
| 1069 | X | 4 c | 8 b | 10 b | 131 | 85.0 | <0.3 |
| 1070 | X | 4 a | 8 a | 11 a | 112 | 78.8 | <0.3 |
| 1071 | X | 4 b | 8 a | 11 a | 101 | 80.2 | <0.3 |
| 1072 | Ti | 4 a | 8 a | 10 a | 125 | 78.0 | <0.3 |
| 1073 | Ti | 4 b | 8 a | 10 a | 113 | 79.5 | <0.3 |
| Comp. Ex. 51 | X | 4 a | 8 a | B | 161 | 78.8 | <0.3 |
| Comp. Ex. 52 | X | 4 b | 8 a | B | 146 | 80.2 | <0.3 |
| Comp. Ex. 53 | X | 4 c | 8 a | B | 153 | 83.0 | <0.3 |

As is apparent from the results in Table 55, the photosensitive materials of Examples 558 to 574 are superior in sensitivity characteristics to those of Comparative Examples 51 to 53 using an electron attractive compound of the formula (B) having a redox potential of less than −0.8 V and those of Examples 698, 699, etc. containing no electron attractive compound because of their low potential after exposure $V_L$ (V), and are superior in durability and heat resistance to those of Comparative Examples 46 and 47 using conventional benzidine (A) because the extrapolated glass transition initiation temperature Tig (°C.) is high and no dent is observed.

Examples 1074 to 1090 and Comparative Examples 54 to 56

According to the same manner as that described in Examples 1019 to 1036 and Comparative Examples 43 to 45 except for using 50 parts by weight of a compound which belongs to the benzidine derivative represented by the formula (5) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 56.

TABLE 56

| Example No. | CGM | HTM | ETM | EAC | $V_L$ (V) | Tig (°C.) | Dent (μm) |
|---|---|---|---|---|---|---|---|
| 1074 | X | 5 a | 8 a | 10 a | 110 | 81.0 | <0.3 |
| 1075 | X | 5 b | 8 a | 10 a | 94 | 78.2 | <0.3 |
| 1076 | X | 5 c | 8 a | 10 a | 94 | 78.9 | <0.3 |
| 1077 | X | 5 d | 8 a | 10 a | 111 | 80.4 | <0.3 |
| 1078 | X | 5 a | 8 b | 10 a | 144 | 82.5 | <0.3 |
| 1079 | X | 5 b | 8 b | 10 a | 123 | 79.6 | <0.3 |
| 1080 | X | 5 c | 8 b | 10 a | 122 | 80.4 | <0.3 |
| 1081 | X | 5 a | 8 a | 10 b | 117 | 80.6 | <0.3 |
| 1082 | X | 5 b | 8 a | 10 b | 100 | 77.8 | <0.3 |
| 1083 | X | 5 c | 8 a | 10 b | 99 | 78.5 | <0.3 |

TABLE 56-continued

| Example No. | CGM | HTM | ETM | EAC | $V_L$ (V) | Tig (°C.) | Dent (μm) |
|---|---|---|---|---|---|---|---|
| 1084 | X | 5 a | 8 b | 10 b | 153 | 82.1 | <0.3 |
| 1085 | X | 5 b | 8 b | 10 b | 131 | 79.2 | <0.3 |
| 1086 | X | 5 c | 8 b | 10 b | 129 | 80.0 | <0.3 |
| 1087 | X | 5 a | 8 a | 11 a | 124 | 80.2 | <0.3 |
| 1088 | X | 5 b | 8 a | 11 a | 106 | 77.4 | <0.3 |
| 1089 | Ti | 5 a | 8 a | 10 a | 137 | 79.5 | <0.3 |
| 1090 | Ti | 5 b | 8 a | 10 a | 118 | 77.3 | <0.3 |
| Comp. Ex. 54 | X | 5 a | 8 a | B | 279 | 80.2 | <0.3 |
| Comp. Ex. 55 | X | 5 b | 8 a | B | 179 | 77.4 | <0.3 |
| Comp. Ex. 56 | X | 5 c | 8 a | B | 152 | 78.1 | <0.3 |

As is apparent from the results in Table 56, the photosensitive materials of Examples 1074 to 1090 are superior in sensitivity characteristics to those of Comparative Examples 54 to 56 using an electron attractive compound of the formula (B) having a redox potential of less than −0.8 V and those of Examples 720, 721, etc. containing no electron attractive compound because of their low potential after exposure $V_L$ (V), and are superior in durability and heat resistance to those of Comparative Examples 46 and 47 using conventional benzidine (A) because the extrapolated glass transition initiation temperature Tig (°C.) is high and no dent is observed.

Examples 1091 to 1117 and Comparative Examples 57 to 59

According to the same manner as that described in Examples 1019 to 1036 and Comparative Examples 43 to 45 except for using 50 parts by weight of a compound which belongs to the phenylenediamine derivative represented by the formula (6) as the hole transferring material, a single-layer type photosensitive material for digital light source which has a single-layer type photosensitive layer of 15 to 20 μm in film thickness was produced.

According to the same manner as that described above, the potential after exposure $V_L$ (V) and amount of wear (μm) were determined as to the single-layer type photosensitive materials of the above respective Examples and Comparative Examples, and their characteristics were evaluated. The results are shown in Tables 57 and 58, together with the above data in Comparative Examples 46 and 47.

TABLE 57

| Example No. | CGM | HTM | ETM | EAC | $V_L$ (V) | Amount of wear (μm) |
|---|---|---|---|---|---|---|
| 1091 | X | 6 a | 8 a | 10 a | 110 | 3.3 |
| 1092 | X | 6 b | 8 a | 10 a | 112 | 3.3 |
| 1093 | X | 6 c | 8 a | 10 a | 109 | 2.9 |
| 1094 | X | 6 d | 8 a | 10 a | 113 | 3.1 |
| 1095 | X | 6 e | 8 a | 10 a | 112 | 3.2 |
| 1096 | X | 6 f | 8 a | 10 a | 109 | 3.5 |
| 1097 | X | 6 g | 8 a | 10 a | 112 | 3.1 |
| 1098 | X | 6 h | 8 a | 10 a | 113 | 3.2 |
| 1099 | X | 6 i | 8 a | 10 a | 110 | 3.1 |
| 1100 | X | 6 i | 8 a | 10 a | 110 | 3.0 |
| 1101 | X | 6 k | 8 a | 10 a | 112 | 3.2 |
| 1102 | X | 6 l | 8 a | 10 a | 113 | 3.3 |
| 1103 | X | 6 m | 8 a | 10 a | 112 | 2.9 |
| 1104 | X | 6 n | 8 a | 10 a | 114 | 2.8 |

TABLE 58

| Example No. | CGM | HTM | ETM | EAC | $V_L$ (V) | Amount of wear (μm) |
|---|---|---|---|---|---|---|
| 1105 | X | 6 b | 8 b | 10 a | 143 | 3.1 |
| 1106 | X | 6 f | 8 b | 10 a | 145 | 3.2 |
| 1107 | X | 6 h | 8 b | 10 a | 142 | 3.1 |
| 1108 | X | 6 b | 8 a | 10 b | 119 | 3.2 |
| 1109 | X | 6 f | 8 a | 10 b | 116 | 3.1 |
| 1110 | X | 6 h | 8 a | 10 b | 120 | 3.3 |
| 1111 | X | 6 b | 8 b | 10 b | 152 | 3.2 |
| 1112 | X | 6 f | 8 b | 10 b | 154 | 3.5 |
| 1113 | X | 6 h | 8 b | 10 b | 151 | 3.3 |
| 1114 | X | 6 b | 8 a | 11 a | 126 | 2.9 |
| 1115 | X | 6 f | 8 a | 11 a | 122 | 3.2 |
| 1116 | Ti | 6 b | 8 a | 10 a | 139 | 3.1 |
| 1117 | Ti | 6 f | 8 a | 10 a | 135 | 3.0 |
| Comp. Ex. 57 | X | 6 b | 8 a | B | 182 | 2.8 |
| Comp. Ex. 58 | X | 6 f | 8 a | B | 177 | 3.1 |
| Comp. Ex. 59 | X | 6 h | 8 a | B | 183 | 3.2 |
| Comp. Ex. 46 | X | A | 8 a | 10 a | 122 | 4.9 |
| Comp. Ex. 47 | X | A | 8 b | 10 a | 127 | 4.8 |

As is apparent from the results in Tables 57 and 58, the photosensitive materials of Examples 1091 to 1117 are superior in sensitivity characteristics to those of Comparative Examples 57 to 59 using an electron attractive compound of the formula (B) having a redox potential of less than −0.8 V and those of Examples 743, 747, etc. containing no electron attractive compound because of their low potential after exposure $V_L$ (V), and are superior in durability, particularly wear resistance, to those of Comparative Examples 46 and 47 using conventional benzidine (A) because of their small amount of wear.

Examples 1118 to 1135 and Comparative Examples 60 to 62

According to the same manner as that described in Examples 1019 to 1036 and Comparative Examples 43 to 45 except for using 30 parts by weight of a compound which belongs to the trinitrofluorenoneimine derivative represented by the formula (9) as the electron transferring material, a single-layer type photosensitive material for digital light source, which has a single-layer type photosensitive layer of 15 to 20 μm in film thickness, was produced.

Comparative Examples 63 and 64

According to the same manner as that described in Examples 1118 to 1135 except for using 50 parts by weight of a conventional benzidine derivative represented by the formula (A) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 59.

TABLE 59

| Example No. | CGM | HTM | ETM | EAC | $V_L$ (V) | Tig (°C.) | Dent (μm) |
|---|---|---|---|---|---|---|---|
| 1118 | X | 2 a | 9 a | 10 a | 136 | 78.4 | <0.3 |
| 1119 | X | 2 b | 9 a | 10 a | 110 | 75.0 | <0.3 |
| 1120 | X | 2 c | 9 a | 10 a | 105 | 77.0 | <0.3 |
| 1121 | X | 2 d | 9 a | 10 a | 136 | 75.7 | <0.3 |
| 1122 | X | 2 e | 9 a | 10 a | 115 | 76.3 | <0.3 |
| 1123 | X | 2 a | 9 b | 10 a | 129 | 79.9 | <0.3 |
| 1124 | X | 2 b | 9 b | 10 a | 106 | 76.4 | <0.3 |
| 1125 | X | 2 c | 9 b | 10 a | 100 | 78.4 | <0.3 |
| 1126 | X | 2 a | 9 a | 10 b | 145 | 78.0 | <0.3 |
| 1127 | X | 2 b | 9 a | 10 b | 117 | 74.6 | <0.3 |
| 1128 | X | 2 c | 9 a | 10 b | 111 | 76.6 | <0.3 |
| 1129 | X | 2 a | 9 b | 10 b | 137 | 79.5 | <0.3 |
| 1130 | X | 2 b | 9 b | 10 b | 112 | 76.1 | <0.3 |
| 1131 | X | 2 c | 9 b | 10 b | 106 | 78.0 | <0.3 |
| 1132 | X | 2 a | 9 a | 11 a | 153 | 77.6 | <0.3 |
| 1133 | X | 2 b | 9 a | 11 a | 124 | 74.2 | <0.3 |
| 1134 | Ti | 2 a | 9 a | 10 a | 150 | 78.2 | <0.3 |
| 1135 | Ti | 2 b | 9 a | 10 a | 122 | 75.1 | <0.3 |
| Comp. Ex. 60 | X | 2 a | 9 a | B | 221 | 77.6 | <0.3 |
| Comp. Ex. 61 | X | 2 b | 9 a | B | 179 | 74.2 | <0.3 |
| Comp. Ex. 62 | X | 2 c | 9 a | B | 170 | 76.2 | <0.3 |
| Comp. Ex. 63 | X | A | 9 a | 10 a | 134 | 69.4 | 1.3 |
| Comp. Ex. 64 | X | A | 9 b | 10 a | 138 | 68.5 | 1.4 |

As is apparent from the results in Table 59, the photosensitive materials of Examples 1118 to 1135 are superior in sensitivity characteristics to those of Comparative Examples 60 to 62 using an electron attractive compound of the formula (B) having a redox potential of less than −0.8 V and those of Examples 780, 781, etc. containing no electron attractive compound because of their low potential after exposure $V_L$ (V), and are superior in durability and heat resistance to those of Comparative Examples 63 and 64 using conventional benzidine (A) because the extrapolated glass transition initiation temperature Tig (°C.) is high and no dent is observed.

Examples 1136 to 1155 and Comparative Examples 65 to 67

According to the same manner as that described in Examples 1118 to 1135 and Comparative Examples 60 to 62 except for using 50 parts by weight of a compound which belongs to the benzidine derivative represented by the formula (3) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 60.

TABLE 60

| Example No. | CGM | HTM | ETM | EAC | $V_L$ (V) | Tig (°C.) | Dent (μm) |
|---|---|---|---|---|---|---|---|
| 1136 | X | 3 a | 9 a | 10 a | 118 | 79.7 | <0.3 |
| 1137 | X | 3 b | 9 a | 10 a | 116 | 81.8 | <0.3 |
| 1138 | X | 3 c | 9 a | 10 a | 113 | 81.1 | <0.3 |
| 1139 | X | 3 d | 9 a | 10 a | 129 | 80.4 | <0.3 |
| 1140 | X | 3 e | 9 a | 10 a | 118 | 82.5 | <0.3 |
| 1141 | X | 3 f | 9 a | 10 a | 129 | 83.3 | <0.3 |
| 1142 | X | 3 g | 9 a | 10 a | 106 | 82.6 | <0.3 |

TABLE 60-continued

| Example No. | CGM | HTM | ETM | EAC | $V_L$ (V) | Tig (°C.) | Dent (μm) |
|---|---|---|---|---|---|---|---|
| 1143 | X | 3 a | 9 b | 10 a | 112 | 81.1 | <0.3 |
| 1144 | X | 3 b | 9 b | 10 a | 110 | 83.4 | <0.3 |
| 1145 | X | 3 c | 9 b | 10 a | 108 | 82.6 | <0.3 |
| 1146 | X | 3 a | 9 a | 10 b | 125 | 79.3 | <0.3 |
| 1147 | X | 3 b | 9 a | 10 b | 123 | 81.4 | <0.3 |
| 1148 | X | 3 c | 9 a | 10 b | 120 | 80.7 | <0.3 |
| 1149 | X | 3 a | 9 b | 10 b | 119 | 81.4 | <0.3 |
| 1150 | X | 3 b | 9 b | 10 b | 117 | 83.7 | <0.3 |
| 1151 | X | 3 c | 9 b | 10 b | 115 | 84.3 | <0.3 |
| 1152 | X | 3 a | 9 a | 11 a | 132 | 78.9 | <0.3 |
| 1153 | X | 3 b | 9 a | 11 a | 131 | 81.0 | <0.3 |
| 1154 | Ti | 3 a | 9 a | 10 a | 130 | 75.7 | <0.3 |
| 1155 | Ti | 3 b | 9 a | 10 a | 160 | 77.8 | <0.3 |
| Comp. Ex. 65 | X | 3 a | 9 a | B | 191 | 78.9 | <0.3 |
| Comp. Ex. 66 | X | 3 b | 9 a | B | 189 | 81.0 | <0.3 |
| Comp. Ex. 67 | X | 3 c | 9 a | B | 183 | 80.3 | <0.3 |

As is apparent from the results in Table 60, the photosensitive materials of Examples 1136 to 1155 are superior in sensitivity characteristics to those of Comparative Examples 65 to 67 using an electron attractive compound of the formula (B) having a redox potential of less than −0.8 V and those of Examples 806, 807, etc. containing no electron attractive compound because of their low potential after exposure $V_L$ (V), and are superior in durability and heat resistance to those of Comparative Examples 63 and 64 using conventional benzidine (A) because the extrapolated glass transition initiation temperature Tig (°C.) is high and no dent is observed.

Examples 1156 to 1172 and Comparative Examples 68 to 70

According to the same manner as that described in Examples 1118 to 1135 and Comparative Examples 60 to 62 except for using 50 parts by weight of a compound which belongs to the benzidine derivative represented by the formula (4) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 61.

TABLE 61

| Example No. | CGM | HTM | ETM | EAC | $V_L$ (V) | Tig (°C.) | Dent (μm) |
|---|---|---|---|---|---|---|---|
| 1156 | X | 4 a | 9 a | 10 a | 122 | 80.4 | <0.3 |
| 1157 | X | 4 b | 9 a | 10 a | 111 | 81.8 | <0.3 |
| 1158 | X | 4 c | 9 a | 10 a | 118 | 84.8 | <0.3 |
| 1159 | X | 4 d | 9 a | 10 a | 118 | 85.5 | <0.3 |
| 1160 | X | 4 a | 9 b | 10 a | 118 | 81.8 | <0.3 |
| 1161 | X | 4 b | 9 b | 10 a | 106 | 83.4 | <0.3 |
| 1162 | X | 4 c | 9 b | 10 a | 106 | 86.2 | <0.3 |
| 1163 | X | 4 a | 9 a | 10 b | 130 | 80.0 | <0.3 |
| 1164 | X | 4 b | 9 a | 10 b | 118 | 81.4 | <0.3 |
| 1165 | X | 4 c | 9 a | 10 b | 125 | 84.3 | <0.3 |
| 1166 | X | 4 a | 9 b | 10 b | 125 | 81.4 | <0.3 |
| 1167 | X | 4 b | 9 b | 10 b | 113 | 83.0 | <0.3 |
| 1168 | X | 4 c | 9 b | 10 b | 119 | 85.8 | <0.3 |
| 1169 | X | 4 a | 9 a | 11 a | 138 | 79.5 | <0.3 |

TABLE 61-continued

| Example No. | CGM | HTM | ETM | EAC | $V_L$ (V) | Tig (°C.) | Dent (μm) |
|---|---|---|---|---|---|---|---|
| 1170 | X | 4 b | 9 a | 11 a | 125 | 81.0 | <0.3 |
| 1171 | Ti | 4 a | 9 a | 10 a | 151 | 78.8 | <0.3 |
| 1172 | Ti | 4 b | 9 a | 10 a | 138 | 80.3 | <0.3 |
| Comp. Ex. 68 | X | 4 a | 9 a | B | 199 | 79.5 | <0.3 |
| Comp. Ex. 69 | X | 4 b | 9 a | B | 181 | 81.0 | <0.3 |
| Comp. Ex. 70 | X | 4 c | 9 a | B | 191 | 83.9 | <0.3 |

As is apparent from the results in Table 61, the photosensitive materials of Examples 1156 to 1172 are superior in sensitivity characteristics to those of Comparative Examples 68 to 70 using an electron attractive compound of the formula (B) having a redox potential of less than −0.8 V and those of Examples 838 and 839 containing no electron attractive compound because of their low potential after exposure $V_L$ (V), and are superior in durability and heat resistance to those of Comparative Examples 63 and 64 using conventional benzidine (A) because the extrapolated glass transition initiation temperature Tig (°C.) is high and no dent is observed.

Examples 1173 to 1189 and Comparative Examples 71 to 73

According to the same manner as that described in Examples 1118 to 1135 and Comparative Examples 60 to 62 except for using 50 parts by weight of a compound which belongs to the benzidine derivative represented by the formula (5) as the hole transferring material, a single-layer type photosensitive material for digital light source which has a single-layer type photosensitive layer of 15 to 20 μm in film thickness was produced.

According to the same manner as that described above, the potential after exposure $V_L$ (V), extrapolated glass transition initiation temperature Tig (°C.) and maximum depth of dent (μm) were determined as to the single-layer type photosensitive materials of the above respective Examples and Comparative Examples, and their characteristics were evaluated. The results are shown in Table 62.

TABLE 62

| Example No. | CGM | HTM | ETM | EAC | $V_L$ (V) | Tig (°C.) | Dent (μm) |
|---|---|---|---|---|---|---|---|
| 1173 | X | 5 a | 9 a | 10 a | 138 | 81.8 | <0.3 |
| 1174 | X | 5 b | 9 a | 10 a | 118 | 79.0 | <0.3 |
| 1175 | X | 5 c | 9 a | 10 a | 116 | 79.7 | <0.3 |
| 1176 | X | 5 d | 9 a | 10 a | 138 | 81.1 | <0.3 |
| 1177 | X | 5 a | 9 b | 10 a | 130 | 83.4 | <0.3 |
| 1178 | X | 5 b | 9 b | 10 a | 112 | 80.4 | <0.3 |
| 1179 | X | 5 c | 9 b | 10 a | 110 | 81.1 | <0.3 |
| 1180 | X | 5 a | 9 a | 10 b | 146 | 81.4 | <0.3 |
| 1181 | X | 5 b | 9 a | 10 b | 125 | 78.6 | <0.3 |
| 1182 | X | 5 c | 9 a | 10 b | 123 | 79.3 | <0.3 |
| 1183 | X | 5 a | 9 b | 10 b | 139 | 83.0 | <0.3 |
| 1184 | X | 5 b | 9 b | 10 b | 119 | 80.0 | <0.3 |
| 1185 | X | 5 c | 9 b | 10 b | 117 | 80.7 | <0.3 |
| 1186 | X | 5 a | 9 a | 11 a | 155 | 81.0 | <0.3 |
| 1187 | X | 5 b | 9 a | 11 a | 132 | 78.2 | <0.3 |
| 1188 | Ti | 5 a | 9 a | 10 a | 170 | 185.0 | <0.3 |
| 1189 | Ti | 5 b | 9 a | 10 a | 146 | 159.0 | <0.3 |
| Comp. Ex. 71 | X | 5 a | 9 a | B | 224 | 81.0 | <0.3 |
| Comp. Ex. 72 | X | 5 b | 9 a | B | 191 | 78.2 | <0.3 |
| Comp. Ex. 73 | X | 5 c | 9 a | B | 189 | 78.9 | <0.3 |

As is apparent from the results in Table 62, the photosensitive materials of Examples 1173 to 1189 are superior in sensitivity characteristics to those of Comparative Examples 71 to 73 using an electron attractive compound of the formula (B) having a redox potential of less than −0.8 V and those of Examples 860, 861, etc. containing no electron attractive compound because of their low potential after exposure $V_L$ (V), and are superior in durability and heat resistance to those of Comparative Examples 63 and 64 using conventional benzidine (A) because the extrapolated glass transition initiation temperature Tig (°C.) is high and no dent is observed.

Examples 1190 to 1216 and Comparative Examples 74 to 76

According to the same manner as that described in Examples 1118 to 1135 and Comparative Examples 60 to 62 except for using 50 parts by weight of a compound which belongs to the phenylenediamine derivative represented by the formula (6) as the hole transferring material, a single-layer type photosensitive material for digital light source which has a single-layer type photosensitive layer of 15 to 20 μm in film thickness was produced.

According to the same manner as that described above, the potential after exposure $V_L$ (V) and amount of wear (μm) were determined as to the single-layer type photosensitive materials of the above respective Examples and Comparative Examples, and their characteristics were evaluated. The results are shown in Tables 63 and 64, together with the above data in Comparative Examples 63 and 64.

TABLE 63

| Example No. | CGM | HTM | ETM | EAC | $V_L$ (V) | Amount of wear (μm) |
|---|---|---|---|---|---|---|
| 1190 | X | 6 a | 9 a | 10 a | 119 | 3.1 |
| 1191 | X | 6 b | 9 a | 10 a | 121 | 3.3 |
| 1192 | X | 6 c | 9 a | 10 a | 118 | 3.5 |
| 1193 | X | 6 d | 9 a | 10 a | 122 | 3.1 |
| 1194 | X | 6 e | 9 a | 10 a | 121 | 3.1 |
| 1195 | X | 6 f | 9 a | 10 a | 118 | 3.0 |
| 1196 | X | 6 g | 9 a | 10 a | 121 | 3.2 |
| 1197 | X | 6 h | 9 a | 10 a | 122 | 3.2 |
| 1198 | X | 6 i | 9 a | 10 a | 119 | 3.3 |
| 1199 | X | 6 j | 9 a | 10 a | 118 | 2.9 |
| 1200 | X | 6 k | 9 a | 10 a | 121 | 2.8 |
| 1201 | X | 6 l | 9 a | 10 a | 122 | 3.3 |
| 1202 | X | 6 m | 9 a | 10 a | 121 | 3.1 |
| 1203 | X | 6 n | 9 a | 10 a | 122 | 3.2 |

TABLE 64

| Example No. | CGM | HTM | ETM | EAC | $V_L$ (V) | Amount of wear (μm) |
|---|---|---|---|---|---|---|
| 1204 | X | 6 b | 9 b | 10 a | 144 | 3.1 |
| 1205 | X | 6 f | 9 b | 10 a | 143 | 3.2 |
| 1206 | X | 6 h | 9 b | 10 a | 141 | 3.5 |
| 1207 | X | 6 b | 9 a | 10 b | 128 | 3.3 |
| 1208 | X | 6 f | 9 a | 10 b | 125 | 2.9 |
| 1209 | X | 6 h | 9 a | 10 b | 129 | 3.2 |
| 1210 | X | 6 b | 9 b | 10 b | 153 | 3.2 |
| 1211 | X | 6 f | 9 b | 10 b | 152 | 3.5 |
| 1212 | X | 6 h | 9 b | 10 b | 150 | 3.3 |
| 1213 | X | 6 b | 9 a | 11 a | 136 | 2.9 |
| 1214 | X | 6 f | 9 a | 11 a | 132 | 3.2 |
| 1215 | Ti | 6 b | 9 a | 10 a | 149 | 3.1 |
| 1216 | Ti | 6 f | 9 a | 10 a | 146 | 3.0 |
| Comp. Ex. 74 | X | 6 b | 9 a | B | 196 | 2.8 |
| Comp. Ex. 75 | X | 6 f | 9 a | B | 191 | 3.1 |
| Comp. Ex. 76 | X | 6 h | 9 a | B | 198 | 3.2 |
| Comp. Ex. 63 | X | A | 9 a | 10 a | 134 | 5.1 |
| Comp. Ex. 64 | X | A | 9 b | 10 a | 138 | 5.2 |

As is apparent from the results in Tables 63 and 64, the photosensitive materials of Examples 1190 to 1216 are superior in sensitivity characteristics to those of Comparative Examples 74 to 76 using an electron attractive compound of the formula (B) having a redox potential of less than −0.8 V and those of Examples 883, 887, etc. containing no electron attractive compound because of their low potential after exposure $V_L$ (V), and are superior in durability, particularly wear resistance, to Comparative Examples 63 and 64 using conventional benzidine (A) because of their small amount of wear.

What is claimed is:

1. An electrophotosensitive material comprising an organic photosensitive layer on a conductive substrate, the organic photosensitive layer comprising a binding resin, at least one selected from bisazo pigments represented by the formulas (I) to (V):

(I)

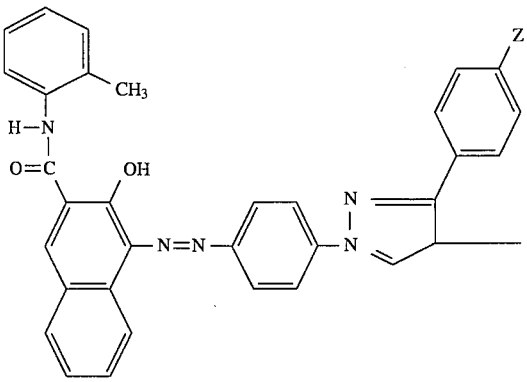

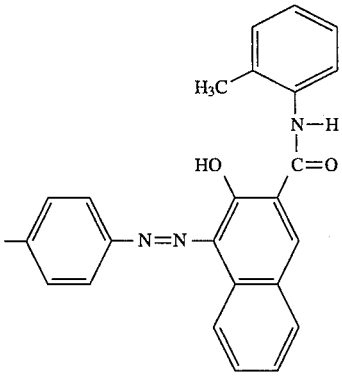

(II)

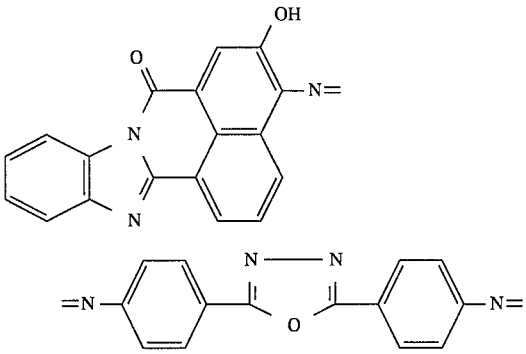

-continued

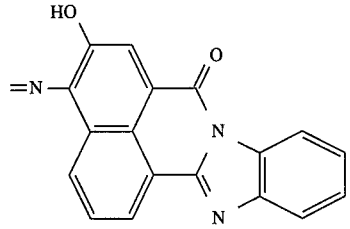

(III)

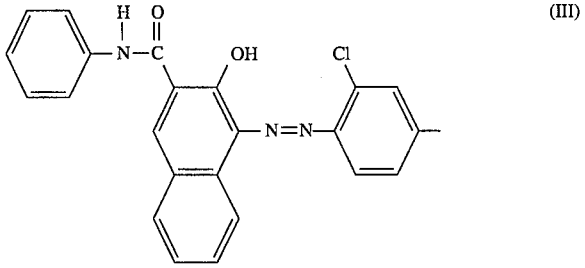

(IV)

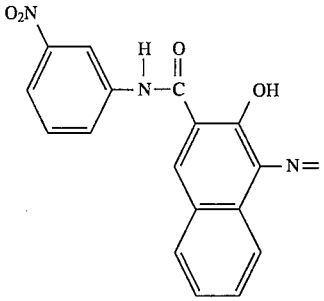

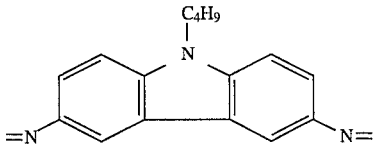

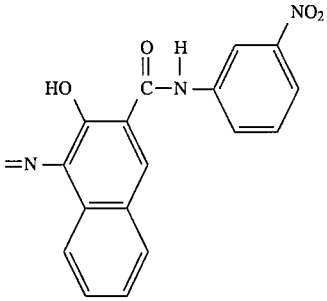

-continued (V)

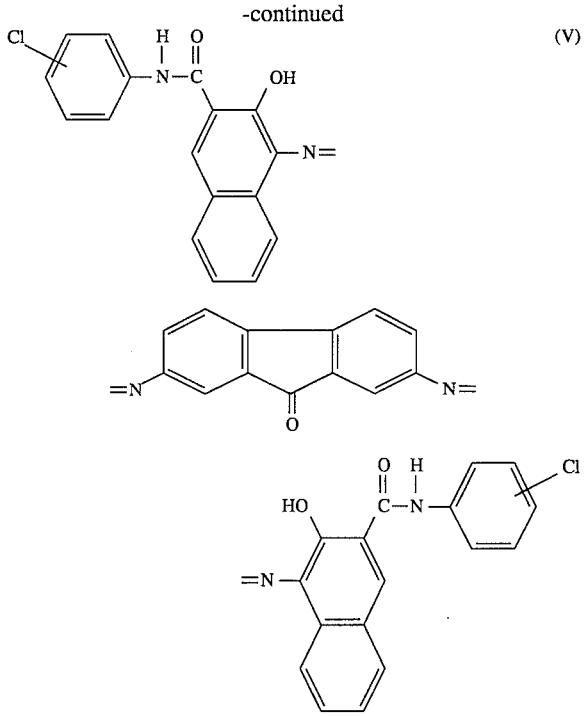

[in the formula (I), Z is a methyl group or a methoxy group] as an electric charge generating material, and a trinitrofluorenoneimine derivative represented by the formula (1):

(1)

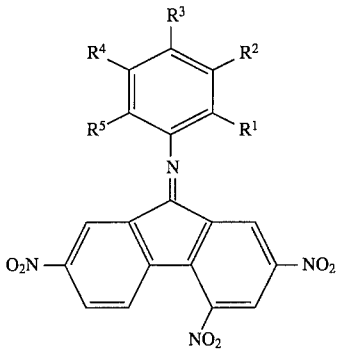

[wherein $R^1$, $R^2$, $R^3$, $R^4$ and $R^5$ are the same or different and indicate a hydrogen atom, an alkyl group, an alkoxy group, an aryl group which may contain a substituent, an aralkyl group which may contain a substituent, or a halogen atom] as an electron transferring material.

2. An electrophotosensitive material comprising an organic photosensitive layer on a conductive substrate, the organic photosensitive layer comprising a binding resin, at least one selected from bisazo pigments represented by the formulas (I) to (V) of claim 1 as an electric charge generating material, a trinitrofluorenoneimine derivative represented by the formula (7):

(7)

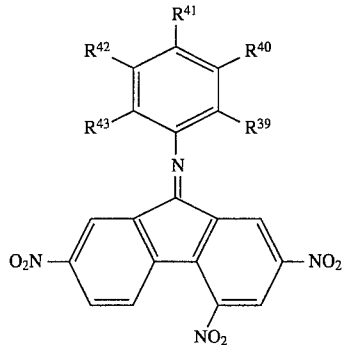

[wherein $R^{39}$, $R^{40}$, $R^{41}$, $R^{42}$ and $R^{43}$ are the same or different and indicate a hydrogen atom, an alkyl group, an alkoxy group or a halogen atom] as an electron transferring material, and at least one selected from compounds represented by the following formulas (2) to (6) as a hole transferring material, (2)

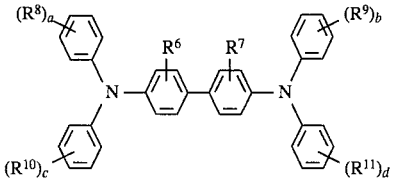

[wherein $R^6$ and $R^7$ are the same or different and indicate a hydrogen atom or an alkyl group; $R^8$, $R^9$, $R^{10}$ and $R^{11}$ are the same or different and indicate an alkyl group, an alkoxy group or a halogen atom; and a, b, c and d are the same or different and indicate an integer of 0 to 5; provided that at least one of a, b, c and d indicates an integer of 2 or more, and c and d indicate an integer other than 0 when a and b indicate 0, simultaneously]

(3)

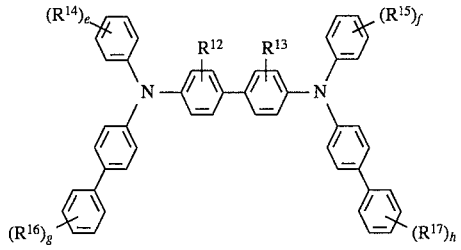

[wherein $R^{12}$ and $R^{13}$ are the same or different and indicate a hydrogen atom or an alkyl group; $R^{14}$ and $R^{15}$ are the same or different and indicate an alkyl group, an alkoxy group, an aryl group which may contain a substituent, or a halogen atom; $R^{16}$ and $R^{17}$ are the same or different and indicate an alkyl group, an alkoxy group or a halogen atom; and e, f, g and h are the same or different and indicate an integer of 0 to 5]

(4)

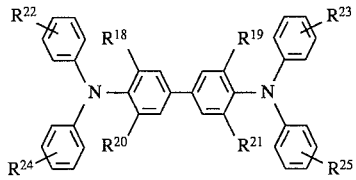

[wherein $R^{18}$, $R^{19}$, $R^{20}$ and $R^{21}$ are the same or different and indicate an alkyl group: and $R^{22}$, $R^{23}$, $R^{24}$ and $R^{25}$ are the same or different and indicate a hydrogen atom, an alkyl group, an alkoxy group, an aryl group which may contain a substituent, or a halogen atom]

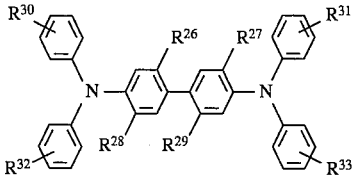

(5)

[wherein $R^{26}$, $R^{27}$, $R^{28}$ and $R^{29}$ are the same or different and indicate an alkyl group: and $R^{30}$, $R^{31}$, $R^{32}$ and $R^{33}$ are the same or different and indicate a hydrogen atom, an alkyl group, an alkoxy group, an aryl group which may contain a substituent, or a halogen atom]

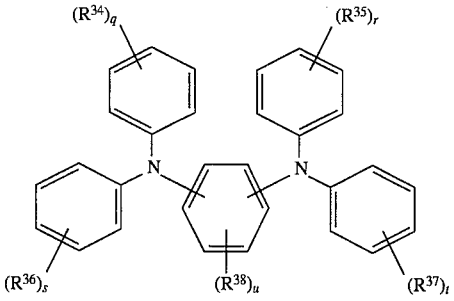

(6)

[wherein $R^{34}$, $R^{35}$, $R^{36}$ and $R^{37}$ are the same or different and indicate an alkyl group, an alkoxy group, an aryl group which may contain a substituent, a halogen atom, an amino group or a N-substituted amino group; $R^{38}$ is an alkyl group, an alkoxy group, a halogen atom, an amino group, a N-substituted amino group, an allyl group, an aryl group which may contain a substituent, or an electron attractive group; q, r, s and t are the same or different and indicate an integer of 0 to 5; and u is an integer of 0 to 2 ].

3. An electrophotosensitive material comprising an organic photosensitive layer on a conductive substrate, the organic photosensitive layer comprising a binding resin, at least one selected from bisazo pigments represented by the formulas (I) to (V) of claim 1 as an electric charge generating material, a trinitrofluorenoneimine derivative represented by the formula (8):

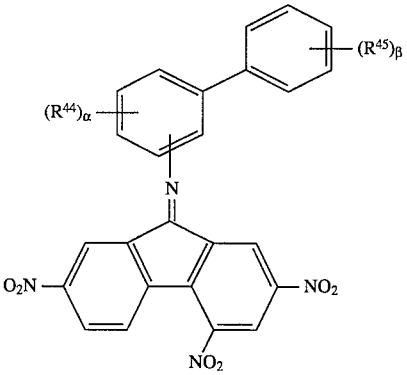

(8)

[wherein $R^{44}$ and $R^{45}$ are the same or different and indicate an alkyl group, an alkoxy group or a halogen atom; and α and β indicate an integer, the sum of which is 0 to 4] as an electric transferring material, and at least one selected from compounds represented by the formulas (2) to (6) of claim 2 as a hole transferring material.

4. An electrophotosensitive material comprising an organic photosensitive layer on a conductive substrate, the organic photosensitive layer comprising a binding resin, at least one selected from bisazo pigments represented by the formulas (I) to (V) of claim 1 as an electric charge generating material, a trinitrofluorenoneimine derivative represented by the formula (9):

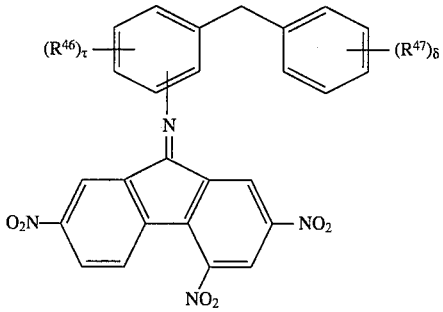

(9)

[wherein $R^{46}$ and $R^{47}$ are the same or different and indicate an alkyl group, an alkoxy group or a halogen atom; and γ and δ indicate an integer, the sum of which is 0 to 4] as an electric transferring material and at least one selected from compounds represented by the formulas (2) to (6) of claim 2 as a hole transferring material.

5. An electrophotosensitive material comprising an organic photosensitive layer on a conductive substrate, the organic photosensitive layer comprising a binding resin, an electric charge generating material, the trinitrofluorenoneimine derivative represented by the formula (1) of claim 1 as an electron transferring material and at least one selected from compounds represented by the formulas (2) to (6) of claim 2 as a hole transferring material.

6. The electrophotosensitive material according to claim 5, wherein the organic photosensitive layer further contains an electron attractive compound having a redox potential of −0.8 to −1.4 V.

7. The electrophotosensitive material according to claim 5, wherein the electric charge generating material is a phthalocyanine pigment.

8. An electrophotosensitive material comprising an organic photosensitive layer on a conductive substrate, the organic photosensitive layer comprising a binding resin, an electric charge generating material, the trinitrofluorenoneimine derivative represented by the formula (7) of claim 2 as an electron transferring material and at least one selected from compounds represented by the formulas (2) to (6) of claim 2 as a hole transferring material.

9. The electrophotosensitive material according to claim 8, wherein the organic photosensitive layer further contains an electron attractive compound having a redox potential of −0.8 to −1.4 V.

10. An electrophotosensitive material comprising an organic photosensitive layer on a conductive substrate, the organic photosensitive layer comprising a binding resin, an electric charge generating material, the trinitrofluorenoneimine derivative represented by the formula (8) of claim 3 as an electron transferring material and at least one selected from compounds represented by the formulas (2)to (6) of claim 2 as a hole transferring material.

11. The electrophotosensitive material according to claim 10, wherein the organic photosensitive layer further contains an electron attractive compound having a redox potential of −0.8 to −1.4 V.

12. An electrophotosensitive material comprising an organic photosensitive layer on a conductive substrate, the organic photosensitive layer comprising a binding resin, an electric charge generating material, the trinitrofluorenon-eimine derivative represented by the formula (9) of claim 4 as an electron transferring material and at least one selected from compounds represented by the formulas (2) to (6) of claim 2 as a hole transferring material.

13. The electrophotosensitive material according to claim 12, wherein the organic photosensitive layer further contains an electron attractive compound having a redox potential of −0.8 to −1.4 V.

* * * * *